US007987804B2

(12) United States Patent
Shiomi et al.

(10) Patent No.: US 7,987,804 B2
(45) Date of Patent: Aug. 2, 2011

(54) BOAT PROPULSION ENGINE

(75) Inventors: Kazuyuki Shiomi, Wako (JP); Tetsuro Ikeno, Wako (JP); Takeshi Okada, Wako (JP); Toshiro Kiura, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 588 days.

(21) Appl. No.: 12/064,579

(22) PCT Filed: Aug. 18, 2006

(86) PCT No.: PCT/JP2006/316666

§ 371 (c)(1),
(2), (4) Date: Feb. 22, 2008

(87) PCT Pub. No.: WO2007/023928

PCT Pub. Date: Mar. 1, 2007

(65) Prior Publication Data

US 2009/0104825 A1 Apr. 23, 2009

(30) Foreign Application Priority Data

Aug. 22, 2005 (JP) ..... 2005-239970
Aug. 22, 2005 (JP) ..... 2005-239995
Aug. 22, 2005 (JP) ..... 2005-240120

(51) Int. Cl.
*B63H 20/32* (2006.01)
*B63H 20/34* (2006.01)
*B63B 1/16* (2006.01)
*B63B 1/24* (2006.01)

(52) U.S. Cl. ..... 114/274; 440/66; 440/76

(58) Field of Classification Search ..... 114/145 R, 114/145 A, 274, 280–282, 284–286; 440/66, 440/76–78; D12/309, 317
See application file for complete search history.

(56) References Cited

U.S. PATENT DOCUMENTS 1,576,237 A * 3/1926 Dawson ..... 440/66
2,748,400 A * 6/1956 Kregall ..... 114/55.55
2,751,875 A * 6/1956 Henry ..... 415/8
2,860,594 A * 11/1958 Kiekhaefer ..... 440/66
2,959,148 A * 11/1960 Canazzi ..... 440/66

(Continued)

FOREIGN PATENT DOCUMENTS

FR 2616744 A1 12/1988

(Continued)

OTHER PUBLICATIONS

Japanese Office Action dated Feb. 19, 2010, issued in corresponding Japanese Patent Application No. 2005-239995.

(Continued)

*Primary Examiner* — Ajay Vasudeva
(74) *Attorney, Agent, or Firm* — Westerman, Hattori, Daniels & Adrian, LLP

(57) ABSTRACT

A boat propulsion engine (1) comprises a main body (4) that extends substantially vertically in relation to a hull (Si), a lift generator (20) disposed in a rear portion of the main body (4), and supporting bodies (24) that support the lift generator (20) on the main body (4). The lift generator (20) has a surface (21*g*, 21*h*) that extends transversely relative to the main body (4) and that is located behind at least the main body (4). The supporting bodies (24) extend backward from the main body (4) to the lift generator (20) in a single vertical direction relative to a surface (21*g*, 21*h*) of the lift generator (20).

4 Claims, 35 Drawing Sheets

U.S. PATENT DOCUMENTS

| | | | | | |
|---|---|---|---|---|---|
| 3,433,195 | A | * | 3/1969 | Poole | 114/274 |
| 4,096,819 | A | * | 6/1978 | Evinrude | 440/71 |
| 4,205,618 | A | * | 6/1980 | Olsson | 114/281 |
| 4,738,644 | A | * | 4/1988 | Happel | 440/76 |
| 4,781,632 | A | * | 11/1988 | Litjens et al. | 440/66 |
| 4,948,384 | A | | 8/1990 | Bland et al. | |
| 4,968,275 | A | * | 11/1990 | Carlson | 440/66 |
| 5,178,089 | A | | 1/1993 | Hodel | |
| 5,203,275 | A | | 4/1993 | Brauner et al. | |
| 5,307,754 | A | | 5/1994 | Leonardis | |
| 5,638,765 | A | | 6/1997 | Poulos | |
| 5,645,009 | A | | 7/1997 | Lexau | |

FOREIGN PATENT DOCUMENTS

| | | | | |
|---|---|---|---|---|
| GB | 1005565 | A | | 9/1965 |
| JP | 57-60995 | A | | 4/1982 |
| JP | 57060995 | A | * | 4/1982 |
| JP | 59-130799 | A | | 7/1984 |

OTHER PUBLICATIONS

Japanese Office Action dated Feb. 19, 2010, issued in corresponding Japanese Patent Application No. 2005-240120.

International Search Report of PCT/JP2006/316658, date of mailing Nov. 17, 2006.

* cited by examiner

BOAT PROPULSION ENGINE

TECHNICAL FIELD

The present invention relates to a boat propulsion engine having a lift generator for generating lift so as to raise a stern when a hull (boat) starts moving from its standstill position.

BACKGROUND ART

In a boat that moves over water by means of the propulsive force of a boat propulsion engine, the stern is lowered and submerged underwater when the boat is at a standstill. When the hull begins to move, the stern further lowers and the bow rises. As a result, conical waves are created on the sides of the bow. The hull is oriented so as to go over the waves, i.e., it is placed the orientation for overcoming the bow waves. Thus, the hull is inclined when the boat begins to move. Since the resistance of the hull against the water (movement resistance) is great when the boat begins to move, achieving a sufficient boat speed (hull speed) is difficult to accomplish.

To increase the speed of the boats the orientation of the hull must be made nearly horizontal by raising the stern to a certain extent. However, the hull requires a long time to reach a near horizontal orientation if no special measures are taken. There is room for improvement in boat propulsion engines to allow the hull to accelerate quickly and smoothly. In view of this, in conventional practice, lift generators that raise the stern and the boat propulsion engine when the boat begins to move are disclosed in Japanese Patent Laid-Open Publication Nos. 57-60995 (JP-A-57-60995) and 59-130799 (JP-A-59-130799)

In the boat propulsion engine disclosed in the 57-60995 publication, an anti-cavitation plate, an anti-splash plate, and an accelerator plate are installed on a casing in the stated order upward from the propeller at the lowest position. The accelerator plate constitutes a lift generator and comprises a horizontal plate that extends to the sides both from the left and right sides of the casing.

However, the accelerator plate of the boat propulsion engine disclosed in the 57-60995 publication is a mere horizontal plate. Moreover, the rear end of the accelerator plate does not extend very far to the rear of the propellers. Therefore, there is little effect of quickly and smoothly raising the submerged stern when the boat propulsion engine begins to move, because it is difficult for the accelerator plate to create sufficient lift. Much time is required to move the orientation of the hull to be nearly horizontal, and smoother acceleration is difficult to achieve. Furthermore, the accelerator plate must be sufficiently rigid relative to lift.

In the boat propulsion engine disclosed in the 59-130799 publication, an anti-cavitation plate and a buoyancy plate are installed on the main body in the stated order upward from the propeller at the lowest position. The buoyancy plate constitutes a lift generator and comprises a plate that extends to the sides from both the left and right sides of the main body. The buoyancy plate has a blade shape in cross section when viewed from the side.

However, in the boat propulsion engine disclosed in the 59-130799 publication, the length of the buoyancy plate in the longitudinal direction is less than the length of the anti-cavitation plate in the longitudinal direction. Moreover, the rear end of the buoyancy plate is located farther forward than the rear end of the anti-cavitation plate. Therefore, there is little effect of quickly and smoothly raising the submerged stern when the boat propulsion engine begins to move, because it is difficult for the buoyancy plate to create sufficient lift. Much time is required to move the orientation of the hull to be nearly horizontal, and smoother acceleration is difficult to achieves. Furthermore, the buoyancy plate must be sufficiently rigid relative to lift.

Techniques for reinforcing the anti-cavitation plate and the buoyancy plate are disclosed in U.S. Pat. Nos. 4,738,644 and 5,645,009.

In the boat propulsion engine disclosed in U.S. Pat. No. 4,738,644, an anti-cavitation plate is provided around a housing above the propellers, and left and right fin plates are attached on the top surface of the anti-cavitation plate. The left and right fin plates comprise horizontal plates that are reinforced by a reinforcing member. Furthermore, a central part of the left and right fin plates is supported by the housing via a support brace.

However, the fin plates of the boat propulsion engine disclosed in U.S. Pat. No. 4,738,644 are essentially set to a length that lies within a range extending from the front end to the rear end of the anti-cavitation plate. Therefore, there is little effect of quickly and smoothly raising the submerged stern when the boat propulsion engine begins to move, because it is difficult for the fin plates to create sufficient lift. Much time is required to move the orientation of the hull to be nearly horizontal, and smoother acceleration is difficult to achieved. Also, the reinforcing member and the support brace cause resistance against the water when the hull is propelled by the boat propulsion engine.

In the boat propulsion engine disclosed in U.S. Pat. No. 5,645,009, an anti-cavitation plate is provided around a housing above the propeller, a horizontal mounting plate is attached to the top surface of the anti-cavitation plate, and a deflector plate is supported on the rear end of the mounting plate. The deflector plate is supported to be capable of swinging downward from a horizontal position. The deflector plate creates lift by swinging to be inclined backwards and downwards.

However, the deflector plate of the boat propulsion engine disclosed in U.S. Pat. No. 5,646,009 is switched between a horizontal position and an inclined position, and is also held in the inclined position by a rod that extends from the boat propulsion engine or from the stern. Therefore, the configuration of the apparatus for creating lift (including the deflector plate) is complicated, and an operation for switching this apparatus is required. Moreover, the rigidity of the deflector plate itself with respect to lift cannot be considered to be sufficient, regardless of the complicated configuration.

In view of this, there has been a need for a lift generator that would create lift so as to raise the stern quickly and smoothly. There has also been a need for improving the rigidity of the lift generator so as to withstand considerable lift.

DISCLOSURE OF THE INVENTION

According to a first aspect of the present invention, there is provided a boat propulsion engine adapted to be mounted to a hull, which engine comprises a main body that extends substantially vertically in relation to the hull, a lift generator disposed in a rear portion of the main body, and supporting bodies that support the lift generator on the main body, wherein the main body is configured so as to accommodate a drive shaft that extends substantially vertically in order to transmit a drive force of a drive source to a propeller, the lift generator has a surface that extends transversely relative to the main body, at least behind the main body, and the supporting bodies are configured so as to extend backward from the main body to the lift generator in a single vertical direction relative to the surface of the lift generator.

In the engine thus arranged, the lift generator has a surface that extends transversely relative to the main body, behind at least the main body. Therefore, lift can be efficiently and efficiently created by the lift generator when the hull begins to move from a stand-still. The boat propulsion engine and the stern are smoothly and quickly raised by this lift. When the hull begins to move, the hull is quickly and smoothly brought to a nearly horizontal orientation in which the stern is not submerged very far, via the orientation for overcoming the bow waves. Thus, it is possible to greatly reduce the amount of time needed for the hull to reach a nearly horizontal orientation via the orientation for overcoming the bow waves after the hull begins to move. Therefore, the hull can be smoothly and quickly accelerated.

Also, the supporting bodies are extended backward from the main body to the lift generator in a single vertical direction relative to the surface of the lift generator, and are connected to the lift generator. Therefore, rigidity is further increased because the lift generator is supported by the main body via the supporting bodies. The necessary rigidity can be ensured even if the lift generator is disposed at a position distanced from the boat propulsion engine to the rear, proportionate to the increase in rigidity. The effects of raising the stern can be further increased by shifting the position of the lift generator to the rear. Furthermore, the rigidity of the surface of the lift generator can be increased because the supporting bodies are formed so as to extend in a longitudinal direction.

Preferably, the supporting bodies have cross sections that extend in a propulsion direction of the boat propulsion engine. Therefore, the rigidity of the surface of the lift generator against the force acting on the surface of the lift generator in the propulsion direction can be sufficiently increased by the supporting members.

Furthermore, the supporting bodies are preferably provided to a rear half of the main body. Therefore, the positions where the supporting bodies are connected to the main body are shifted. The lengths of the supporting bodies connecting the main body to the lift generator can be reduced accordingly. As a result, the supporting bodies can be reduced in size.

Furthermore it is preferable that the supporting bodies be provided within a range of the maximum width of the main body, when the boat propulsion engine is viewed from behind. Therefore, when the hull moves forward, the resistance that results from the waves created by the supporting bodies, i.e., the wave-making resistance of the supporting bodies, can be reduced. Therefore, smooth lift can be created by the lift generator, and the hull can be propelled at high speeds.

Furthermore, it is preferable that the surface of the lift generator have an inclined surface extending downward and rearward, and that the supporting bodies be provided so as to support at least portions in a vicinity of the inclined surface. Therefore, lift can be achieved efficiently and effectively by the inclined surface that extends downward and rearward. It is possible to even further reduce the amount of time needed for the hull to reach a nearly horizontal orientation, via the orientation for overcoming the bow waves, after the hull begins to move. Therefore, the hull can be accelerated smoothly and quickly. The lift generator is supported by the supporting bodies at portions in a vicinity of the inclined surface that bears most of the propulsive force and lift. Therefore, the rigidity of the lift generator can be effectively increased.

Furthermore, it is preferable that the supporting bodies extend near to a rear end of the lift generator, so as to increase a range in which the lift generator is supported. Therefore, the rigidity of the surface of the lift generator, can be effectively increased by the supporting bodies.

Furthermore, it is preferable that the supporting bodies be formed integrally with the main body. Therefore, the supporting bodies can be manufactured easily and inexpensively.

Furthermore, it is preferable that the supporting bodies be formed separately from the main body. Therefore, it is possible to decide whether the supporting bodies and the lift generator will be located on the main body. It is also possible to appropriately select the optimum shapes for the supporting bodies and the lift generator. The supporting bodies and the lift generator can also be attached to the main body from behind as necessary. Therefore, the merits of manufacturing the boat propulsion engine can be achieved, and the user can arbitrarily select the supporting bodies and the lift generator.

According to a second aspect of the present invention, a boat propulsion engine adapted to be mounted to a hull is provided, which engine comprises: a main body that extends substantially vertically in relation to the hull; an outer peripheral wall composed of a separate member that is disposed around a periphery of the main body and is attached to the main body; a lift generator disposed in a rear portion of the outer peripheral wall; and supporting bodies that support the lift generator on the outer peripheral wall; wherein the main body is configured so as to accommodate a drive shaft that extends substantially vertically in order to transmit a drive force of a drive source to a propeller; the lift generator has a surface that extends transversely relative to the outer peripheral wall, at least behind the outer peripheral wall; and the supporting bodies are configured so as to extend backward from an outside surface of the outer peripheral wall to the lift generator in a single vertical direction relative to the surface of the lift generator.

In the engine thus arranged, it is possible to decide whether the supporting bodies and the lift generator will be located on the main body, because the supporting bodies and the lift generator are provided on an outer peripheral wall composed of a separate member attached to the main body. Also, it is possible to appropriately select the optimum shapes for the supporting bodies and the lift generator. The supporting bodies and the lift generator can be attached to the main body from behind as necessary. Therefore, the merits of manufacturing a boat propulsion engine can be achieved, and the user can arbitrarily select the supporting bodies and the lift generator.

With this arrangement, lift can be achieved efficiently and effectively by the lift generator when the hull begins to move from a standstill. Therefore, lift can be achieved efficiently and effectively by the lift generator when the hull begins to move from a standstill. The boat propulsion engine and the stern are raised smoothly and quickly by the lift. When starting to move, the hull reaches a nearly horizontal orientation smoothly and quickly, via the orientation for overcoming the bow waves. Thus, it is possible to greatly reduce the amount of time needed for the hull to reach a nearly horizontal orientation via the orientation for overcoming the bow waves after the hull begins to move. Therefore, the hull can be smoothly and quickly accelerated.

It is preferable that the outer peripheral wall be a cover that covers at least part of the main body, and that the cover have a continuous left half and right half. Therefore, the cover has a small number of components, and a favorable outward appearance can easily be achieved.

Furthermore, it is preferable that the outer peripheral wall be a cover that covers at least part of the main body, and that the cover have a configuration that can be divided in two to the left and right. Therefore, the cover, the lift generator, and the supporting bodies are easily assembled on the main body.

According to a third aspect of the present invention, a boat propulsion engine is provided, which comprises a main body, an anti-cavitation plate provided to the main body above a propeller, and a lift generator provided to the main body at a distance above the anti-cavitation plate, wherein the lift generator is configured so as to extend from the main body farther backward than a rear end of the anti-cavitation plate, and has a bottom surface inclined downward and rearward.

In the engine thus arranged, lift can be achieved efficiently and effectively by the surface inclined backward and downward when the hull begins to move from a standstill. Also, the rear of the lift generator is configured so as to extend farther backward than the rear end of the anti-cavitation plate. Therefore, the lift created by the lift generator is not affected by the cavitation from the driving of the propeller. Accordingly, lift can be efficiently and effectively achieved by the lift generator when the hull begins to move from a standstill. The boat propulsion engine and the stern are raised smoothly and quickly by the lift. When starting to move, the hull reaches a nearly horizontal orientation smoothly and quickly, via the orientation for overcoming the bow waves. Thus, it is possible to greatly reduce the amount of time needed for the hull to reach a nearly horizontal orientation via the orientation for overcoming the bow waves after the hull begins to move. Therefore, the hull can be smoothly and quickly accelerated.

After the hull is accelerated, since the lift generator is located above the draft of the boat, the apparatus does not cause resistance against the water during movement, and superior high-speed maneuverability can be ensured. Moreover, the lift generator is disposed above the anti-cavitation plate. Water flowing over the anti-cavitation plate is guided smoothly to the rear, because of the space between the lift generator and the anti-cavitation plate. Therefore, water is not retained between the lift generator and the anti-cavitation plate. Furthermore, the lift generator may nave a simple configuration in which the apparatus is disposed above the anti-cavitation plate and has a bottom surface that is inclined downward and rearward.

It is preferable that the lift generator be composed of a plate-shaped member. Therefore, the structure of the lift generator can be simplified, and the lift generator can be easily manufactured.

Furthermore, it is preferable that the lift generator have a width that does not exceed the width of the boat propulsion engine when the boat propulsion engine is viewed from behind. Therefore, in cases in which multiple boat propulsion engines are lined up and mounted on the stern, the multiple lift generators can be prevented from interfering with each other when the boat propulsion engines are steered or tilted up.

According to a fourth aspect of the present invention, a boat propulsion engine is provided, which engine comprises a main body, an anti-cavitation plate provided to the main body above a propeller, and a lift generator provided to the main body at a distance above the anti-cavitation plate, wherein the lift generator has a bottom surface that faces the anti-cavitation plate, and the bottom surface is inclined downward and rearward, at a position behind a rear end of the anti-cavitation plate.

In the engine thus arranged, the surface of the lift generator inclined downward and rearward is disposed behind the rear end of the anti-cavitation plate. Therefore, the lift created by the lift generator is not affected by the cavitation from the driving of the propeller. Accordingly, lift can be efficiently and effectively achieved by the surface inclined downward and rearward when the hull begins to move from a standstill. The boat propulsion engine and the stern are raised smoothly and quickly by the lift. When starting to move, the hull reaches a nearly horizontal orientation smoothly and quickly, via the orientation for overcoming the bow waves. Thus, it is possible to greatly reduce the amount of time needed for the hull to reach a nearly horizontal orientation via the orientation for overcoming the bow waves after the hull begins to move. Therefore, the hull can be smoothly and quickly accelerated.

After the hull is accelerated, since the lift generator is located above the draft of the boat, the apparatus does not cause resistance against the water during movement, and superior high-speed movement can be ensured. Moreover, the lift generator is disposed above the anti-cavitation plate. Water flowing over the anti-cavitation plate is guided smoothly to the rear, because of the space between the lift generator and the anti-cavitation plate. Therefore, water is not retained between the lift generator and the anti-cavitation plate. Furthermore, the lift generator may have a simple configuration in which the apparatus is disposed above the anti-cavitation plate and has a bottom surface that is inclined downward and rearward.

It is preferable that the lift generator be composed of a plate-shaped member. Therefore, the structure of the lift generator can be simplified, and the lift generator can be easily manufactured.

Furthermore, it is preferable that the lift generator have a width that does not exceed the width of the boat propulsion engine when the boat propulsion engine is viewed from behind. Therefore, in cases in which multiple boat propulsion engines are aligned and mounted on the stern, the multiple lift generators can be prevented from interfering with each other when the boat propulsion engines are steered or tilted up.

According to a fifth aspect of the present invention, a boat propulsion engine is provided, which engine comprises a main body, an anti-cavitation plate provided to the main body above a propeller, and a lift generator provided to the main body at a distance above the anti-cavitation plate, wherein the lift generator has a rear half portion that extends rearward from the main body, and that is located behind a rear end of the anti-cavitation plate as well as behind the propeller.

In the engine thus arranged, the rear half portion of the lift generator is located behind the rear end of the anti-cavitation plate as well as behind the propeller. When the boat propulsion engine is at a standstill, the hull is inclined downward and rearward in a manner such that the stern is lowered. Therefore, the boat propulsion engine is submerged in a lowered state. When the boat propulsion engine is operated from this state to cause the hull to begin to move from a standstill, the lift generator constitutes an inclined surface that is inclined downward and rearward. This downward and rear-inclined surface makes it possible to achieve lift efficiently and effectively.

The lift created by the lift generator is not affected by the cavitation from the driving of the propeller, because the rear half portion of the lift generator is located behind the rear end of the anti-cavitation plate as well as behind the propeller. Therefore, lift can be efficiently and effectively achieved by the lift generator when the hull begins to move from a standstill. The boat propulsion engine and the stern are raised smoothly and quickly by the lift. When starting to move, the hull reaches a nearly horizontal orientation smoothly and quickly, via the orientation for overcoming the bow waves. Thus, it is possible to greatly reduce the amount of time needed for the hull to reach a nearly horizontal orientation via the orientation for overcoming the bow waves after the hull begins to move. Therefore, the hull can be smoothly and quickly accelerated.

After the hull is accelerated, since the lift generator is located above the draft of the boat, the apparatus does not cause resistance against the water during movement, and superior high-speed maneuverability can be ensured. Moreover, the lift generator is disposed above the anti-cavitation plate. Water flowing over the anti-cavitation plate is guided smoothly to the rear, because of the space between the lift generator and the anti-cavitation plate. Therefore, water is not retained between the lift generator and the anti-cavitation plate. Furthermore, the lift generator may have a simple configuration in which the apparatus is disposed above the anti-cavitation plate and has a bottom surface that is inclined downward and rearward.

It is preferable that the lift generator be composed of a wing-shaped body that has a substantial wing shape in cross section when the boat propulsion engine is viewed from the side. Therefore, the boat propulsion engine can be raised efficiently, and even more smoothly and quickly by the wing-shaped lift generator. Accordingly, the hull reaches a nearly horizontal orientation more smoothly and quickly, from the orientation for overcoming the bow waves. Thus, it is possible to greatly reduce the amount of time needed for the hull to reach a nearly horizontal orientation via the orientation for overcoming the bow waves after the hull begins to move. As a result, the hull can be smoothly and quickly accelerated.

Furthermore, it is preferable that the lift generator have a width that does not exceed the width of the boat propulsion engine when the boat propulsion engine is viewed from behind. Therefore, in cases in which multiple boat propulsion engines are aligned and mounted on the stern, the multiple lift generators can be prevented from interfering with each other when the boat propulsion engines are steered or tilted up.

According to a sixth aspect of the present invention, a boat propulsion engine adapted to be mounted to a hull is provided, which engine comprises a main body, and a lift generator provided to the main body, wherein the lift generator has a first portion that constitutes a substantially horizontal first bottom surface, and a second portion that constitutes a second bottom surface extended continuously rearward from the rear end of the first bottom surface and that is inclined downward and rearward, wherein reinforcing bodies extending in the longitudinal direction are provided across the entire first portion and second portion.

In the engine thus arranged, lift can be achieved efficiently and effectively by the second bottom surface that is inclined downward and rearward, when the hull begins to move from a standstill. The boat propulsion engine and the stern are raised smoothly and quickly by the lift. When starting to move, the hull reaches a nearly horizontal orientation smoothly and quickly so that the stern is not submerged very far, via the orientation for overcoming the bow waves. Thus, it is possible to greatly reduce the amount of time needed for the hull to reach a nearly horizontal orientation via the orientation for overcoming the bow waves after the hull begins to move. Therefore, the hull can be smoothly and quickly accelerated.

In this arrangement, the first portion that constitutes the horizontal first bottom surface and the second portion that constitutes the inclined second bottom surface are provided continuously, and are reinforced by reinforcing bodies extending in the longitudinal direction across the entire first portion and second portion. The first portion and second portion therefore supplement each other, increasing rigidity. The rigidity of the rear end of the first portion and the second portion inclined downward and rearward from this rear end in particular can be sufficiently increased. Therefore, the angle of inclination of the second bottom surface in relation to the first bottom surface can be maintained. Accordingly, lift can be achieved efficiently and effectively by a highly rigid lift generator.

It is preferable that the reinforcing bodies be provided within a range of the width of the boat propulsion engine when the boat propulsion engine is viewed from behind. Therefore, when the hull moves forward, the wave-making resistance of the front surfaces (longitudinal front ends) of the reinforcing bodies can be reduced, and splashing from the movement of the first and second bottom surfaces can be reduced. Accordingly, smooth lift can be created by the lift generator, and high speed propulsion can be smoothly achieved.

Furthermore, it is preferable that the reinforcing bodies be provided to a top surface of the lift generator. Therefore, the reinforcing bodies are disposed on the reverse sides of the first bottom surface and second bottom surface. Wave-making resistance is reduced accordingly, and smoother lift action can be achieved.

Furthermore, it is preferable that the reinforcing bodies be provided to the edges on the left and right sides of the lift generator. Therefore, since the first portion and the second portion are continuously reinforced by the reinforcing bodies (longitudinal walls), rigidity can be ensured against the lift generator bending both vertically and horizontally.

Furthermore, it is preferable that the reinforcing bodies be provided to a top surface of the lift generator. Therefore, the reinforcing bodies are disposed on the reverse sides of the first bottom surface and second bottom surface. Wave-making resistance is reduced accordingly, and smoother lift action can be achieved.

Furthermore, it is preferable that the reinforcing bodies be provided to a bottom surface of the lift generator. Therefore, the reinforcing bodies can be configured as longitudinal walls that extend downward from the edges on the left and right sides of the lift generator. The entire lift generator, composed of the first portion, the second portion, and the reinforcing bodies, can be made relatively small in size. Also, rigidity can be ensured against the lift generator bending both vertically and horizontally.

According to a seventh aspect of the present invention, a boat propulsion engine adapted to be mounted to a hull is provided, which engine comprises a main body, and a lift generator attached to the main body, wherein the lift generator has a portion constituting a downward-oriented surface, and the portion constituting the downward-oriented surface is disposed within a range of the width of the boat propulsion engine, and has reinforcing bodies that extend in a longitudinal direction.

In the engine thus arranged, lift can be efficiently and effectively achieved by the downward-oriented surface when the hull begins to move from a standstill. The boat propulsion engine and the stern are raised smoothly and quickly by the lift. When starting to move, the hull reaches a nearly horizontal orientation smoothly and quickly so that the stern is not submerged very far, via the orientation for overcoming the bow waves. Thus, it is possible to greatly reduce the amount of time needed for the hull to reach a nearly horizontal orientation via the orientation for overcoming the bow waves after the hull begins to move. Therefore, the hull can be smoothly and quickly accelerated.

In this arrangement, the wave-making resistance of the front surfaces of the reinforcing bodies can be reduced and splashing can be minimized by keeping the portion constituting the downward-facing surface of the lift generator within a range of the width of the boat propulsion engine. Therefore, lift can be achieved efficiently and effectively when the hull begins to move from a standstill. Also, rigidity is increased because the portion constituting the downward-facing surface has reinforcing bodies extending in the longitudinal direction. Therefore, lift can be achieved efficiently and effectively by a highly rigid lift generator.

BRIEF DESCRIPTION OF THE DRAWINGS

Certain preferred embodiments of the present invention will be described in detail below, by way of example only, with reference to the accompanying drawings, in which.

BEST MODE FOR CARRYING OUT THE INVENTION

First, the boat propulsion engine according to a first embodiment will be described with reference to FIGS. 1 through 4.

Figure 1:
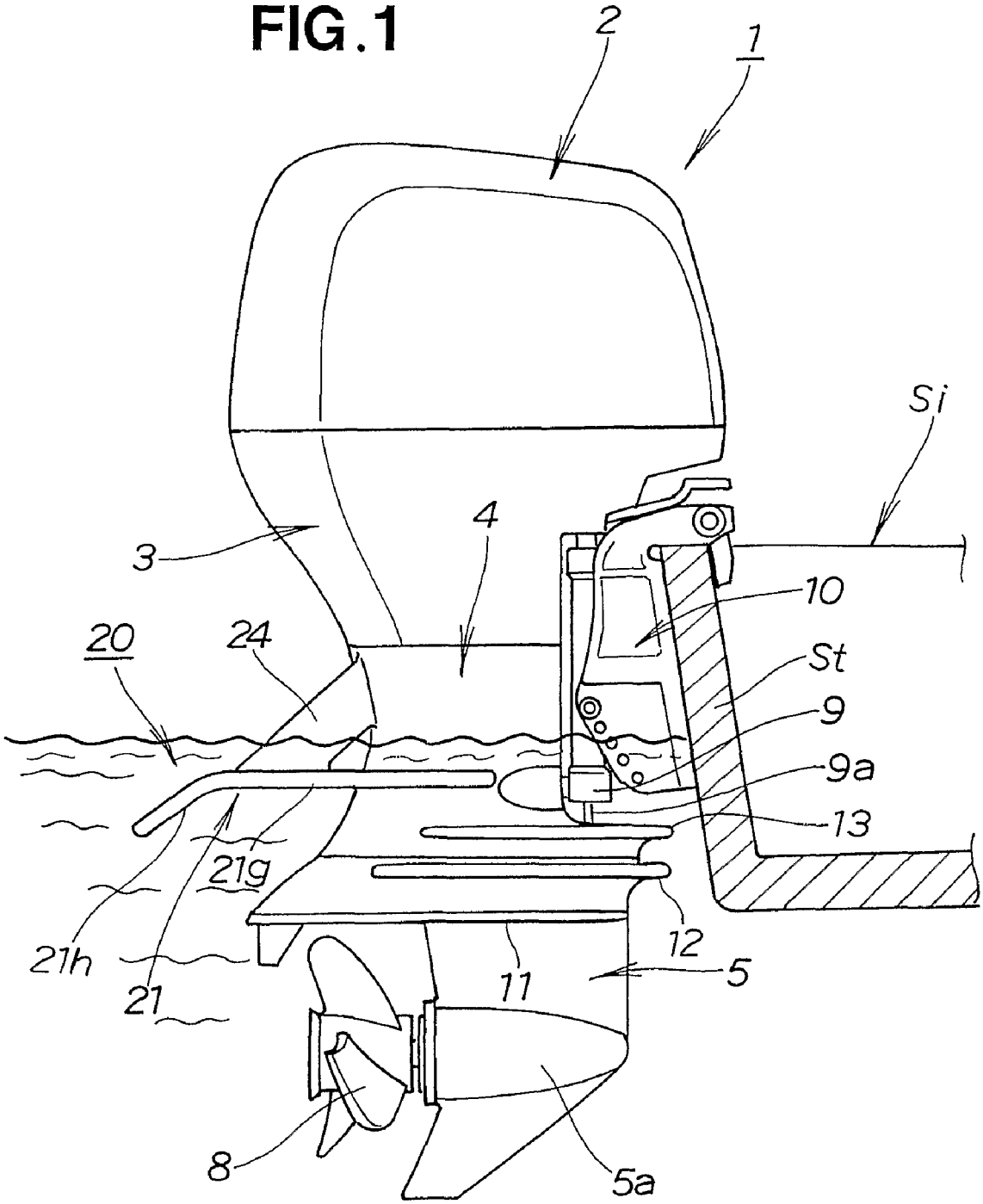
FIG. 1 is a view of a hull that is equipped with a boat propulsion engine according to a first embodiment of the present invention.

The center of gravity of a hull Si is located nearer to the center of the hull and away from a boat propulsion engine 1 mounted on a stern St, as shown in FIG. 1.

Figure 2:
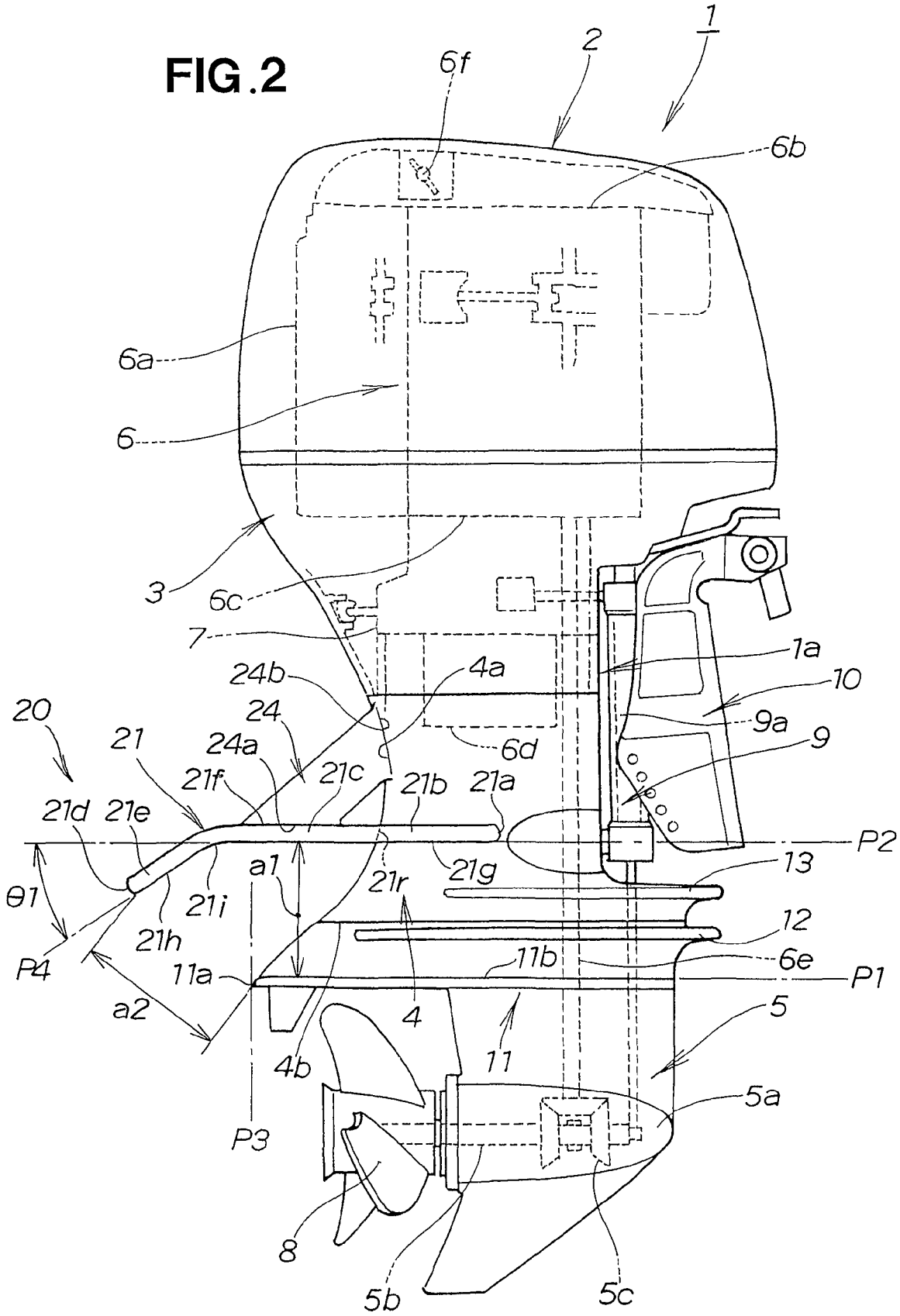
FIG. 2 is a side view of the boat propulsion engine shown in FIG. 1.

The boat propulsion engine 1 comprises an engine part 6 (drive source 6), a propeller 8 (propulsion device), a swivel case 9, and a stern bracket 10, as shown in FIGS. 1 and 2. The engine can be considered to be an outboard engine, because the engine is mounted on the outside of the hull Si. The boat propulsion engine 1 is described in detail below.

The boat propulsion engine 1 has an interior space enclosed by a topmost engine cover 2, an undercover 3 located below this cover 2, an extension case 4 located below this cover 3, and a gear case 5 located below this case 4. The engine cover 2, the undercover 3, the extension case 4, and the gear case 5 constitute a main body of the boat propulsion engine 1. This main body extends substantially vertically in relation to the hull Si.

The extension case 4 has an aligning surface 4*b* corresponding to the upper end surface of the gear case 5, as shown in FIG. 2. The gear case 5 has a gearbox 5*a* formed integrally in the middle. The extension case 4 and the gear case 5 are composed of an aluminum alloy or another such lightweight metal material.

The engine cover 2 accommodates the engine part 6 in the interior. The engine part 6 is a multi-cylinder engine that has multiple cylinders. The engine part 6 is a so-called vertical engine in which a crankshaft and a camshaft are disposed in a vertical orientation. The cylinders are disposed in a vertical orientation in a manner in which the axial line is oriented vertically.

An engine head 6*a* (including the cylinder head and the head cover) of the engine part 6 is disposed in a rear portion of the boat propulsion engine 1. An engine main body 6*b* (including the cylinder block and the crankcase) of the engine part 6 is disposed in the middle of the boat propulsion engine 1. The bottom of the engine part 6, i.e., the bottom part 6*c* of the engine main body 6*b*, protrudes into the undercover 3. An engine mounting case 7 of the engine part 6 is disposed below the bottom part 6*c* of the engine main body 6*b*, and is provided with an oil pan 6*d*. Furthermore, the engine part 6 includes a throttle valve 6*f*.

The boat propulsion engine 1 has a drive shaft 6*e* linked with the crankshaft of the engine part 6, an output shaft 5*b* linked with the drive shaft 6*e* via a gear mechanism 5*c*, and a propeller 8 linked to the output shaft 5*b*. More specifically, the drive shaft 6*e* extends downward from the end of the crankshaft, and is linked to the gear mechanism 5*c* at the bottom end. In other words, the drive shaft 6*e* extends substantially vertically and passes through the interiors of the bottom part 6*c* of the engine main body 6*b*, the engine mounting case 7, and the extension case 4, extending into the gear case 5. The gear mechanism 5*c* is accommodated within the gearbox 5*a*. The output shaft 5*b* extends backward from the gear mechanism 5*c*, and the propeller 8 is located at the rear end. The propeller 8 is a propulsion device that creates propulsion force. The motive energy created by the engine part 6 is transmitted to the propeller 8 by the drive shaft 6*e*, the gear mechanism 5*c*, and the output shaft 5*b*.

The boat propulsion engine 1 is attached to the stern St by the swivel case 9 and the stern bracket 10, as shown in FIGS. 1 and 2. The swivel case 9 and the stern bracket 10 are provided within a concavity 1*a* of the boat propulsion engine 1. The concavity 1*a* is a longitudinal depression formed in the front of the boat propulsion engine 1 (the portion near the stern St), and extends from the front lower half of the undercover 3 to the front of the extension case 4.

More specifically, a swivel shaft 9*a* of the swivel case 9 supports the boat propulsion engine 1 in a manner that allows the engine to swing to the left and right. Therefore, the boat propulsion engine 1 can be steered. The stern bracket 10 also supports the boat propulsion engine 1 in a manner that allows the engine to swing up and down, via the swivel case 9.

The lower half of this boat propulsion engine 1, which includes the propeller 8, is submerged under water in normal circumstances.

The lower part of the boat propulsion engine 1 comprises one anti-cavitation plate 11, two top and bottom anti-splash plates 12, 13, and a lift generator 20.

The anti-cavitation plate 11 is a plate-shaped member installed above the propeller 8 to prevent air from being drawn into the propeller 8, and can also be referred to as an anti-ventilation plate. In other words, the anti-cavitation plate 11 is located at the bottom of the boat propulsion engine 1 at a position above the propeller 8 separated by a fixed distance, and the anti-cavitation plate covers the top of the propeller 8. More specifically, the anti-cavitation plate 11 is formed into a horizontal fin shape that protrudes outward from the left and right side surfaces and the rear surface of the gear case 5.

The height where the anti-cavitation plate 11 is attached to the boat propulsion engine 1 is set as follows. Specifically, when the boat propulsion engine 1 is mounted on the hull Si, the height of the anti-cavitation plate 11 is set so as to be substantially at the same height as the bottom of the hull Si, as shown in FIG. 1.

The two anti-splash plates 12, 13 are plate-shaped members that prevent water from splashing up from the draft surface. The lower anti-splash plate 12 is located above the anti-cavitation plate 11 and is separated by a fixed distance. The upper anti-splash plate 13 is located above the lower anti-splash plate 12 and is separated by a fixed distance.

More specifically, the lower anti-splash plate 12 is formed into a horizontal fin-shape that protrudes outward from the front surface and the left and right side surfaces at the top of the gear case 5. The upper anti-splash plate 13 is formed into a horizontal fin-shape that protrudes outward from the front surface and the left and right side surfaces at the bottom of the extension case 4.

Thus, the anti-cavitation plate 11 and the lower anti-splash plate 12 are integrally formed on the gear case 5. The upper anti-splash plate 13 is integrally formed on the extension case 4.

The lift generator 20 is configured from a plate-shaped member 21, i.e., a plate body 21, provided in the middle of the boat propulsion engine 1. The plate body 21 is located above the upper anti-splash plate 13, is separated by a fixed distance, and is composed of a horizontal plate integrally formed on the extension case 4. More specifically, the plate body 21 is a flat plate that extends from the longitudinal middle of the extension case 4 to a point behind the rear end 11*a* of the anti-cavitation plate 11.

Figure 3:
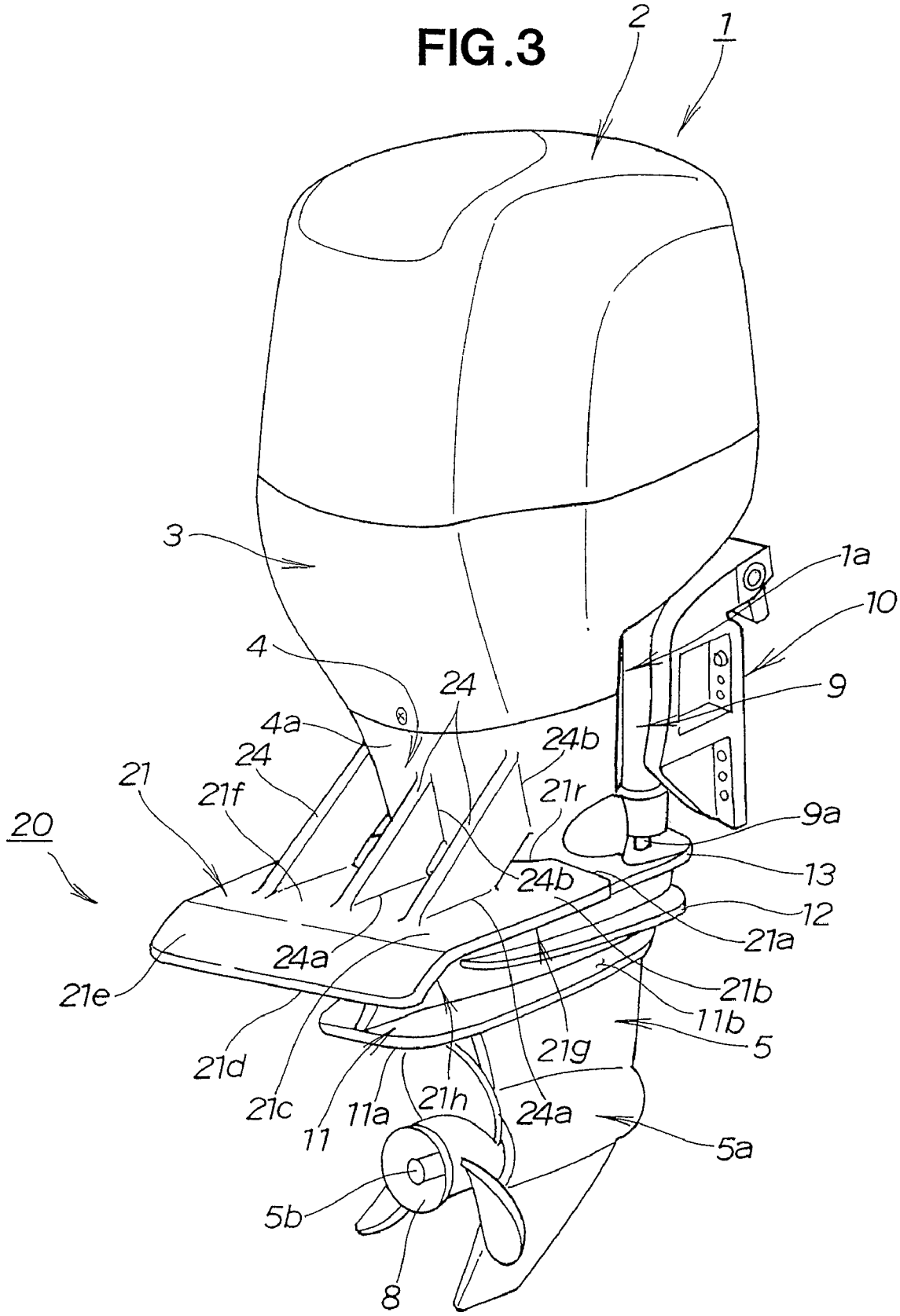
FIG. 3 is a perspective view of the boat propulsion engine shown in FIG. 2.

The front edge of the plate body 21 has an arcuate concavity 21*r* along the rear surface 4*a* of the extension case 4, as shown in FIGS. 2 and 3. As a result, the concavity 21*r* encloses the rear surface 4*a* and is integrally formed in the rear surface 4*a*.

The front end 21*a* of the plate body 21 is located in the longitudinal middle of the extension case 4. The rear end 21*d* of the plate body 21 is located behind and above the rear end 11*a* of the anti-cavitation plate 11, i.e., behind and above the propeller 8.

The plate body 21 is an integrally molded article composed of a horizontal front half 21*b* that extends backward from the front end 21*a*, a horizontal intermediate part 21*c* that extends further backward from the rear end of the front half 21*b*, and a rear inclined part 21*e* that extends backward from the rear end 21*i* (curved part 21*i*) of the intermediate part 21*c* to the rear end 21*d*.

The front half 21*b* is disposed on the left and right sides of the extension case 4. In other words, the front half 21*b* is formed into a flat forked shape (bifurcated shape) so as to enclose the rear surface 4*a* on the outer peripheral wall of the extension case 4 from the left, and right sides. The intermediate part 21*c* is disposed behind the extension case 4. The curved part 21*i* is the border between the intermediate part 21*c* and the rear inclined part 21*e*.

The entire shape of the plate body 21 can be regarded as being substantially rectangular in shape when viewed from above.

The four lines P1 through P4 shown in FIG. 2 are defined as follows. The first line P1 is a horizontal line that extends over the top surface 11*b* of the anti-cavitation plate 11. The second line P2 is a horizontal line that extends over the bottom surface 21*g* (downward-oriented surface 21*g*) of the plate body 21, i.e., along the bottom surface 21*g* of the front half 21*b* and the intermediate part 21*c*. The second line P2 is parallel to the first line P1. The third line P3 is a vertical line that extends over the rear end 11*a* of the anti-cavitation plate 11. Naturally, the third line P3 is at a right angle to the first and second lines P1, P2. The fourth line P4 is a straight line that is inclined along the bottom surface 21*h* of the rear inclined part 21*e* in the plate body 21.

The boundary between the bottom surface 21*g* (downward-oriented surface 21*g*) and the bottom surface 21*h* (inclined surface 21*h*) is denoted as the curved part 21*i*. The curved part 21*i* is positioned behind and above the rear end 11*a* of the anti-cavitation plate 11. In other words, the curved part 21*i* is located behind the third line P3 in FIG. 2. Therefore, the bottom surface 21*h* of the rear inclined part 21*e* is located behind and above the rear end 11*a* of the anti-cavitation plate 11, i.e., behind and above the propeller 8.

In FIG. 2, the angle θ1 of inclination of the rear inclined part 21*e*, i.e., the angle θ1 at which the inclined surface 21*h* is inclined in relation to a bottom surface 21*g* (the angle θ1 of the line P4 in relation to the line P2; the acute angle), is preferably set within a range of "$0° \leqq \theta 1 \leqq 45°$." Furthermore, it is particularly preferable that the angle θ1 of inclination be set to approximately 30°. The angle θ1 of inclination can also be referred to as the angle of attack.

The dividing distance (first dividing distance) from the top surface 11*b* of the anti-cavitation plate 11 to the bottom surface 21*g* of the plate body 21, i.e., from the first line P1 to the second line P2, is a1. The dividing distance (second dividing distance) from the rear end 11*a* of the anti-cavitation plate 11 to the rear end 21*d* of the plate body 21 is a2. The second dividing distance a2 is greater than 90% of the first dividing distance a1. Specifically, the relationship between the two is "$(0.9 \times a1) < a2$."

More specifically, the second dividing distance a2 is either substantially equal to ($a1 \approx a2$) or greater than ($a1 < a2$) the first dividing distance a1. However, in cases in which the second dividing distance a2 is less than the first dividing distance a1 ($a1 > a2$), it is preferable that the second dividing distance a2 be greater than 90% of the first dividing distance a1. The second dividing distance a2 may also be the shortest distance from the rear end 11*a* of the anti-cavitation plate 11 to a bottom surface 21*h* of the plate body 21.

Figure 4:
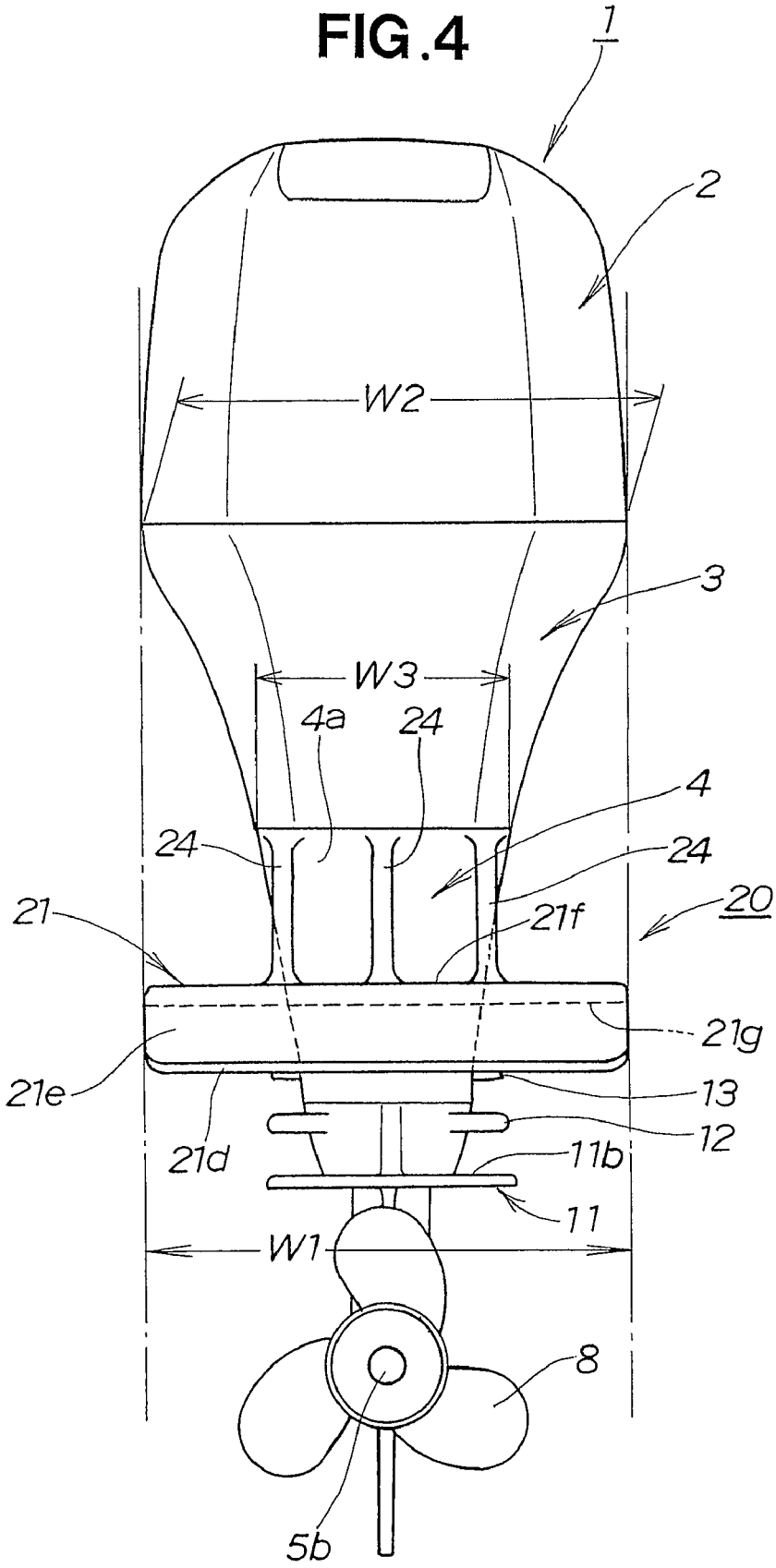
FIG. 4 is a rear view of the boat propulsion engine shown in FIG. 2.

When the boat propulsion engine 1 is viewed from behind as in FIG. 4, the width W1 of the plate body 21, i.e., the width W1 of the lift generator 20, is preferably set to be either approximately equal to the maximum width W2 of the boat propulsion engine 1 ($W1 \approx W2$), or slightly less than the maximum width W2 ($W1 < W2$). It is also preferable that the width W1 of the plate body 21 be set to be sufficiently greater than the outside diameter of the propeller 8. The reasons for this are as follows.

For example, in some cases, multiple boat propulsion engines 1 are aligned and mounted on the stern St, according to the size and other characteristics of the hull Si shown in FIG. 1. The force propelling the hull Si can be increased by providing multiple boat propulsion engines 1. All of the boat propulsion engines 1 are swung to the left and right when the hull Si is steered.

If the width W1 of the lift generator 20 is greater than the maximum width W2 of the boat propulsion engine 1, then there is a possibility that the multiple lift generators 20 will interfere with each other, or that a lift generator 20 will interfere with the adjacent boat propulsion engine 1 when the hull is steered. The width W1 of the plate body 21 is preferably limited to avoid such interference.

Also, when the boat propulsion engine 1 is viewed from behind as in FIG. 4, multiple supporting members 24 are placed within a range of the width W3 of the extension case 4. It is more preferable that the multiple supporting members 24 be disposed so as not to protrude to the sides past the outlines of the extension case 4. Therefore, when the hull Si moves forward, wave-making resistance from the supporting members 24 can be reduced, splashing can be reduced during the movement of the boat, and smooth lift action can be achieved.

The lift generator 20 described above is summarized as follows.

The lift generator 20 has surfaces (bottom surface 21*g* and bottom surface 21*h*) that are located behind at least the extension case 4 (main body 4) and that broaden transversely relative to the extension case 4, as shown in FIGS. 2 and 3. Furthermore, the lift generator 20 includes first portions 21*b*, 21*c* that constitutes the substantially parallel first bottom surface 21*g*, and a second portion 21*e* that constitutes the second bottom surface 21*h*, which extends continuously backward from the curved part 21*i* of the first bottom surface 21*g*, and that is inclined downward and rearward.

Next, the operation of the lift generator 20 will be described with reference to FIGS. 1 and 2.

When the hull Si is moved forward by the propulsive force of the boat propulsion engine 1, a pressure difference is created in the top and bottom surfaces of the rear inclined part 21*e* that is inclined downward and rearward. As a result, a lifting force, or so-called lift, is created in the plate body 21 (the lift generator 20).

When the boat has stopped, the hull Si maintains a somewhat raised orientation in the bow due to the balance between the buoyancy and the center of gravity of the hull Si. When the boat stops, the bow remains raised, and the longitudinal angle of inclination of the hull Si is about 5°, for example. In this state, the bottom surface 21*g* of the plate body 21 is at a slight angle, or a so-called recessed angle (about 5°, for example), in relation to a horizontal plane.

Then, at the start of propulsion, a force acts to cause the boat propulsion engine 1 side of the hull to sink. In a case in which the longitudinal angle of inclination at standstill is about 5°, the stern St sinks from this position due to acceleration, and the longitudinal angle of inclination is brought to a maximum of 15°, then the angle of the bottom surface 21*h* in relation to a horizontal plane is increased by 15° from the previous angle of 30°, bringing the angle to 45°. Since this angle is 45°, the vertical component force (lift) does not exceed the horizontal component force. Therefore, the acceleration capabilities can be increased in this case because the upper resistance does not exceed the rear resistance.

This lift causes a lifting force to act upward from below on the plate body 21. Since the rear inclined part 21*e* is inclined downward and rearward, this lifting force acts as a repeating load on the curved continuous part via the inclined part, as well as on all the surrounding parts.

To handle this repeating load, multiple supporting members 24 (supporting members 24) are provided extending forward and upward from the top surface 21*f* of the intermediate part 21*c* of the plate body 21 to the rear surface 4*a* of the extension case 4. The supporting members 24 fulfill the role of supporting bodies for supporting the repeating load that acts on the plate body 21, i.e., the role of a gusset plate for reinforcing the plate body 21.

More specifically, the supporting members 24 are composed of three standing plates that are comparatively thick. All of the standing plates are separated from each other to the left and right and are parallel in an erect state. The bottom ends 24*a* of the supporting members 24 are integrally provided to a top surface 21*f* near the border between the intermediate part 21*c* and the rear inclined part 21*e*.

The front ends 24*b* of the supporting members 24 are integrally provided on the top of the rear surface 4*a* in the outer peripheral wall of the extension case 4 (the main body 4 of the boat propulsion engine 1). In this manner, the supporting members 24 integrally connect the top surface 21*f* of the plate body 21 with the rear surface 4*a* of the extension case 4. Specifically, the front ends 24*b* of the supporting members 24 are provided to the longitudinal rear half of the peripheral wall of the extension case 4.

Since the front ends 24*b* of the supporting members 24 are provided to the rear surface 4*a* of the extension case 4, the distances between the ends of the supporting members 24 can be shortened, and the supporting members 24 can be reduced in size. Moreover, propulsion resistance and wave-making resistance from the supporting members 24 installed on the lift generator 20 can be reduced. Splashing when the hull Si moves can also be reduced and smooth lift action can be achieved. The term "wave-making resistance" refers to the resistance created by waves caused by the forward movement of the hull Si.

The plate body 21 and the supporting members 24 can be configured integrally with the extension case 4. For example, the plate body 21 and the supporting members 24 can be integrally molded with the extension case 4. The plate body 21 and the supporting members 24 can also be bonded to the extension case 4 by welding or another such method. The plate body 21 and the supporting members 24 can also be bonded to the extension case 4 in an integrated manner.

The supporting members 24 are configured from three thick plates which are separated to the left and right and whose cross section extends in the propulsion direction of the boat propulsion engine 1, as shown in FIGS. 2, 3, and 4. The plate body 21 is supported by the supporting members 24, from the horizontal intermediate part 21*c* to top surface of the rear inclined part 21*e* that is inclined downward and rearward. The supporting members 24 increase the rigidity of a lift creating surface 21*h* of the lift generator 20, against the lift that is borne by the lift creating surface 21*h* (bottom surface 21*h*).

The supporting members 24 are provided within the maximum width W2 of the extension case 4, when the extension case 4 is viewed from the longitudinal direction, as shown in FIG. 4. Specifically, the supporting members 24 are provided within a range of the maximum width (within the width of the submerged condition of the boat propulsion engine 1) when viewed in the longitudinal direction of the peripheral wall of the main body of the boat propulsion engine 1, particularly from the front. Therefore, wave-making resistance when the boat propulsion engine 1 propels the boat can be reduced, and the propulsion resistance of the boat propulsion engine 1 that has the lift generator 20 can also be reduced.

As described above, the hull Si begins to move when the boat propulsion engine 1 operates, at which time the lower half of the boat propulsion engine 1 that includes the lift generator 20 is submerged as shown in FIG. 1, and the stern St is lowered by the weight of the boat propulsion engine 1, and the balance between the center of gravity and buoyancy of the hull Si.

When the boat begins to move, the stern St including the boat propulsion engine 1 is raised by the lift action of the lift generator 20. The propulsive force of the boat propulsion engine 1 allows lift to be quickly and smoothly created. This lift raises the plate body 21 up by the action of the inclined surface 21*h* that is inclined downward and rearward, and that is located above the propeller 8 and extends backward.

The load on the lift generator 20 is supported by the supporting members 24.

As previously described, the first dividing distance a1 and the second dividing distance a2 have either the relationship "a1≈a2", the relationship "a1<a2", or the relationship "(0.9× a1)<a2." Water that flows backward along the top surface 11*b* of the anti-cavitation plate 11 is deflected along the incline of the bottom surface 21*h* of the rear inclined part 21*e*, and is expelled smoothly to the rear without being hindered by the vicinity of the rear end 21*d*.

Therefore, the boat propulsion engine 1 and the stern St can be raised very quickly and smoothly when the boat begins to move, and the orientation of the moving hull Si can be brought to be nearly horizontal within an extremely short amount of time. Therefore, the hull Si to which the boat propulsion engine 1 is attached can be brought to high speeds quickly and smoothly.

Next, a first modification of the boat propulsion engine 1 according to the first embodiment will be described with reference to FIG. 5.

Figure 5:
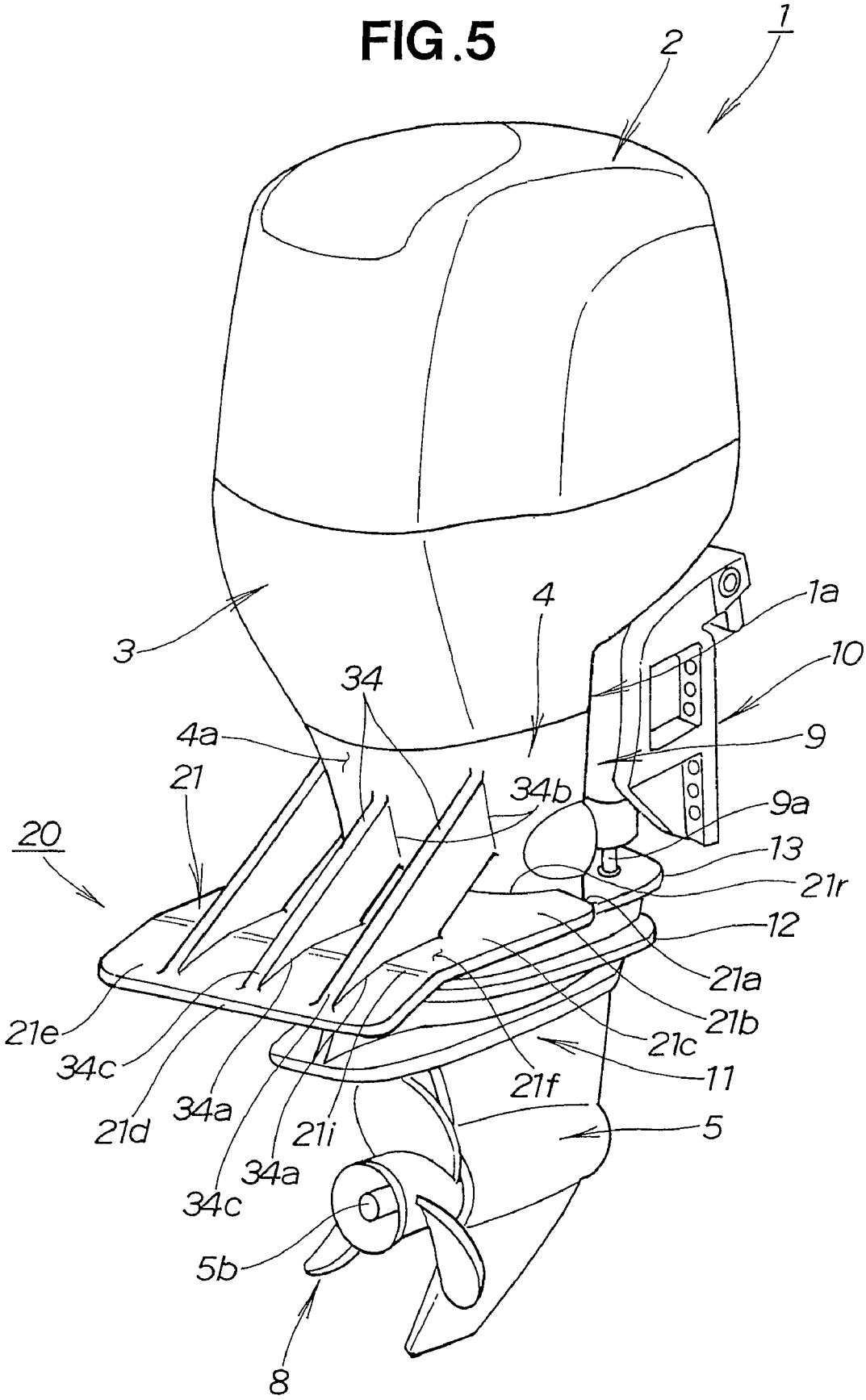
FIG. 5 is a perspective view of a first modification of the boat propulsion engine according to the first embodiment of the present invention.

The boat propulsion engine 1 of the first modification is characterized in that the supporting members 24 of the first embodiment have been changed to supporting members 34, as shown in FIG. 5. The rest of the configuration is identical to the configuration of the first embodiment shown in FIGS. 1 through 4, and the same numerical symbols are therefore used and descriptions are omitted.

The supporting members 34 (supporting bodies 34) are characterized in that rearmost ends 34*c* extend into the vicinity of the rear end 21*d* of the rear inclined part 21*e*, and the configuration is otherwise substantially identical to that of the first embodiment shown in FIGS. 1 through 4.

More specifically, the bottom ends 34*a* of the supporting members 34 are integrally provided on both the top surface 21*f* of the intermediate part 21*c* and the top surface of the rear inclined part 21*e*. The front ends 34*b* of the supporting members 34 are integrally provided at the top of the rear surface 4*a* in the outer peripheral wall of the extension case 4. Thus, the supporting members 34 integrally connect the intermediate part 21*c* and the rear inclined part 21*e* with the rear surface 4*a* of the extension case 4.

According to the first modification, the rigidity of the supporting members 34 is improved because the supporting members 34 support the rear inclined part 21*e* and the intermediate part 21*c* connected to the rear inclined part against the propulsive force borne by the lift generator 20, and particularly against the propulsive force borne by the rear inclined part 21*e*.

Next, a second modification of the boat propulsion engine 1 according to the first embodiment will be described with reference to FIG. 6.

Figure 6:
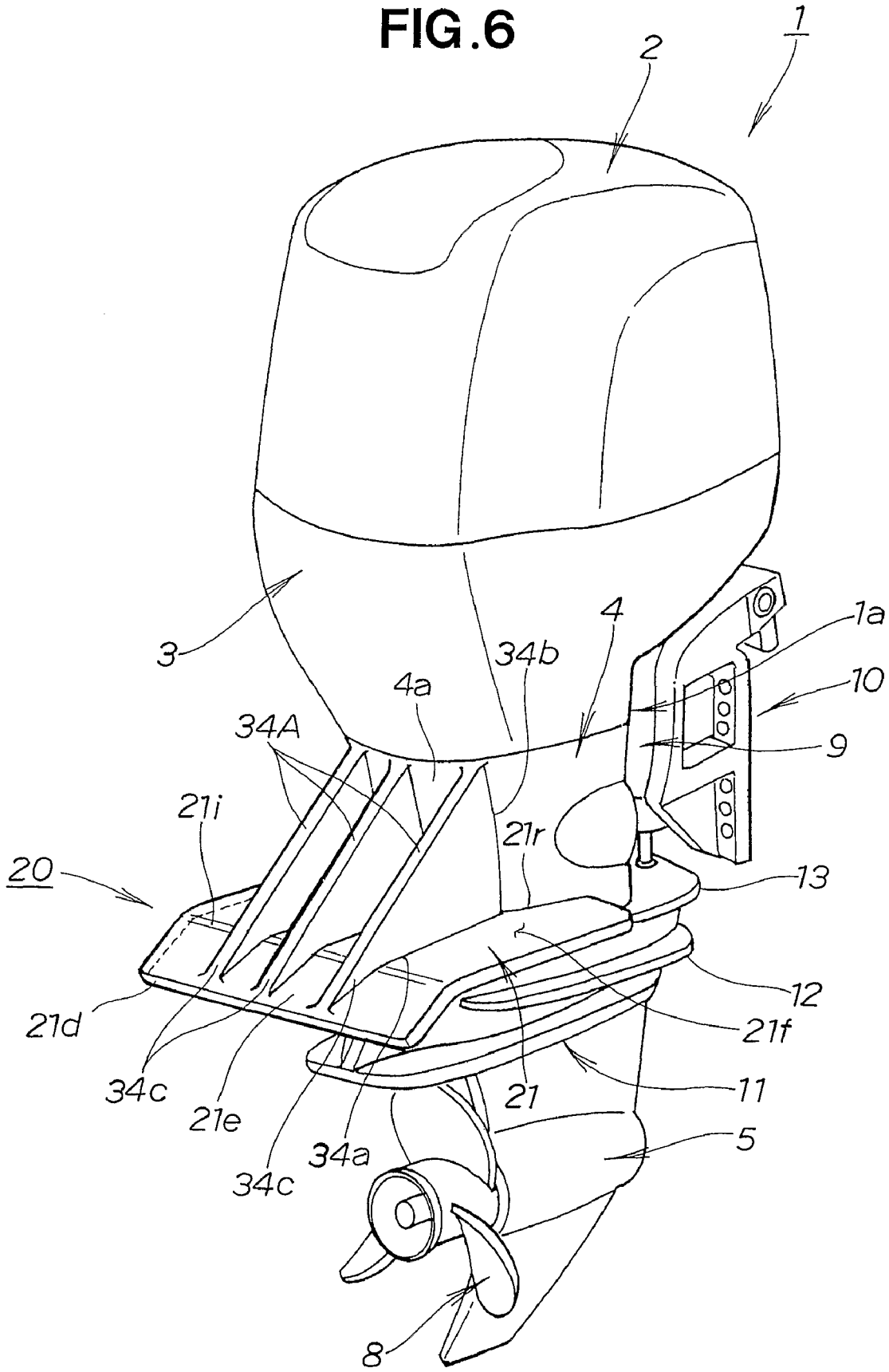
FIG. 6 is a perspective view of a second modification of the boat propulsion engine according to the first embodiment of the present invention.

The boat propulsion engine 1 of the second modification is characterized in that the supporting members 34 (see FIG. 5) of the first modification are changed to supporting members 34A, as shown in FIG. 6. The supporting members 34A (supporting bodies 34A) are formed into substantially triangular shapes when viewed from the side, as a result of the angles between the bottom ends 34*a* and the front ends 34*b*. The configuration is otherwise identical to the configuration, of the first modification shown in FIG. 5, and the same numerical symbols are therefore used and descriptions are omitted.

Next, a third modification of the boat propulsion engine 1 according to the first embodiment will be described with reference to FIG. 7.

The boat propulsion engine 1 of the third modification is characterized in lacking the supporting members 24 (see FIG.

Figure 7:
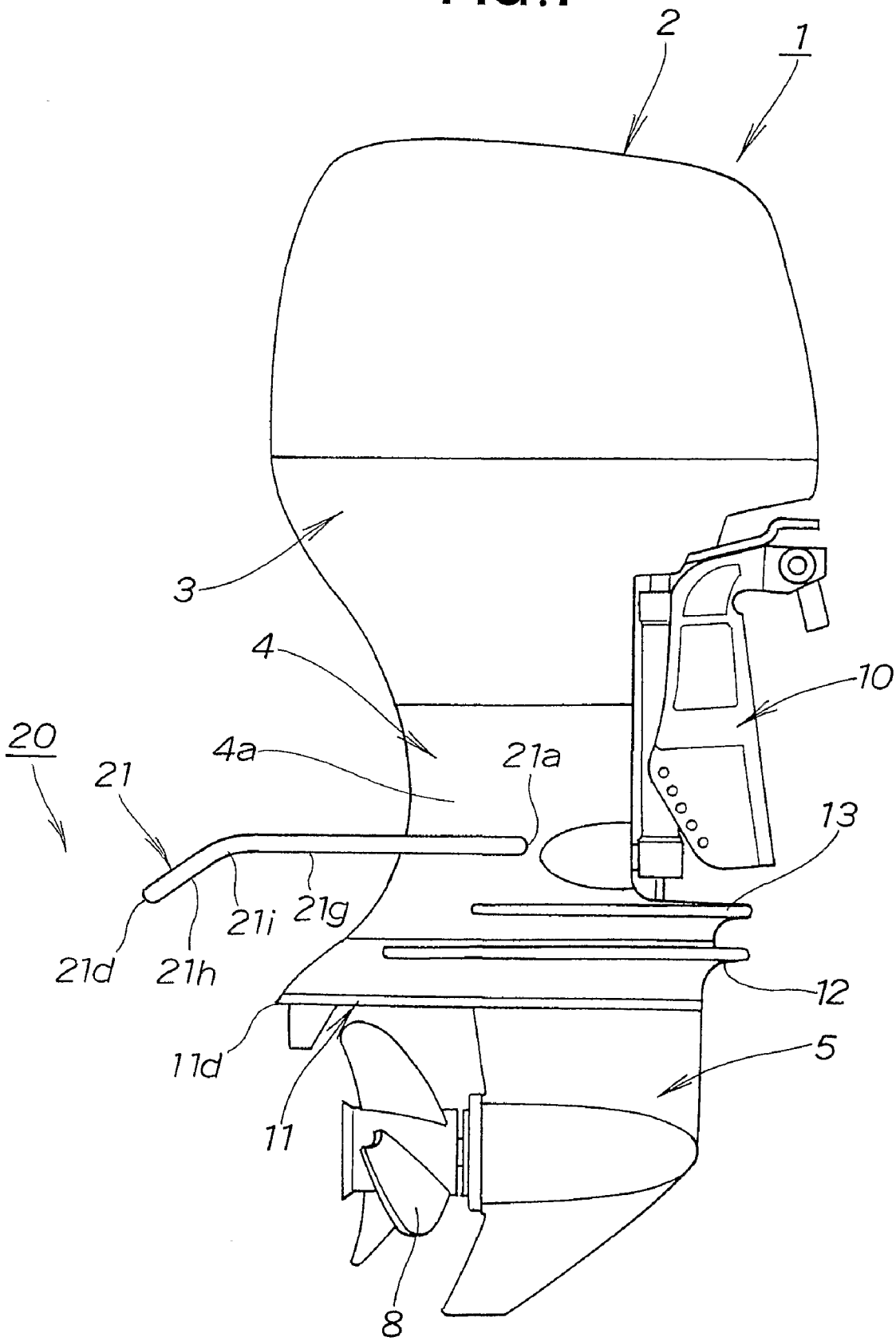
FIG. 7 is a side view of a third modification of the boat propulsion engine according to the first embodiment of the present invention.

3) of the first embodiment, as shown in FIG. 7. The configuration is otherwise identical to the configuration of the first embodiment shown in FIGS. 1 through 4, and the same numerical symbols are therefore used and descriptions are omitted.

The plate body 21 of the lift generator 20 has the same configuration as in the first embodiment, and is either integrally formed on the rear surface 4*a* of the extension case 4, or is bonded by welding or another such method.

The third modification is preferred for a boat propulsion engine 1 that has low horsepower for propelling a relatively small hull Si (see FIG. 1).

Next, the boat propulsion engine according to a second embodiment will be described with reference to FIGS. 8 through 10.

Figure 8:
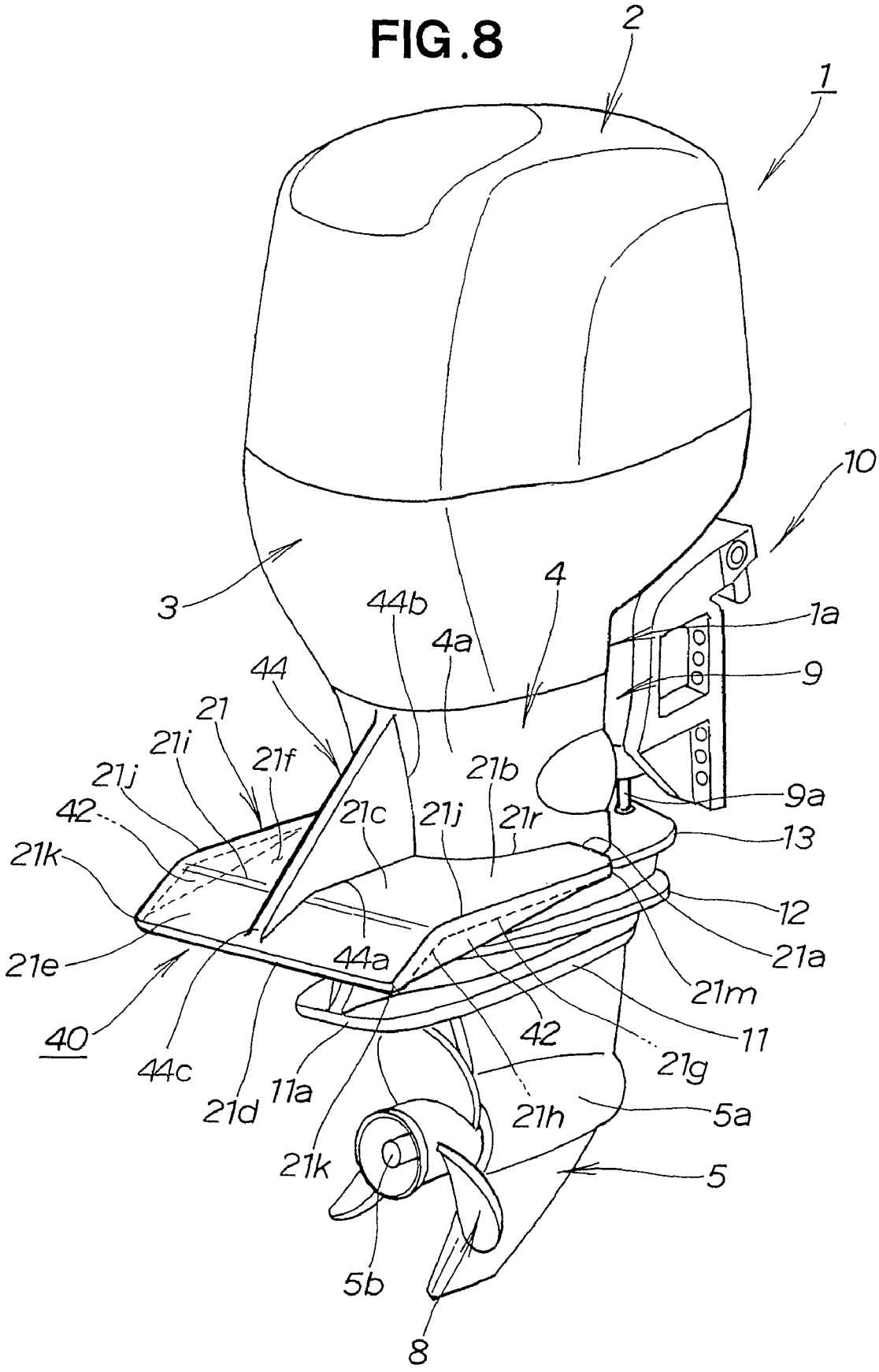
FIG. 8 is a perspective view of the boat propulsion engine according to a second embodiment of the present invention.
Figure 9:
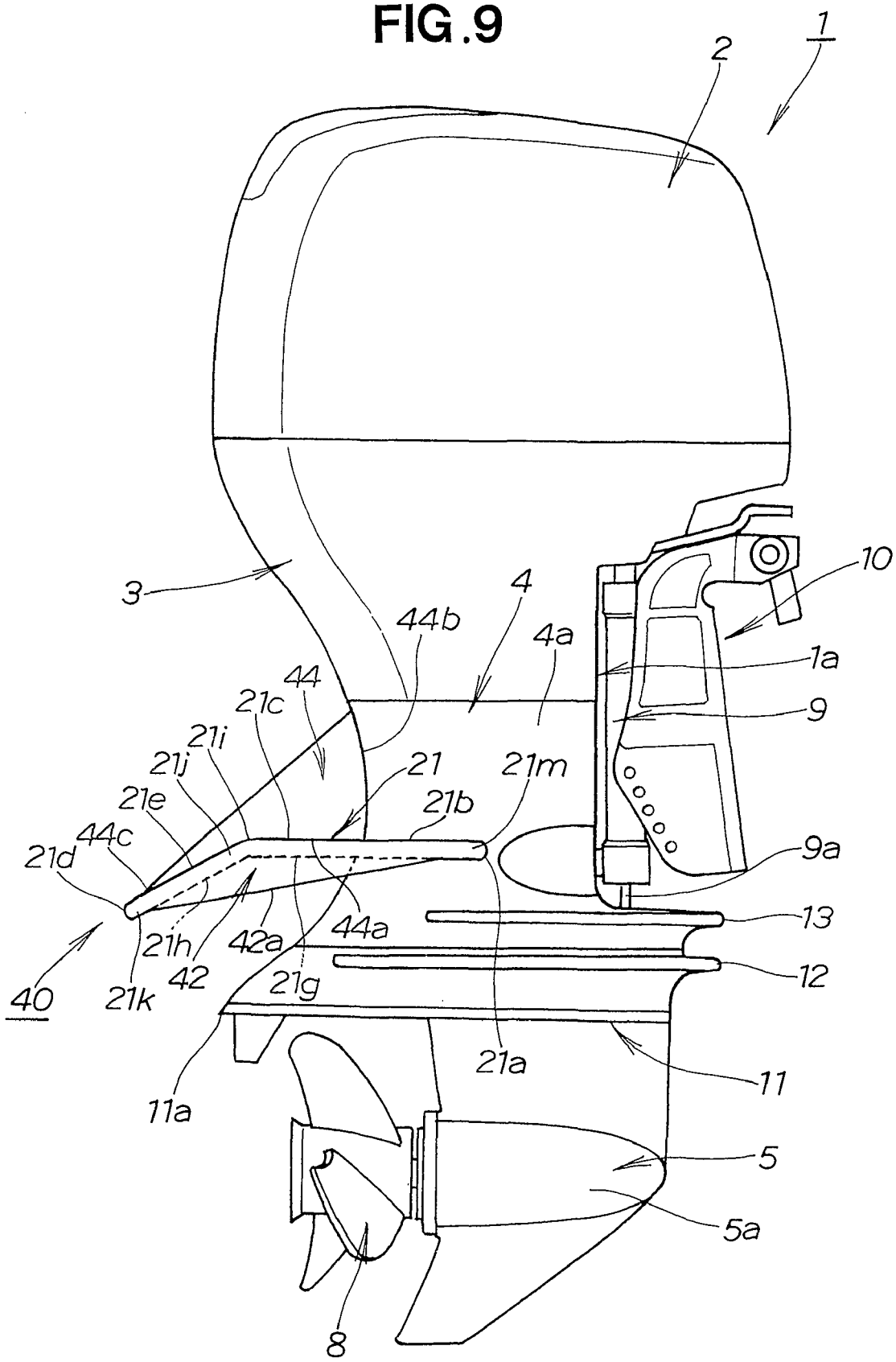
FIG. 9 is a side view of the boat propulsion engine shown in FIG. 8.
Figure 10:
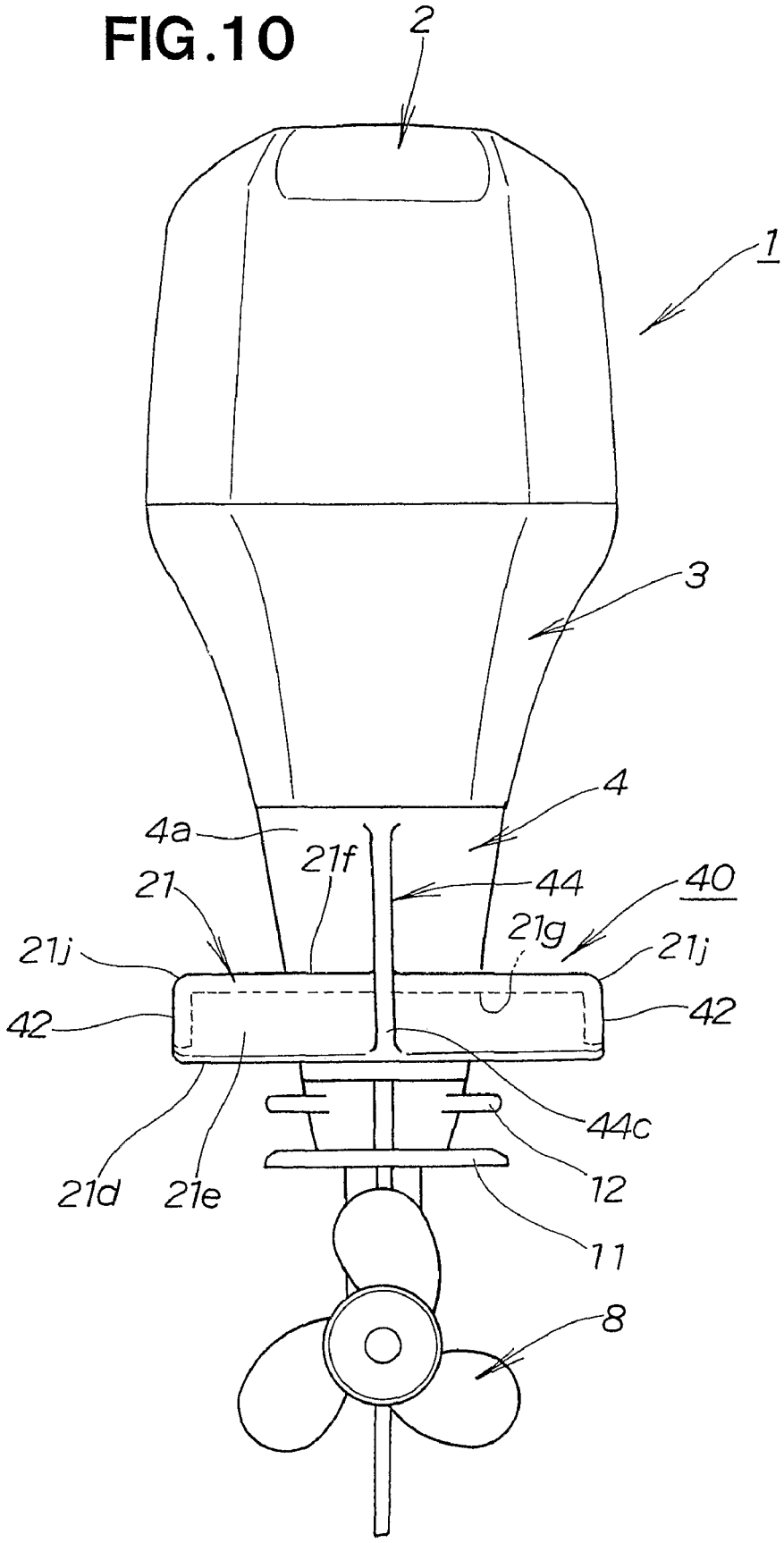
FIG. 10 is a rear view of the boat propulsion engine shown in FIG. 8.

The boat propulsion engine 1 of the second embodiment is characterized in being different from the first embodiment in that the lift generator 20 (see FIG. 3) is changed to a lift generator 40, and the multiple supporting members 24 (see FIG. 3) are changed to one supporting member 44, as shown in FIGS. 8, 9, and 10. The configuration is otherwise identical to the configuration of the first embodiment shown in FIGS. 1 through 4, and the same numerical symbols are therefore used and descriptions are omitted.

The lift generator 40 of the second embodiment is composed of a plate body 21 (main body 21), and side edge parts 42, 42 formed integrally on the left and right edges 21*j*, 21*j* in the plate body 21. The configuration of the plate body 21 has the same configuration as in the first embodiment, and the same numerical symbols are therefore used and descriptions are omitted.

The lift generator 40 has a downward-oriented concave shape in cross section when viewed from behind as in FIG. 10, due to the presence of the side edge parts 42, 42 (reinforcing bodies 42, 42) that extend downward from the left and right edges 21*j*, 21*j* of the plate body 21. As a result, the rigidity of the lift generator 40 is increased.

More specifically, the left side edge part 42 is substantially triangular in a side view, and the bottom 42*a* is inclined backward and downward so that the left side edge 21*j* of the plate body 21, the rear end 21*k* of this side edge 21*j*, and the front end 21*m* of the side edge 21*j* are all connected, as shown in FIGS. 9 and 10. The portion of the side edge 42 in the curved part 21*i* of the main body 21 protrudes the farthest downward. The side edge 42 is not substantially formed at the rear end 21*k* and front end 21*m* portions of the side edge 21*j*.

The supporting member 44 of the second embodiment has a configuration that resembles the supporting members 34 of the first modification shown in FIG. 5, and only one is located in the widthwise middle of the boat propulsion engine 1, i.e., in the widthwise center of the rear surface 4*a* on the outer periphery of the extension case 4.

The supporting member 44 extends to the base portion where the front half 21*b* of the plate body 21 is attached to the rear surface 4*a* of the extension case 4, is formed as a fairly thick component, and is substantially triangular in shape when viewed from the side.

The rearmost end 44*c* of the supporting member 44 (supporting body 44) extends to the vicinity of the rear end 21*d* of the rear inclined part 21*e*. The bottom end 44*a* of the supporting member 44 is integrally provided to both the top surface 21*f* of the intermediate part 21*c* and the top surface of the rear inclined part 21*e*. The front end 44*b* of the supporting member 44 is integrally provided at the top of the rear surface 4*a* in the outer peripheral wall of the extension case 4. Thus, the supporting member 44 integrally connects the intermediate part 21*c* and the rear inclined part 21*e* with the rear surface 4*a* of the extension case 4.

Thus, according to the second embodiment, it is possible: (1) to increase the thickness of the supporting member 44 despite the fact that there is only one supporting member; (2) to integrally connect the rear ends 21*k* and the front ends 21*m* of the side edge parts 42 by providing side edge parts 42, 42 that extend downward on the left and right sides of the supporting member 44; and (3) to further increase the support rigidity of the lift generator 40 by extending the rear of the supporting member 44 to the top surface of the rear inclined part 21*e*.

Next, a first modification of the boat propulsion engine 1 according to the second embodiment will be described with reference to FIG. 11.

Figure 11:
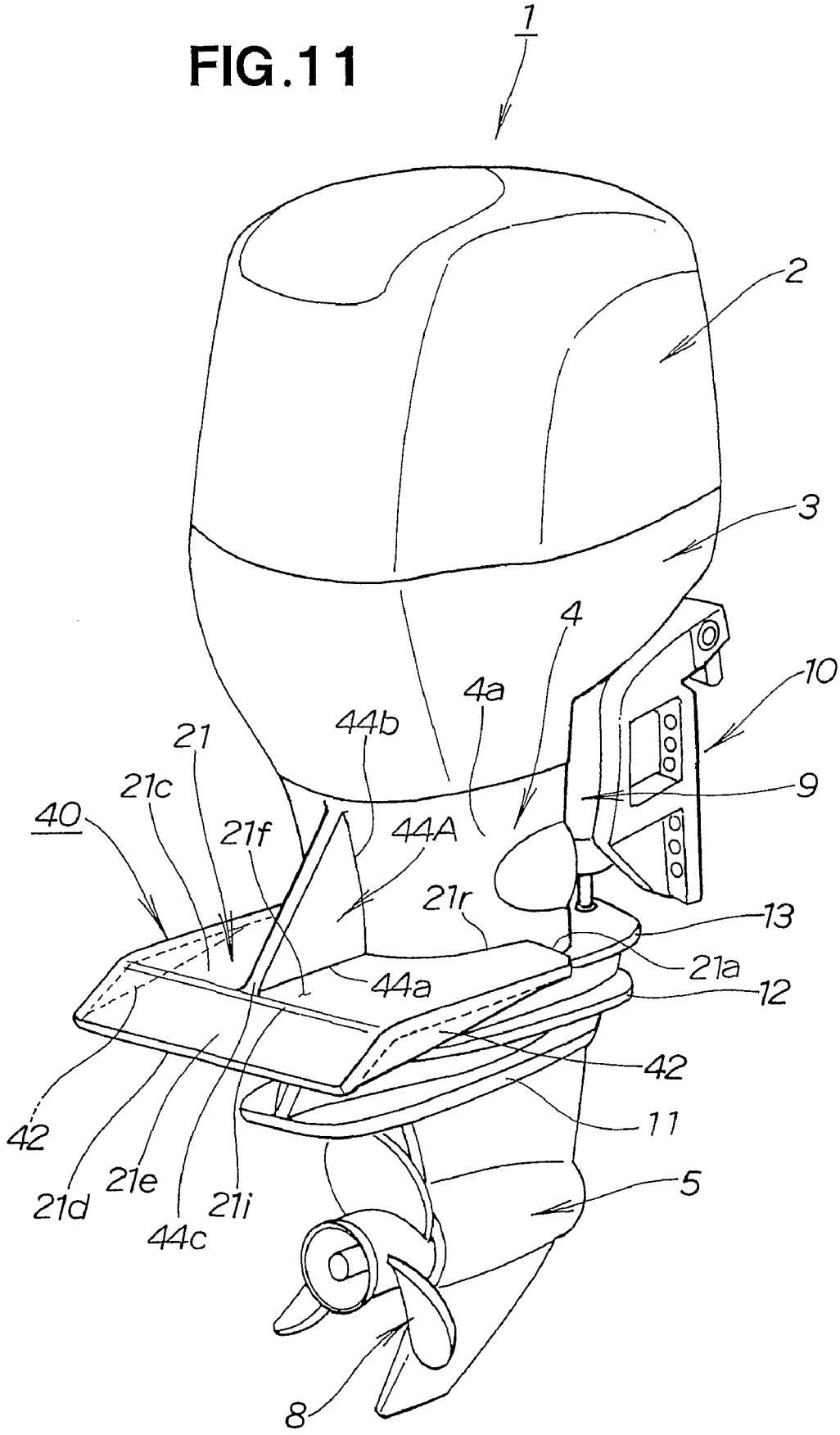
FIG. 11 is a perspective view of a first modification of the boat propulsion engine according to a second embodiment of the present invention.

The boat propulsion engine 1 of the first modification is characterized in that the supporting member 44 of the second embodiment is changed to a supporting member 44A, as shown in FIG. 11. The rearmost end 44*c* of the supporting member 44A is located at the curved part 21*i* at the front of the rear inclined part 21*e*. It is also acceptable for the rearmost end 44*c* of the supporting member 44A to not extend to the rear inclined part 21*e* in this manner. High rigidity is achieved in this case as well because the plate body 21 is supported by the left and right side edge parts 42, 42. The configuration is otherwise identical to the configuration in the second embodiment shown in FIGS. 8 through 10, and the same numerical symbols are therefore used and descriptions are omitted.

Next, a second modification of the boat propulsion engine 1 according to the second embodiment will be described with reference to FIG. 12.

Figure 12:
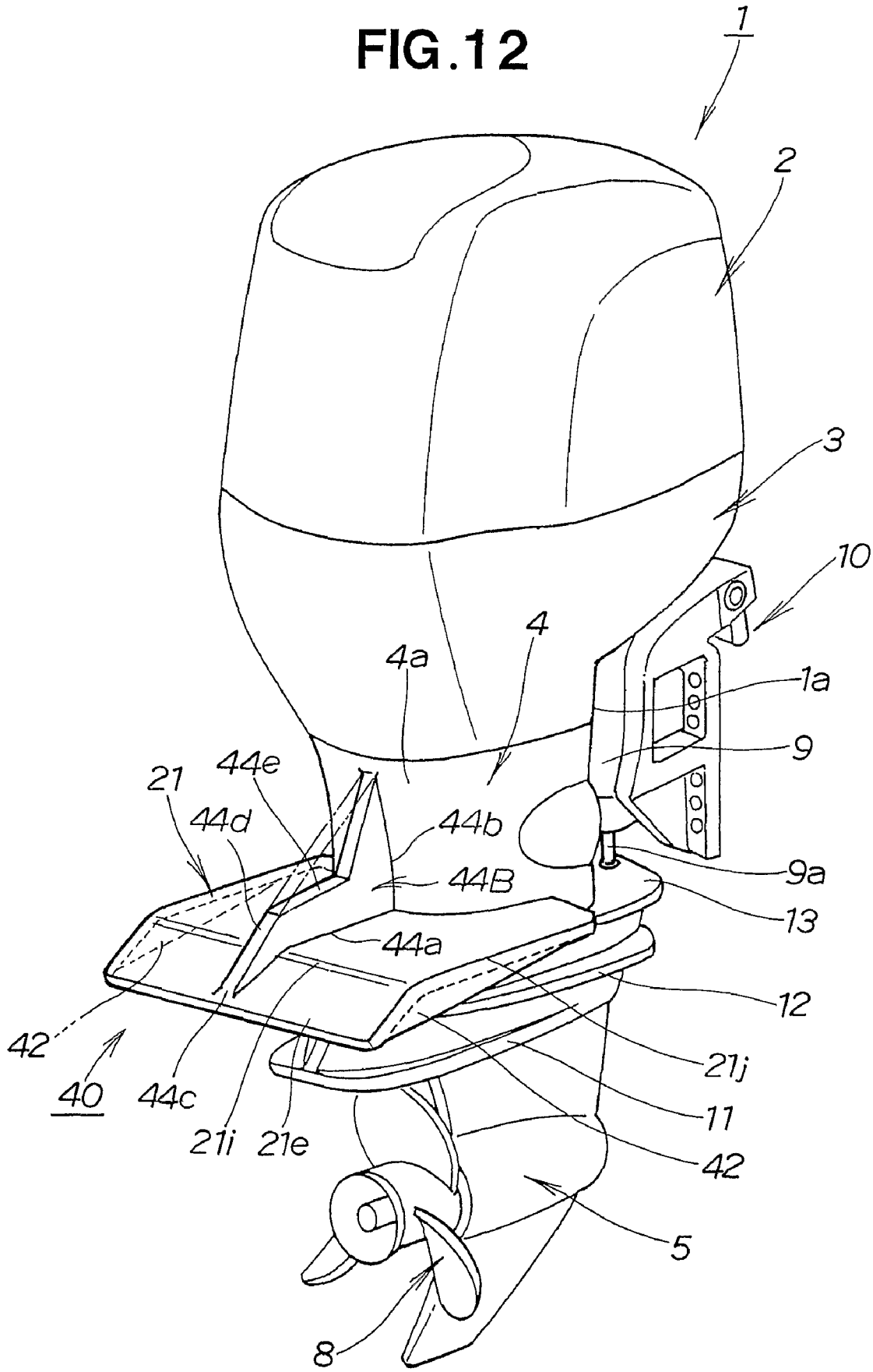
FIG. 12 is a perspective view of a second modification of the boat propulsion engine according to the second embodiment of the present invention.

The boat propulsion engine 1 of the second modification is characterized in that the supporting member 44 of the second embodiment is changed to a supporting member 444B, as shown in FIG. 12. The supporting member 44B, when viewed from the side, has a substantial L shape due to the presence of a recessed part 44*e* formed in the top edge 44*d*. The supporting member 44B extends to the top surface of the rear inclined part 21*e* of the second embodiment as well, and the support rigidity of the rear inclined part 21*e* can be increased. The configuration is otherwise identical to the configuration in the second embodiment shown in FIGS. 8 through 10, and the same numerical symbols are therefore used and descriptions are omitted.

Next, the boat propulsion engine 1 according to a third embodiment will be described with reference to FIG. 13.

Figure 13:
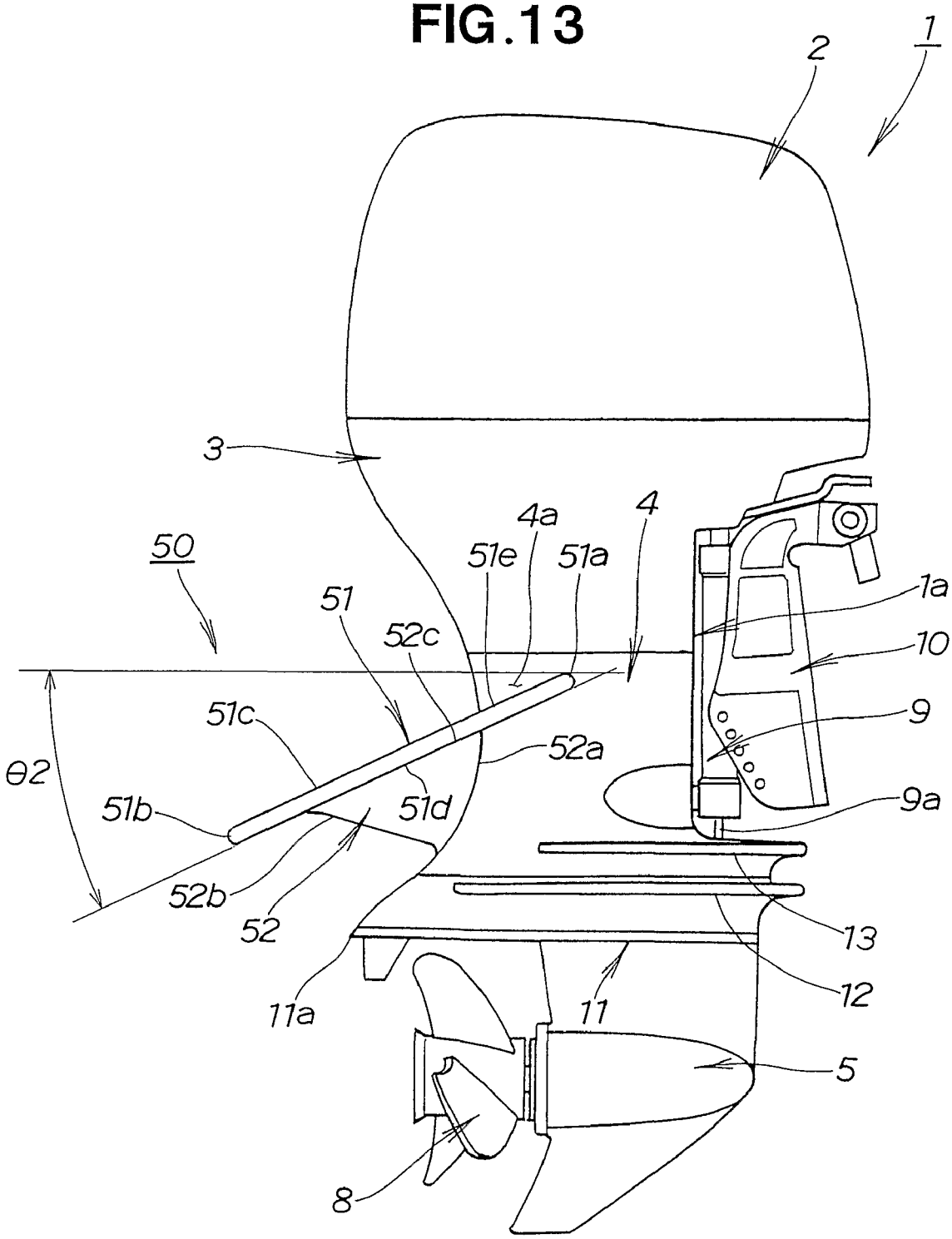
FIG. 13 is a side view of the boat propulsion engine according to a third embodiment of the present invention.

The boat propulsion engine 1 of the third embodiment is characterized in being different from the first embodiment in that the lift generator 20 (see FIG. 3) is changed to a lift generator 50, and the multiple supporting members 24 (see FIG. 3) are changed to a supporting member 52, as shown in FIG. 13. The configuration is otherwise identical to the configuration of the first embodiment shown in FIG. 1 through 4, and the same numerical symbols are therefore used and descriptions are omitted.

The lift generator 50 of the third embodiment is configured from a single plate body 51. This plate body 51 is integrally provided at the top of the rear surface 4*a* in the outer peripheral wall of the extension case 4, and is a flat plate with a substantially rectangular shape when viewed from above.

More specifically, the plate body 51 is a flat plate that is inclined in linear fashion downward and rearward. The angle θ2 of inclination (angle θ2 of recession) of the plate body 51 is substantially the same as the angle θ1 of inclination of the rear inclined part 21*e* shown in FIG. 2. Furthermore, the plate body 51 is disposed above the anti-cavitation plate 11 and the anti-splash plates 12, 13. In other words, the plate body S1 is oriented with the front end 51*a* at a high position and the rear end 51*b* at a low position. The relationship of the plate body 51 to the plates 11, 12, 13 is the same as in the first embodiment.

Furthermore, the top surface 51*c* and the bottom surface 51*d* of the plate body 51 are both flat. The front part 51*e* of the plate body 51 is formed into a fork shape (bifurcated shape) in plan view, and is connected and integrated so as to enclose the rear surface 4*a* on the outer peripheral wall of the extension case 4 from the left and right sides.

The supporting member 52 is disposed below the plate body 51. Specifically, the supporting member 52 is a single vertical plate that connects the widthwise middle of the bottom surface 51*d* of the plate body 51 with the middle of the rear surface 4*a* of the extension case 4. The front end 52*a* of the supporting member 52 has a specific height and is integrally formed in the middle of the rear surface 4*a* of the extension case 4. The bottom end edge 52*b* of the supporting member 52 is oriented upward and to the rear. The top end 52*c* of the supporting member 52 is integrally formed in the widthwise middle of the bottom surface 51*d* of the plate body 51. The top end 52*c* is provided at the front of the rear end 51*b* of the plate body 51. The supporting member 52 is not limited to only one member, and multiple supporting members 52 may be disposed separated from each other to the left and right.

Thus, according to the third embodiment, the entire plate body 51, including the front half, is inclined downward and rearward from the direction of propulsion at an angle 92. Therefore, the plate body 51 can raise the boat propulsion engine 1 and the stern St (see FIG. 1) very quickly and smoothly when the hull Si begins to move. Accordingly, the moving hull Si (see FIG. 1) is brought to a nearly horizontal orientation in an extremely short amount of time. As a result, the hull Si can be brought to high speeds quickly and smoothly.

Furthermore, since the front half of the plate body 51 is also inclined, the lift effects can be achieved even in cases in which the draft of the hull Si is deeper. Therefore, the lift generator 50 has a greater range of application.

Next, a first modification of the boat propulsion engine 1 according to the third embodiment will be described with reference to FIG. 14.

Figure 14:
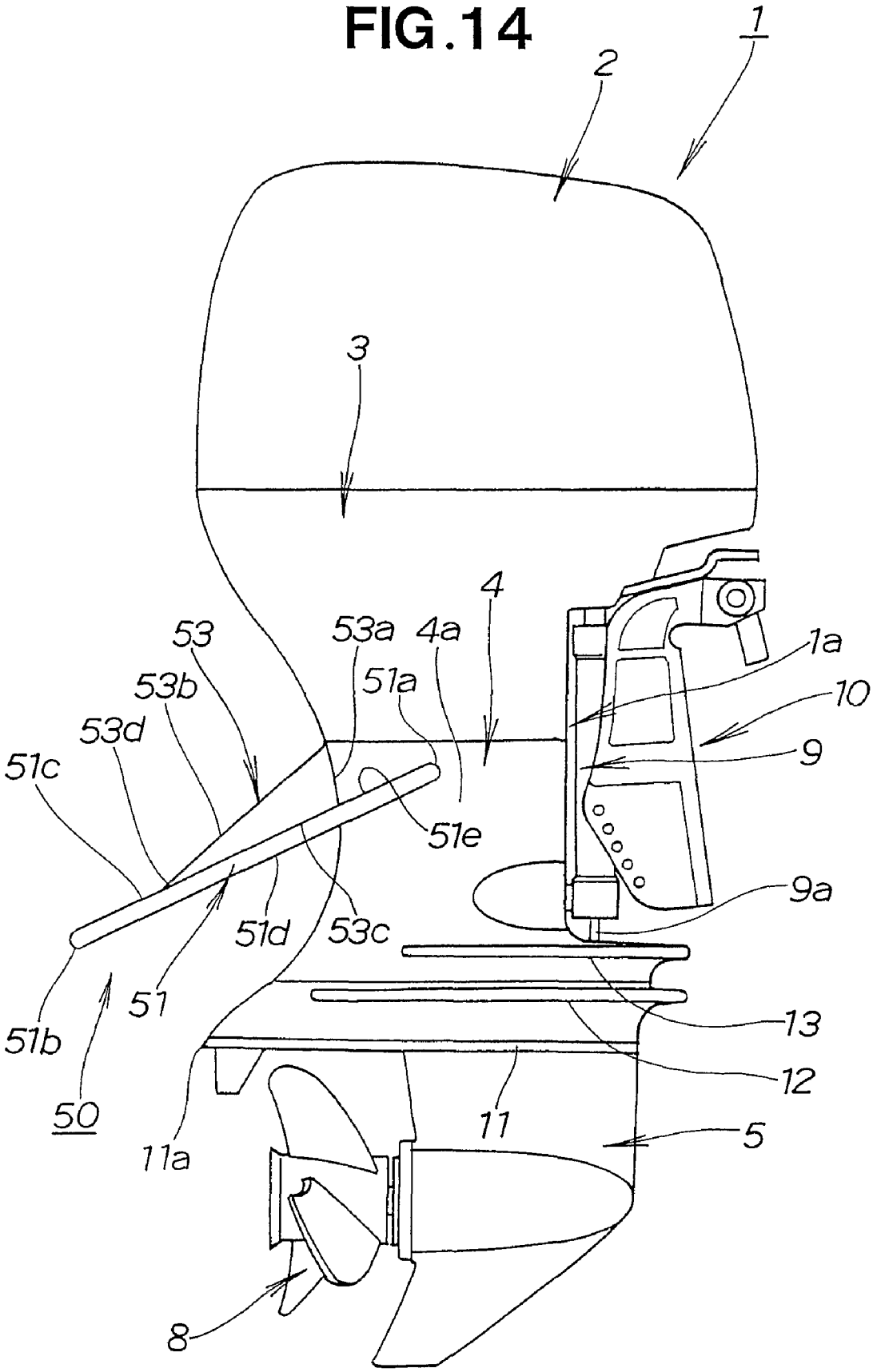
FIG. 14 is a side view of a first modification of the boat propulsion engine according to the third embodiment of the present invention.

The boat propulsion engine 1 of the first modification is characterized in that the supporting member 52 of the third embodiment is changed to a supporting member 53, as shown in FIG. 14.

The supporting member 53 is disposed above the plate body 51. Specifically, the supporting member 53 is a single vertical plate that connects the widthwise middle of the top surface 51*c* of the plate body 51 with the middle of the rear surface 4*a* of the extension case 4. The front end 53*a* of the supporting member 53 has a specific height and is integrally formed in the middle of the rear surface 4*a* of the extension case 4. The top end edge 53*b* of the supporting member 53 is oriented downward and rearward. The bottom end edge 53*c* of the supporting member 53 is integrally formed in the widthwise middle of the top surface 51*c* of the plate body 51. The rear end 53*d* of the supporting member 53 is provided at the front of the rear end 51*b* of the plate body 51. The supporting member 53 is not limited to only one member, and multiple supporting members 53 may be disposed separated from each other to the left and right.

The configuration is otherwise identical to the configuration of the third embodiment shown in FIG. 13, and the same numerical symbols are therefore used and descriptions are omitted.

Next, a second modification of the boat propulsion engine 1 according to the third embodiment will be described with reference to FIG. 15.

Figure 15:
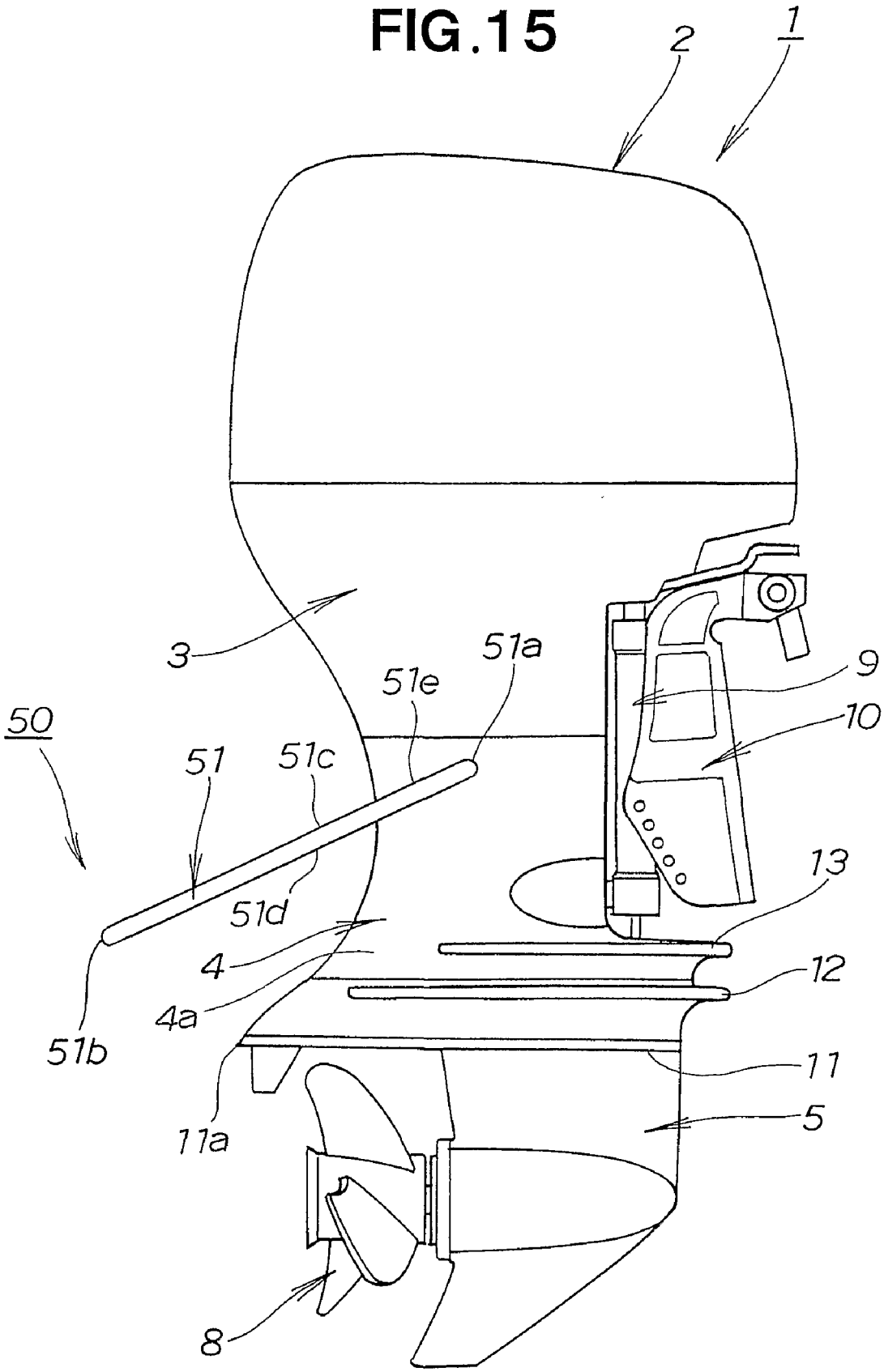
FIG. 15 is a side view of a second modification of the boat propulsion engine according to the third embodiment of the present invention.

The second modification is characterized in lacking the supporting member 52 (see FIG. 13) of the third embodiment, as shown in FIG. 15. The configuration is otherwise identical to the configuration of the third embodiment shown in FIG. 13, and the same numerical symbols are therefore used and descriptions are omitted.

The plate body 51 of the lift generator 50 has the same configuration as in the third embodiment, and is either formed integrally on the rear surface 4*a* of the extension case 4, or is bonded by welding or another such method.

This modification is preferred for a boat propulsion engine 1 that has low horsepower for propelling a relatively small hull Si (see FIG. 1).

Next, the boat propulsion engine 1 according to a fourth embodiment will be described with reference to FIG. 16.

Figure 16:
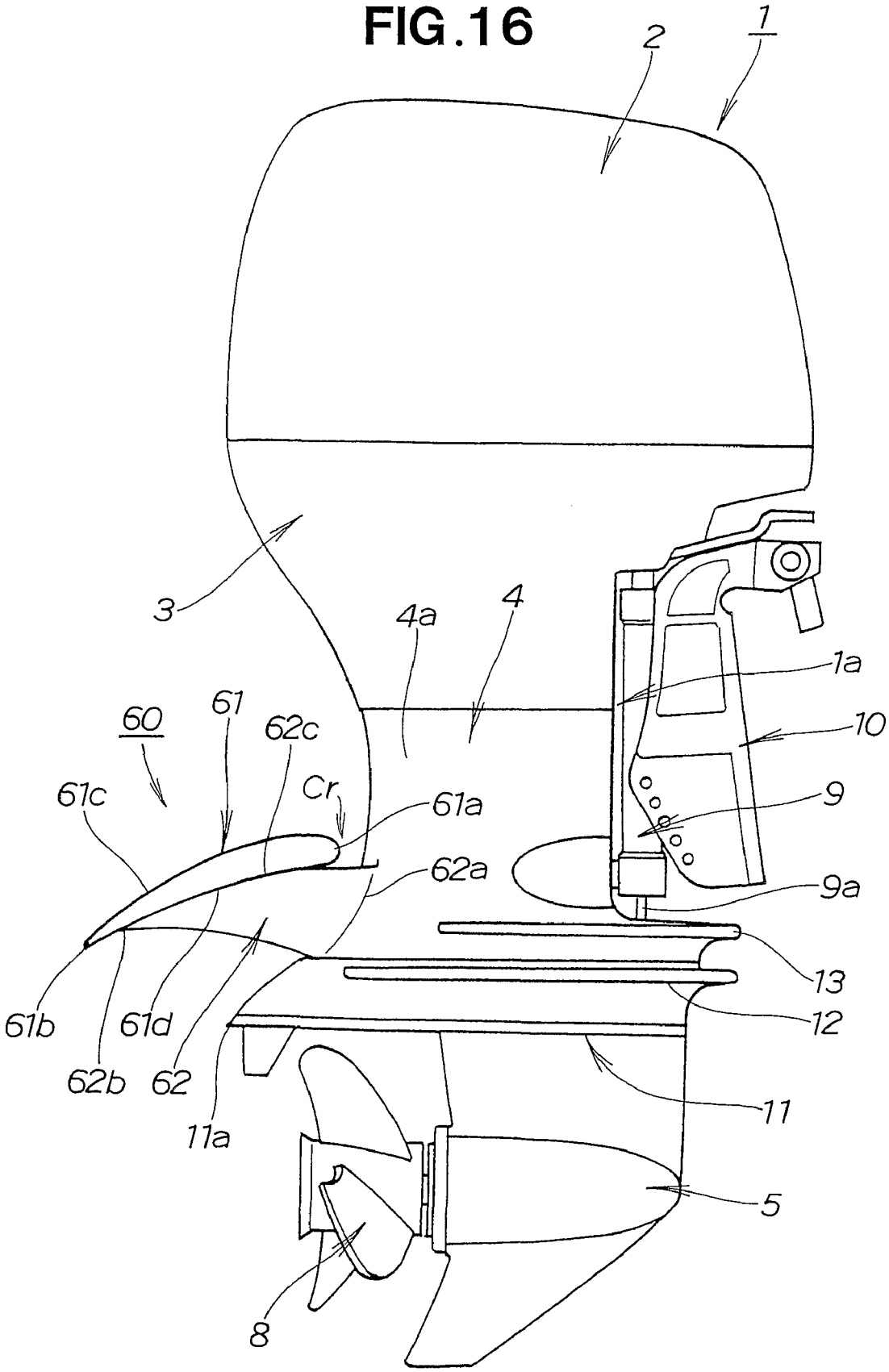
FIG. 16 is a side view of the boat propulsion engine according to a fourth embodiment of the present invention.

The boat propulsion engine 1 of the fourth embodiment is characterize in being different from the first embodiment in that the lift generator 20 (see FIG. 3) is changed to a lift generator 60, and the multiple supporting members 24 (see FIG. 3) are changed to multiple supporting members 62, as shown in FIG. 16. The configuration is otherwise identical to the configuration of the first embodiment shown in FIGS. 1 through 4, and the same numerical symbols are therefore used and descriptions are omitted.

The lift generator 60 is disposed a specific distance Cr back from the rear surface 4*a* in the lower half of the extension case 4, and is integrally attached to the rear surface 4*a* by the supporting members 62 (supporting bodies 62).

More specifically, the lift generator 60 is configured from a single wing-shaped body 61. The wing-shaped body 61 is disposed a specific distance Cr back from the lower half of the rear surface 4*a* of the extension case 4, and has a wing shape that is inclined downward and rearward at a recessed angle from the propelled direction of the boat propulsion engine 1.

More specifically, the wing-shaped body 61 is formed into a substantially rectangular shape when viewed from above, and is formed into a substantially wing-shaped cross section that is inclined downward and rearward from the front end 61*a* that faces the rear surface 4*a*, when viewed from the side. In other words, when viewed from the side, the wing-shaped body 61 has an arcuate shape that is inclined downward and rearward from the front edge 61*a* towards the rear edge 61*b*, and the bottom surface 61*d* is formed into a concave shape having a slight arc. The angle of inclination of the wing-shaped body 61 is substantially the same as the angle θ1 of inclination of the rear inclined part 21*e* shown in FIG. 2.

Furthermore, the wing-shaped body 61 is disposed above the anti-cavitation plate 11 and the anti-splash plates 12, 13. Specifically, the wing-shaped body 61 is oriented with the front edge 61*a* at a high position and the rear edge 61*b* at a low position. The relationship of the wing-shaped body 61 to the plates 11, 12, 13 is the same as in the first embodiment.

The supporting members 62 are disposed below the wing-shaped body 61. Specifically, the supporting members 62 are two vertical plates (only one is shown in FIG. 16) that connect the bottom surface 61*d* of the wing-shaped body 61 with the rear surface 4*a* of the extension case 4. The two supporting members 62 are disposed separated from each other to the left and right.

The front ends 62*a* of the supporting members 62 have a specific height and are formed integrally in the middle of the rear surface 4*a* of the extension case 4. The rear ends 62*b* of the supporting members 62 are provided in front of the rear edge 61*b* of the wing-shaped body 61. The top ends 62*c* of the supporting members 62 are integrally formed on the bottom surface 61*d* of the wing-shaped body 61.

Next, the boat propulsion engine 1A of a fifth embodiment will be described with reference to FIGS. 17 through 21.

The boat propulsion engine 1A of the fifth embodiment is characterized in that the extension case 4 (see FIG. 3) of the first embodiment is changed to a structure that combines a leg case 70 and a cover 104, and the cover 104 is provided with a lift generator 120, as shown in FIGS. 17 through 21. The configuration of the boat propulsion engine 1A is otherwise substantially identical to that of the boat propulsion engine 1 in the first embodiment. The rest of the configuration is also otherwise identical to the configuration in the first embodiment shown in FIGS. 1 through 4, and the same numerical symbols are therefore used and descriptions are omitted.

First, the boat propulsion engine 1A of the fifth embodiment will be described based on FIG. 17, with reference to FIGS. 2 and 3. The boat propulsion engine 1A has a leg case 70 instead of the extension case 4 (see FIG. 3), and the periphery of the leg case 70 is covered by the cover 104.

The leg case 70 is an accommodating member located between the undercover 3 and the gear case 5, similar to the extension case 4, and fulfills substantially the same role as the extension case 4. The leg case 70 is configured to be narrower than the extension case 4, and is composed of an aluminum alloy or another such lightweight metal material.

The leg case 70 has a flange 71 formed at the top end, two left and right attachment bosses 73 formed at the top of the front surface, and two left and right mounting housings 75 formed at the bottom. FIG. 17 shows only one attachment boss 73 and one mounting housing 75. The attachment bosses 73 have attachment holes. The left and right mounting housings 75 support a center housing by means of buffering members in the lower end of the swivel case 9.

The top surface of the flange 71 of the leg case 70 is aligned with and bonded to a bottom surface of the undercover 3. The bottom end surface 72 of the leg case 70 is aligned with and bonded to the top surface 5*d* of the gear case 5. As a result, the leg case 70 is integrated with the undercover 3 and the gear case 5.

The undercover 3 and the gear case 5 have substantially the same configuration as in the first embodiment. Furthermore, the undercover 3 has one attachment part 74 in the widthwise center of the rear surface, in a vicinity of the bottom end. The attachment part 74 has an attachment hole.

The cover 104 is designed with the same configuration as the outward configuration of the extension case 4 (see FIG. 3) of the first embodiment. This is achieved by covering the leg case 70 from the left and right sides, as shown in FIGS. 17 and 18. This cover 104 can be divided in two parts to the left and right at the widthwise center of the leg case 70, and is composed of a left half 104L and a right half 104R.

Figure 19:
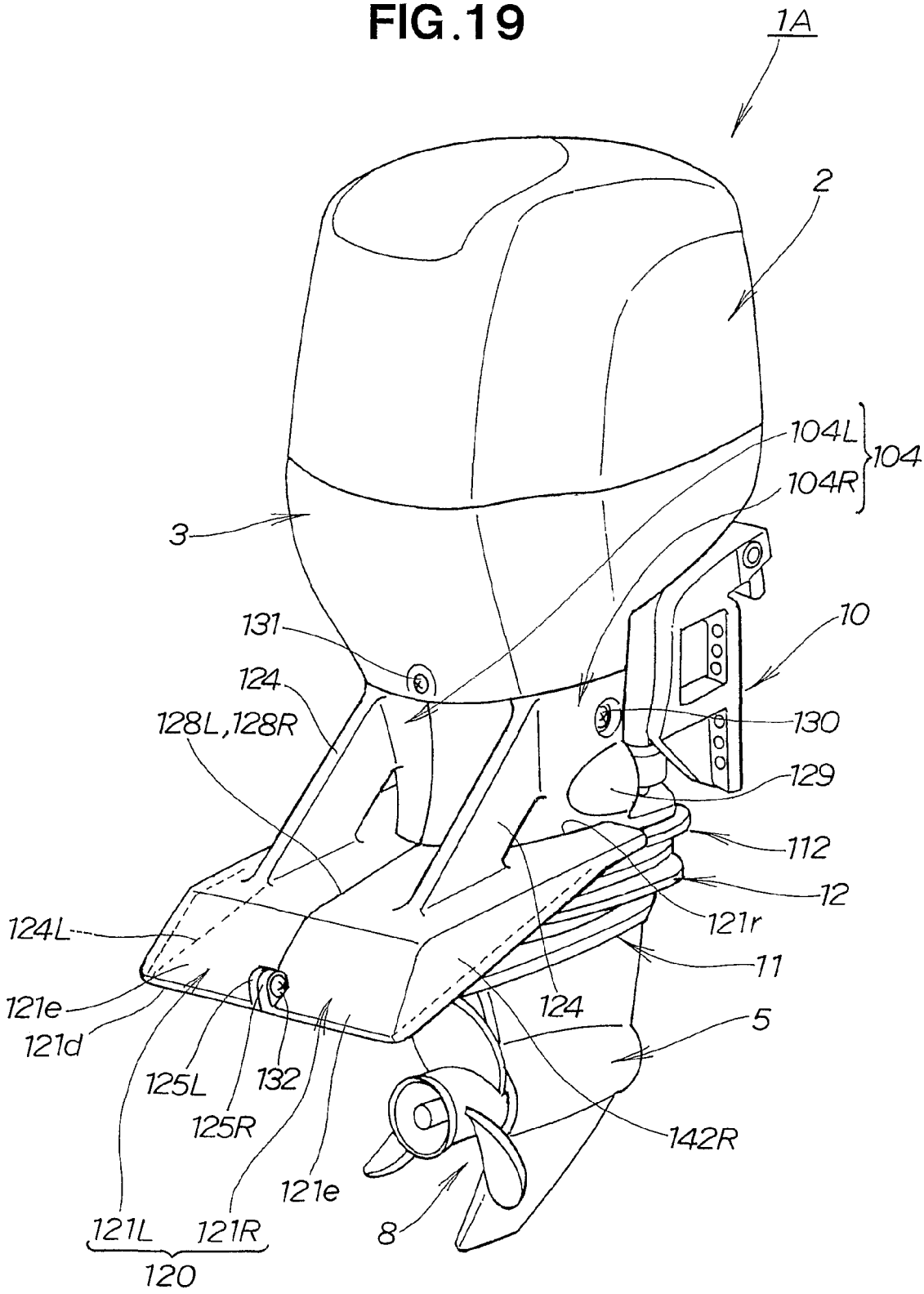
FIG. 19 is diagram describing the manner in which the lift generator is assembled on the boat propulsion engine shown in FIG. 17.

The left and right halves 104L, 104R are halved members that are bilaterally symmetrical to each other, and have bonding surfaces 128L, 128R that face each other. Therefore, the left and right halves 104L, 104R form an integrated cover 104 as shown in FIG. 19, when the bonding surfaces 128L, 128R are joined together. Furthermore, the left and right halves 104L, 104R are composed of a very strong and rigid synthetic resin.

The left half 104L is composed of a main body 104*a* that covers the left half of the leg case 70, a plate-shaped half 121L that extends backward from the main body 104*a*, and a supporting member 124. Similarly, the right half 104L is composed of a main body 104*a* that covers the right half of the leg case 70, a plate-shaped half 121R that extends backward from the main body 104*a*, and a supporting member 124.

The left and right main bodies 104*a*, 104*a* are substantially half-cylinder members that are long and thin and that extend vertically, and these main bodies form a shape that is substantially a cylinder that covers the leg case 70 when the bodies are assembled together. The left main body 104*a* has a stepped part 104*b*, an interlocking piece 104*c*, an upper anti-splash plate 112, an attachment part 126L, an attachment piece 127L, and an expanded cover part 129. Similarly, the right main body 104*a* has a stepped part 104*b*, an interlocking piece 104*c*, an upper anti-splash plate 112, an attachment part 126R, an attachment piece 127R, and an expanded cover part 129.

The left and right stepped parts 104*b*, 104*b* extend in the shapes of shelves that enclose the front halves at the bottoms of the outer surfaces of the main bodies 104*a*, 104*a*.

The left and right interlocking pieces 104*c*, 104*c* are thin members formed along the top end edges of the main bodies 104*a*, 104*a*, and are capable of fitting in the insides of the bottom end of the undercover 3.

The upper anti-splash plates 112, 112 are formed in the vertical middles of the left and right stepped parts 104*b*, 104*b*, and these plates replace the upper anti-splash plate 13 shown in FIGS. 1 through 4.

The left and right attachment parts 126L, 126R are bosses formed on the inner surfaces of the main bodies 104*a*, 104*a*, and are disposed at positions that face the attachment bosses 73 of the leg case 70.

The left and right attachment pieces 127L, 127R are formed at the rear ends of the left and right interlocking pieces 104, 104*c*, and are disposed at positions that face the attachment part 74 of the undercover 3.

The left and right plate-shaped halves 121L, 121R form the lift generator 120 when joined together, as shown in FIG. 19. The lift generator 120 has substantially the same configuration as the lift generator 40 of the second embodiment shown in FIG. 8.

More specifically, the front side edges of the left and right plate-shaped halves 121L, 121R have arcuate concavities 121*r*, 121*r* along the rear surfaces of the main bodies 104*a*, 104*a*, as shown in FIGS. 17 through 21. As a result, the concavities 121*r*, 121*r* encircle the rear surfaces of the main bodies 104*a*, 104*a* and are formed integrally in the rear, surfaces.

The rear ends 121*d*, 121*d* of the left and right plate-shaped halves 121L, 121R are located behind and above the rear end 11*a* of the anti-cavitation plate 11, i.e., behind and above the propeller 8.

The left and right plate-shaped halves 121L, 121R are composed of horizontal front halves 121*b*, 121*b* that extend backward from the front ends 121*a*, 121*a*; horizontal intermediate parts 121*c*, 121*c* that extend further backward from the rear ends of the front halves 121*b*, 121*b*; and rear inclined parts 121*e*, 121*e* that extend downward and rearward from the rear ends 121*i*, 121*i* (curved parts 121*i*, 121*i*) of the intermediate parts 121*c*, 121*c* and that reach the rear ends 121*d*, 121*d*.

The left and right front halves 121*b*, 121*b* are disposed on the left and right sides of the main bodies 104*a*, 104*a*. Specifically, the front halves 121*b*, 121*b* are formed into forked shapes (bifurcated shapes) in plan view so as to enclose the rear surfaces on the outer peripheral walls of the main bodies 104*a*, 104*a* from the left and right sides. The intermediate parts 121*c*, 121*c* are disposed behind the main bodies 104*a*, 104*a*. The curved parts 121*i*, 121*i* are the borders between the intermediate parts 121*c*, 121*c* and the rear inclined parts 121*e*, 121*e*. The rear inclined parts 121*e*, 121*e* have connecting pieces 125L, 125R in the bonding surfaces 128L, 128R at the rear ends. The connecting pieces 125L, 125R' extend upward from the rear inclined parts 121*e*, 121*e*.

The left and right plate-shaped halves 121L, 121R have horizontal bottom surfaces 121*g*, 121*g* of the front halves 121*b*, 121*b* and the intermediate parts 121*c*, 121*c*, as well as inclined bottom surfaces 121*h*, 121*h* (inclined surfaces 121*h*, 121*h*) of the rear inclined parts 121*e*, 121*e*.

The entire shape of the left and right plate-shaped halves 121L, 121R can be regarded to be substantially rectangular when viewed from above.

Furthermore, the left and right plate-shaped halves 121L, 121R have side edge parts 142L, 142R (reinforcing bodies 142L, 142R) that are formed integrally on the outer edges on the opposite sides of the bonding surfaces 128L, 128R. The side edge parts 142L, 142R are plates that are provided completely across the rear ends of the rear inclined parts 121*e*, 121*e* from the front ends 121*a*, 121*a*, and that have substantially the same configuration as the side edge parts 42 of the second embodiment shown in FIG. 8.

The rear inclined parts 121*e*, 121*e* in the left and right plate-shaped halves 121L, 121R have connecting pieces 125L, 125R in the bonding surfaces 128L, 128R at the rear ends.

The left supporting body 124 integrally links the top surface 121*f* of the plate-shaped half 121L with the rear of the outer peripheral surface of the main body 104*a*, and is composed of a relatively thick vertical plate. The rear end 124*a* of this supporting body 124 is integrally provided to a top surface 121*f* in the front half 121*b* of the plate-shaped half 121L. The front end 124*b* of the supporting member 124 is integrally provided at the top of the rear surface of the main body 104*a*.

The right supporting body 124 is bilaterally symmetrical to the left supporting member 124 but is otherwise substantially identical, and a description thereof is omitted.

The expanded cover part 129 covers the mounting housings 75 in the sides of the leg case 70.

The procedure of assembling the left and right cover halves 104L, 104R is as follows.

Figure 17:
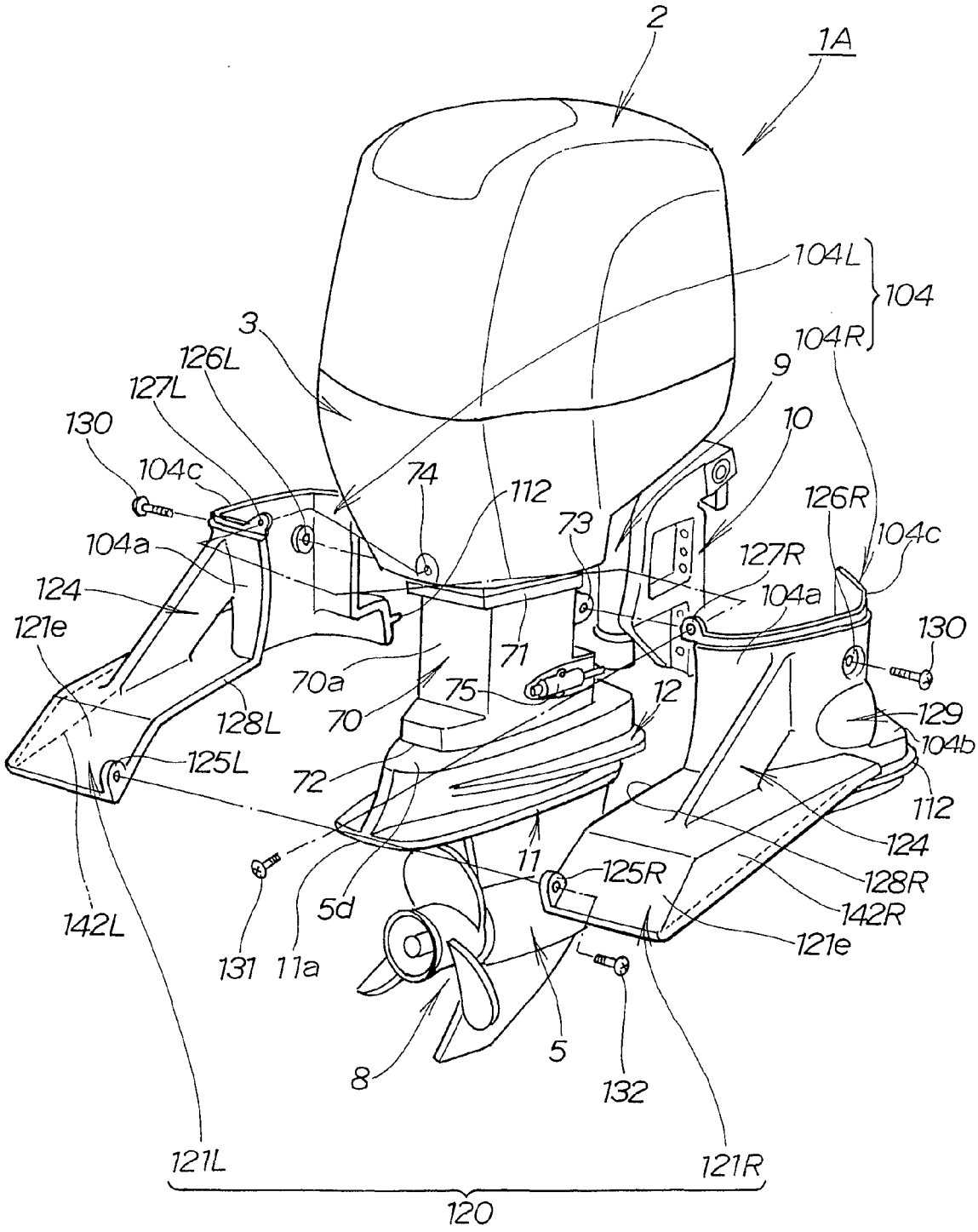
FIG. 17 is an exploded view of the boat propulsion engine and the lift generator according to a fifth embodiment of the present invention.
Figure 18:
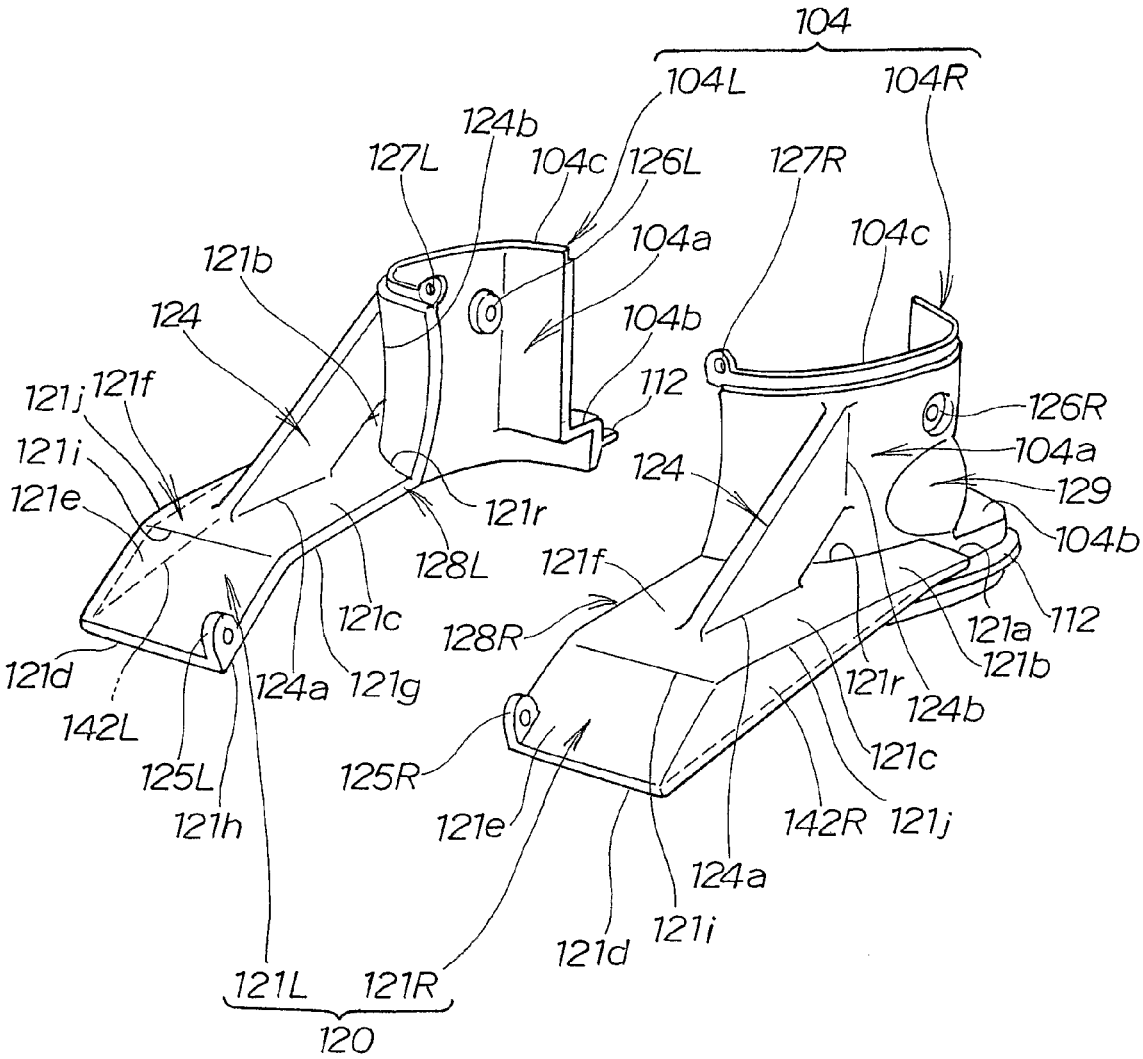
FIG. 18 is an exploded view of the lift generator shown in FIG. 17.

First, the left and right cover halves 104L, 104R are made to face the left and right sides of the leg case 70 of the boat propulsion engine 1A, and the bonding surfaces 128L, 128R are joined together, as shown in FIG. 17. As a result, the left and right main bodies 104*a*, 104*a* face the left and right surfaces of the leg case 70.

Next, with the bonding surfaces 128L, 128R joined together, the left and right interlocking pieces 104*c*, 104*c* are fitted into the inner side of the bottom end of the undercover 3.

Next, the left and right attachment parts 126L, 126R are made to coincide with the left and right attachment bosses 73 of the leg case 70 and are coupled using bolts 130, 130. As a result, the left and right main bodies 104*a*, 104*a* are coupled with the leg case 70. Furthermore, the mounting housings 75 of the leg case 70 are covered by the expanded cover parts 129.

Next, the left and right attachment pieces 127L, 127R are superposed over the front and rear of the attachment part 74 of the undercover 3, and are coupled using a bolt 131. As a result, the left and right cover halves 104L, 104R are coupled with the undercover 3.

Finally, the connecting pieces 125L, 125R of the left and right plate-shaped halves 121L, 121R are joined together and coupled using a bolt 132, completing the operation.

Figure 20:
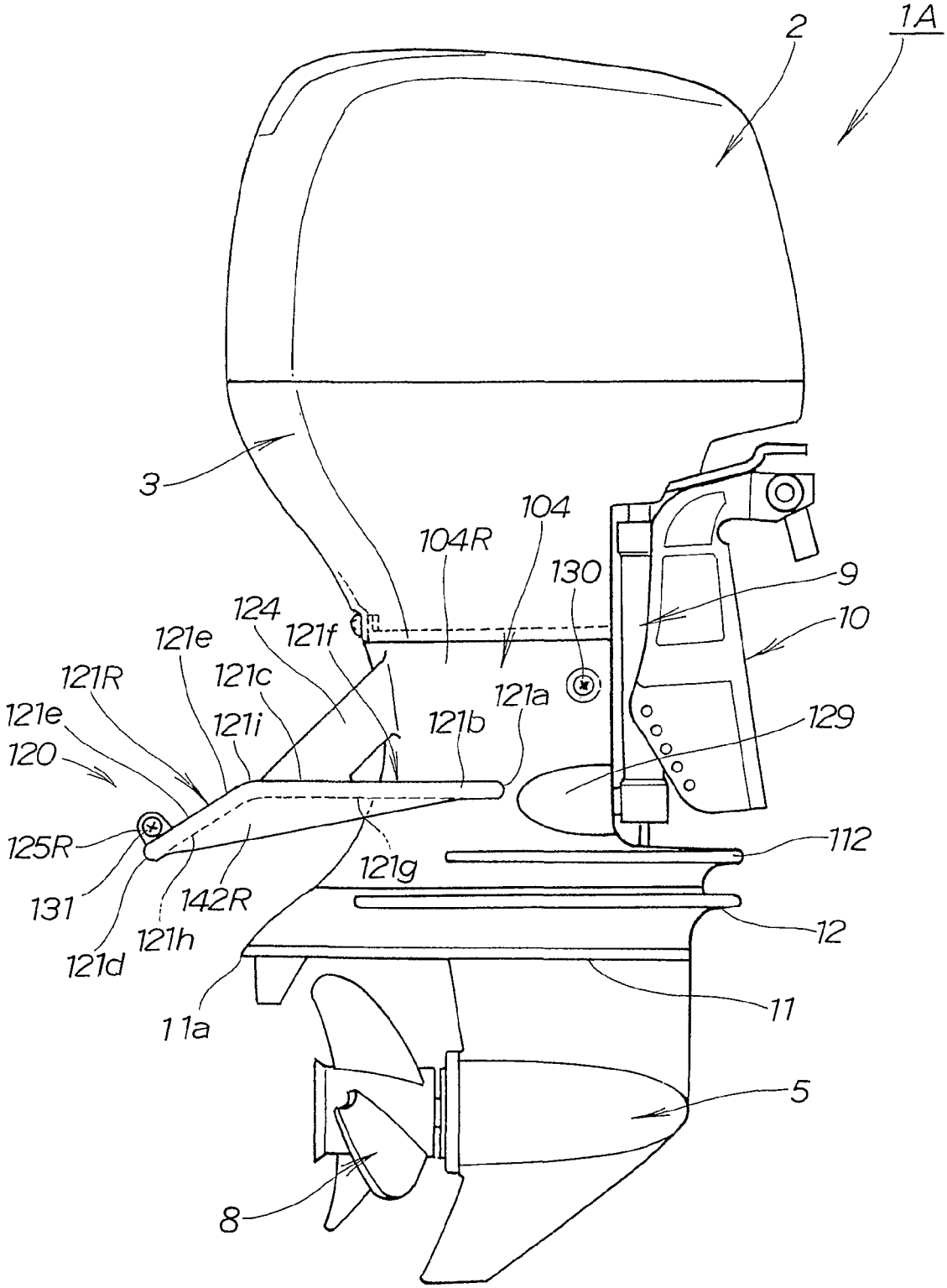
FIG. 20 is a side view of the boat propulsion engine and the lift generator shown in FIG. 19.
Figure 21:
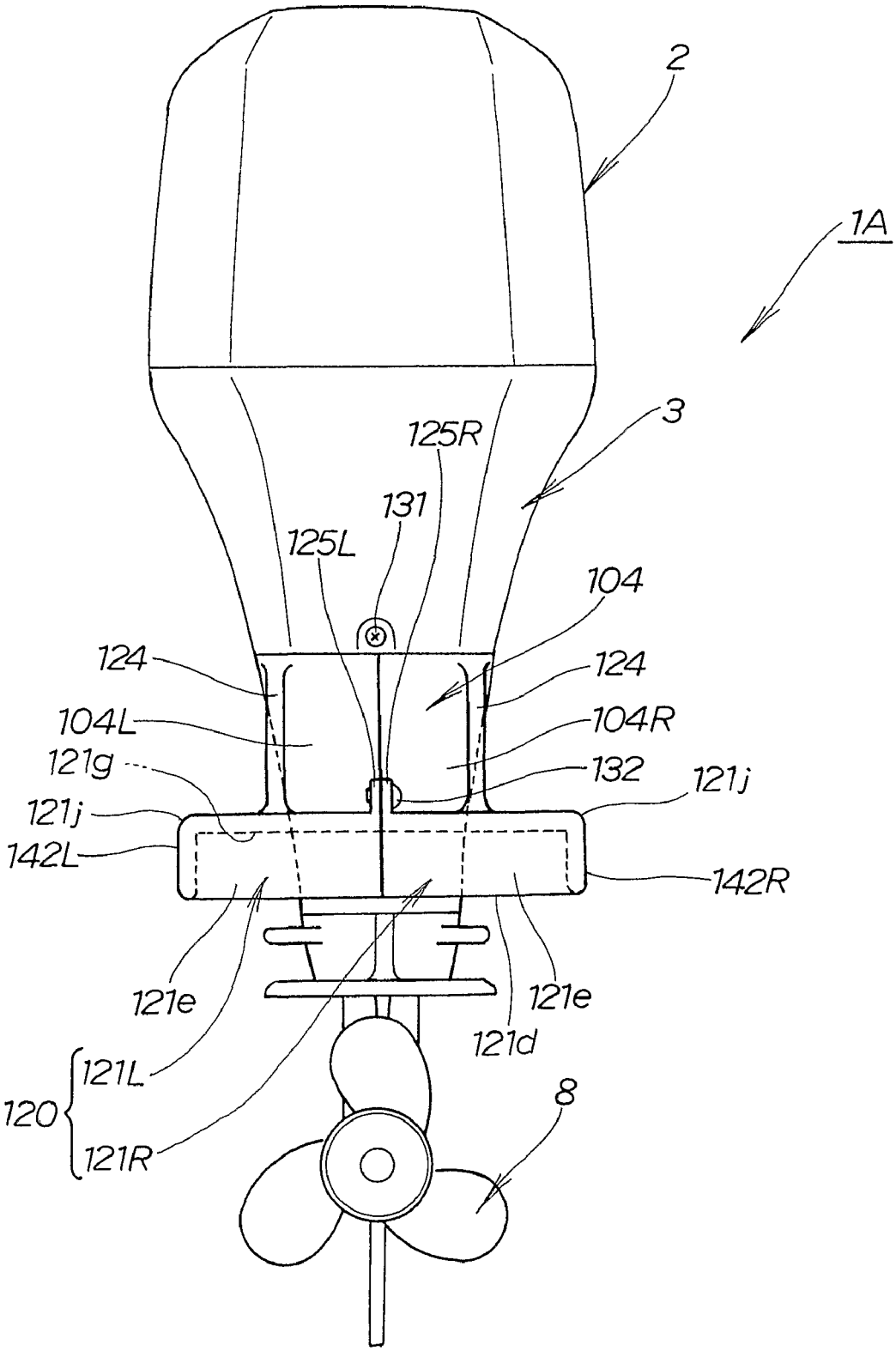
FIG. 21 is a rear view of the boat propulsion engine and the lift generator shown in FIG. 19.

As a result of assembling the parts in this manner, the left and right cover halves 104L, 104R form a cover 104, which is attached to the leg case 70, as shown in FIGS. 19 through 21. The cover 104 covers the leg case 70, resulting in an outward structure similar to the extension case 4 shown in FIGS. 1 through 4.

Furthermore, the left and right plate-shaped halves 121L, 121R form the lift generator 120 when assembled together. The conditions of the lift generator 120 are the same as in the first embodiment shown in FIGS. 1 through 4. The left and right supporting members 124, 124 are disposed on the lift generator 120 at specific intervals to the left and right, and support the left and right plate-shaped halves 121L, 121R.

The boat propulsion engine 1A of the fifth embodiment described above is summarized as follows.

The leg case 70 forms part of the main body of the boat propulsion engine 1A. This leg case 70 (main body 70) extends substantially vertically in relation to the hull Si. The cover 104 is a separate member from the leg case 70, and forms an outer peripheral wall that covers the leg case 70. The lift generator 120 has surfaces 121*g*, 121*h* that extend to the left and right from the cover 104, behind at least the cover 104 (the outer peripheral wall 104).

The cover 104 is not limited to a configuration that is divided in two to the left and right, and another possibility is a configuration where the left and right cover halves 104L, 104R are formed integrally, and only part of the main bodies 104*a*, 104*a* can be opened to the left and right. For example, the cover 104 may be configured so that the rear half that includes the lift generator 120 is formed integrally, and the front half is configured to be capable of opening and closing to the left and right. In this case, after the front half is opened and mounted on the leg case 70, the open portions are coupled using bolts.

Next, a modification of the supporting members 124 (see FIG. 18) according to the fifth embodiment will be described with reference to FIG. 22.

Figure 22:
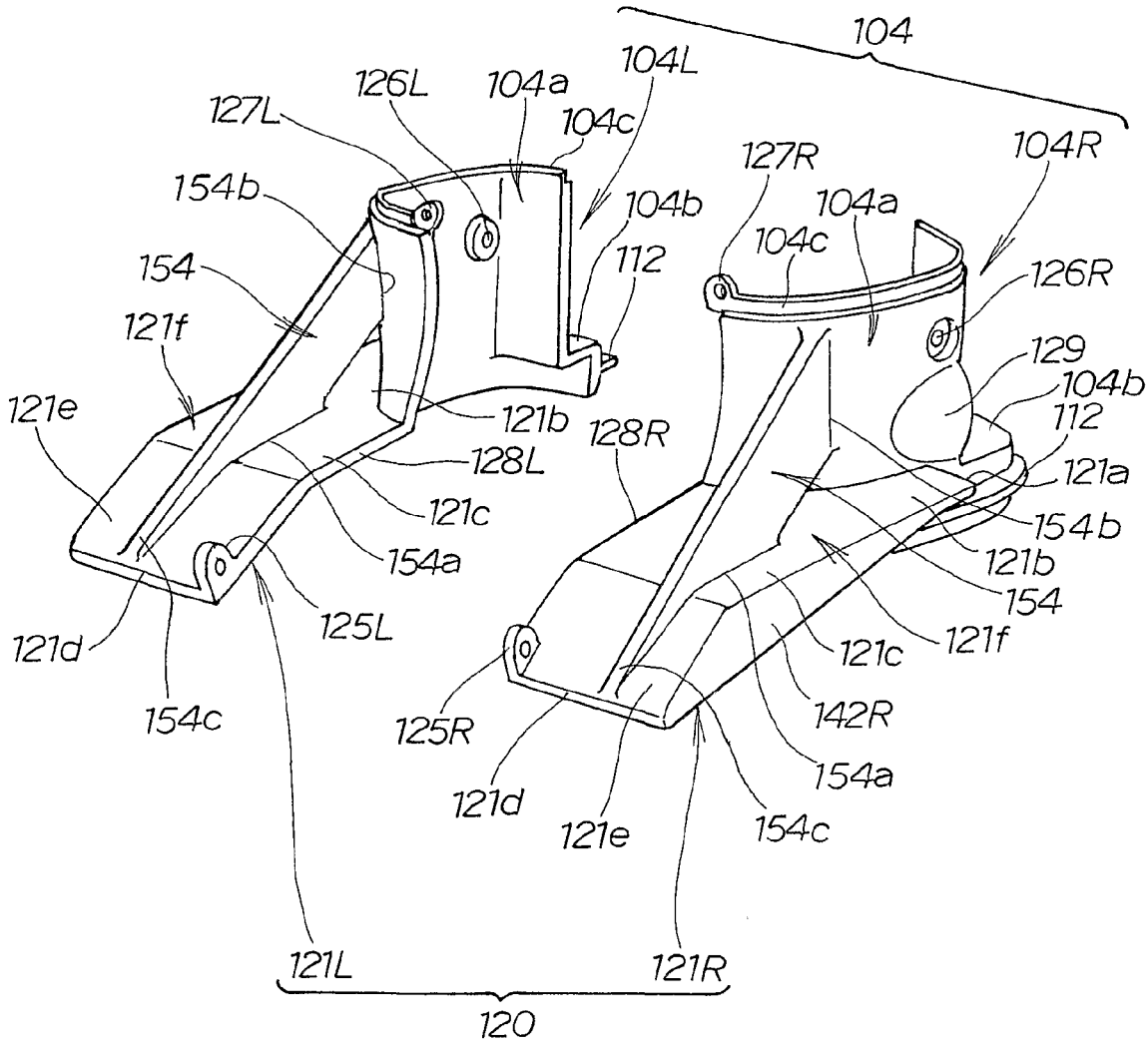
FIG. 22 is an exploded view of a modification of the lift generator according to the fifth embodiment of the present invention.

The cover 104 of this modification is characterized in that the supporting members 124 of the fifth embodiment are changed to supporting members 154, as shown in FIG. 22. The configuration is otherwise identical to the configuration of the fifth embodiment shown in FIGS. 17 through 21, and the same numerical symbols are therefore used and descriptions are omitted.

The supporting members 154 (supporting bodies 154) are characterized in that the rearmost ends 154*c* extend to the vicinity of the rear ends 121*d*, but the configuration is otherwise substantially identical to that of the fifth embodiment shown in FIGS. 17 through 21.

More specifically, the rear ends 154*a* of the supporting members 154 are provided integrally to both the top surfaces 121*f* of the intermediate parts 121*c* and the top surfaces of the rear inclined parts 121*e*. Specifically, the rear ends 154*a* extend to the vicinity of the rear ends 121*d*. The front ends 154*b* of the supporting members 154 are integrally provided at the tops of the rear surfaces of the main bodies 104*a*. Thus, the supporting members 154 integrally connect the rear inclined parts 121*e* of the intermediate parts 121*c* with the rear surfaces of the main bodies 104*a*.

According to this modification, the rigidity of the plate-shaped bodies 121 is increased because the supporting members 154 support the rear inclined parts 121*e* and the intermediate parts 121*c* linked thereto against the propulsive force borne by the lift generator 120, and particularly against the propulsive force borne by the rear inclined parts 121*e*.

The cover 104 according to both the fifth embodiment and the modification need not be divided in two, and may have the left half (left cover half 104L) and the right half (right cover half 104R) connected. For example, the cover 104 may be configured so that the rear half of a case 104 that includes the lift generator 120 is formed integrally, and the front part can be opened to the left and right. The front part is then opened and mounted around the leg case 70, and the divided and opened part at the front is coupled by bolts or the like.

Figure 23:
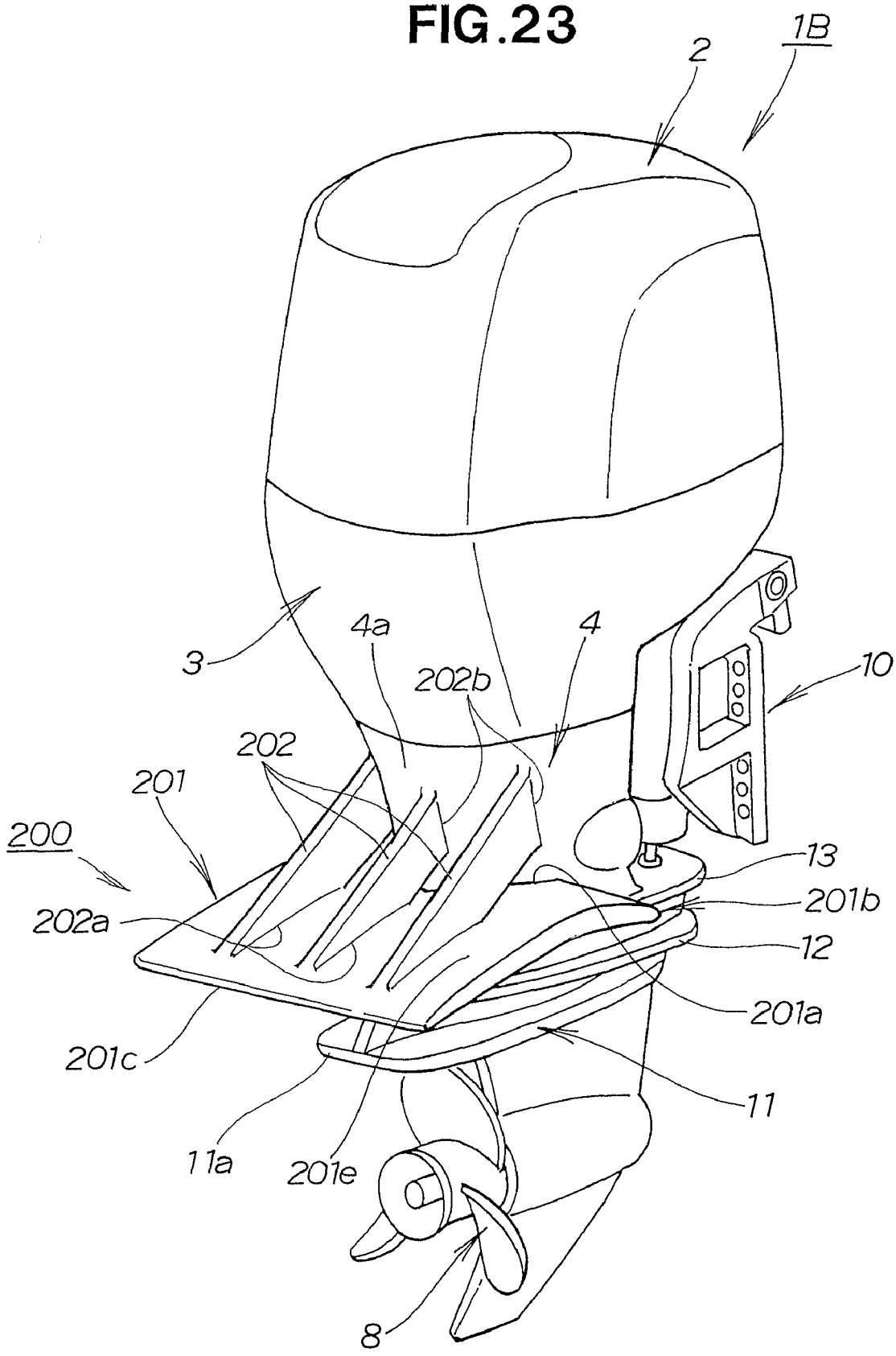
FIG. 23 is a perspective view of the boat propulsion engine according to a sixth embodiment of the present invention.

Next, a boat propulsion engine 1B according to a sixth embodiment will be described with reference to FIGS. 23 through 25.

Figure 24:
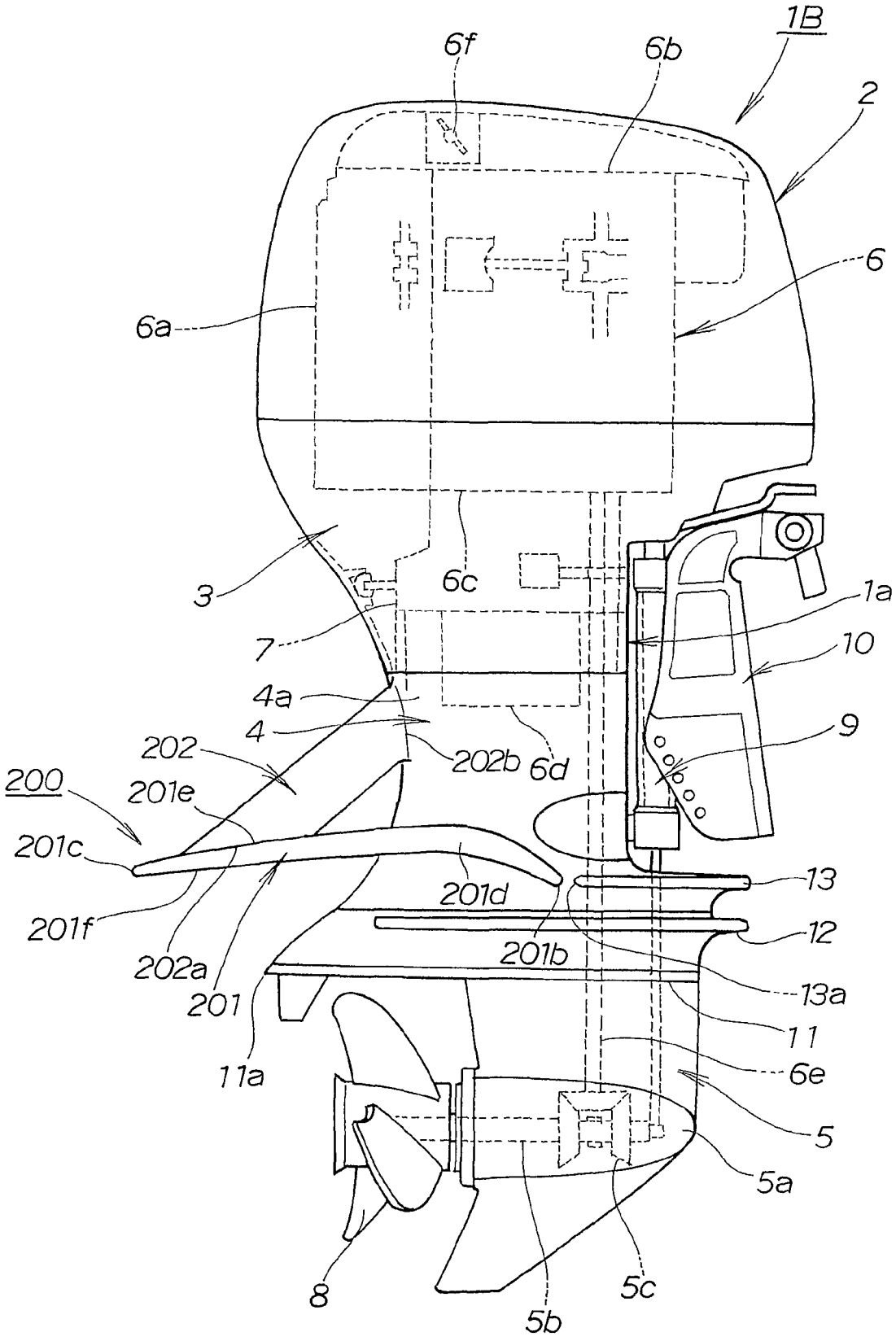
FIG. 24 is a side view of the boat propulsion engine shown in FIG. 23.

The boat propulsion engine 1B of the sixth embodiment is characterized in that the upper anti-splash plate 13 is changed to a configuration provided only to the front half of the extension case 4, and a lift generator 200 is provided, as shown in FIG. 24. The configuration of the boat propulsion engine 1B is otherwise substantially identical to the boat propulsion engine 1 of the first embodiment. The rest of the configuration also is otherwise identical to the configuration of the first embodiment shown in FIGS. 1 through 4, and the same numerical symbols are therefore used and descriptions are omitted.

The lift generator 200 is disposed immediately behind the upper anti-splash plate 13, at substantially the same height as the upper anti-splash plate 13.

Specifically, the lift generator 200 is composed of a single plate-shaped body 201. The plate-shaped body 201 is disposed so as to extend backward from the bottom half of the rear surface 4*a* of the extension case 4, as shown in FIGS. 23 through 25.

The front edge 201*a* of the plate-shaped body 201 is hollowed out in the middle into a substantial U shape when viewed from above. Therefore, the front edge 201*a* of the plate-shaped body 201 is formed so as to encircle the rear surface 4*a* and to extend to the left and right sides of the extension case 4 so that the left and right front ends 201*b* face the rear end 13*a* of the anti-splash plate 13. In other words, the plate-shaped body 201 is formed extending backward from both sides of the longitudinal middle of the extension case 4, so as to encircle the rear periphery. Furthermore, the front edge 201*a* of the plate-shaped body 201 is integrally formed on the rear surface 4*a*. The rear end 201*c* of the plate-shaped body 201 is disposed behind and above the rear end 11*a* of the anti-cavitation plate 11.

The height of the front ends 201*b* is substantially level with the height of the upper anti-splash plate 13. The height of the rear end 201*c* is set to be either substantially level with or slightly lower than the height of the front ends 201*b* to an extent that does not hinder the flow of water.

The entire plate-shaped body 201 is substantially in the shape of a wing. Specifically, the plate-shaped body 201 is formed into the shape of a bow that has a peak 201*d* at the portion that overlaps the extension case 4 when viewed from the side as in FIG. 24, and that has a camber at the top. The slope of the portion behind the peak 201*d* (curved part 201*d*) is less than the slope of the portion in front of the peak 201*d*. The thickness of the plate-shaped body 201 is greatest at the peak 201*d*, and decreases both towards the front ends 201*b* and towards the rear end 201*c*.

The top surface 201*e* and the bottom surface 201*f* of the plate-shaped body 201 are formed into the shape of a bow that has a camber at the top. Furthermore, the bottom surface 201*f* has a recessed angle in the propelled direction of the boat propulsion engine 1B, due to being inclined downward and rearward from the peak 201*d*.

Figure 25:
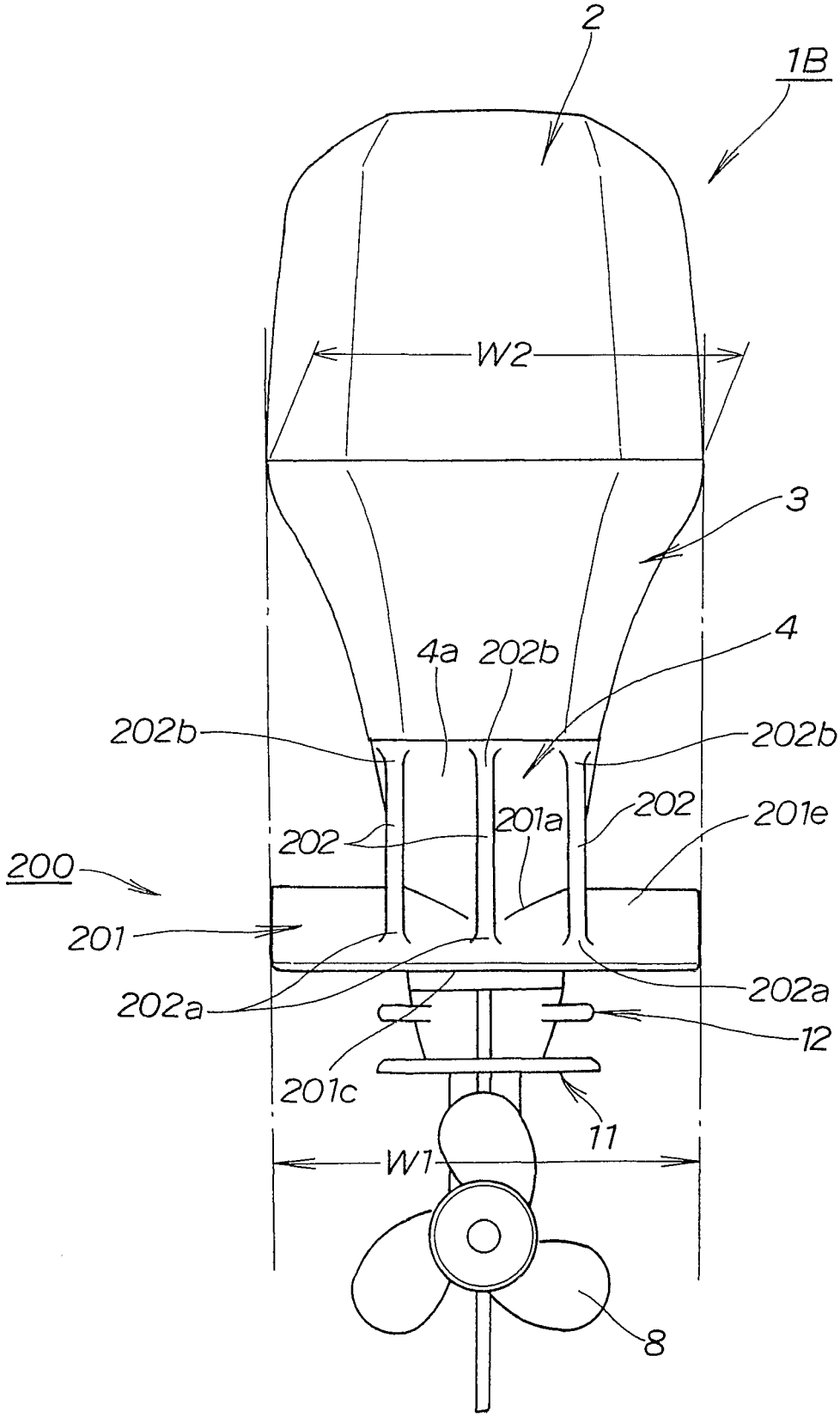
FIG. 25 is a rear view of the boat propulsion engine shown in FIG. 23.
Figure 26:
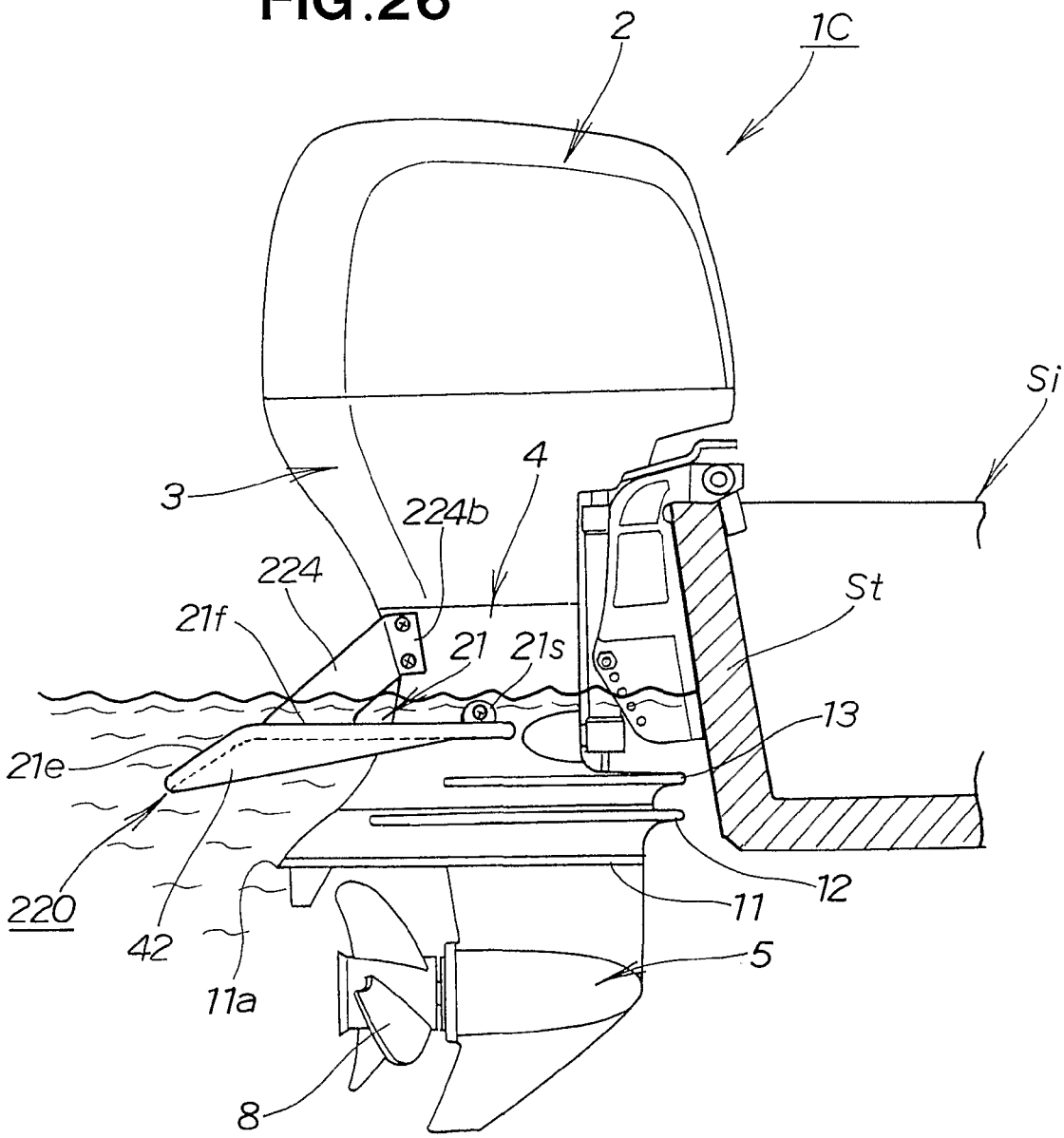
FIG. 26 is a view of a hull equipped with the boat propulsion engine according to a seventh embodiment of the present invention.
Figure 27:
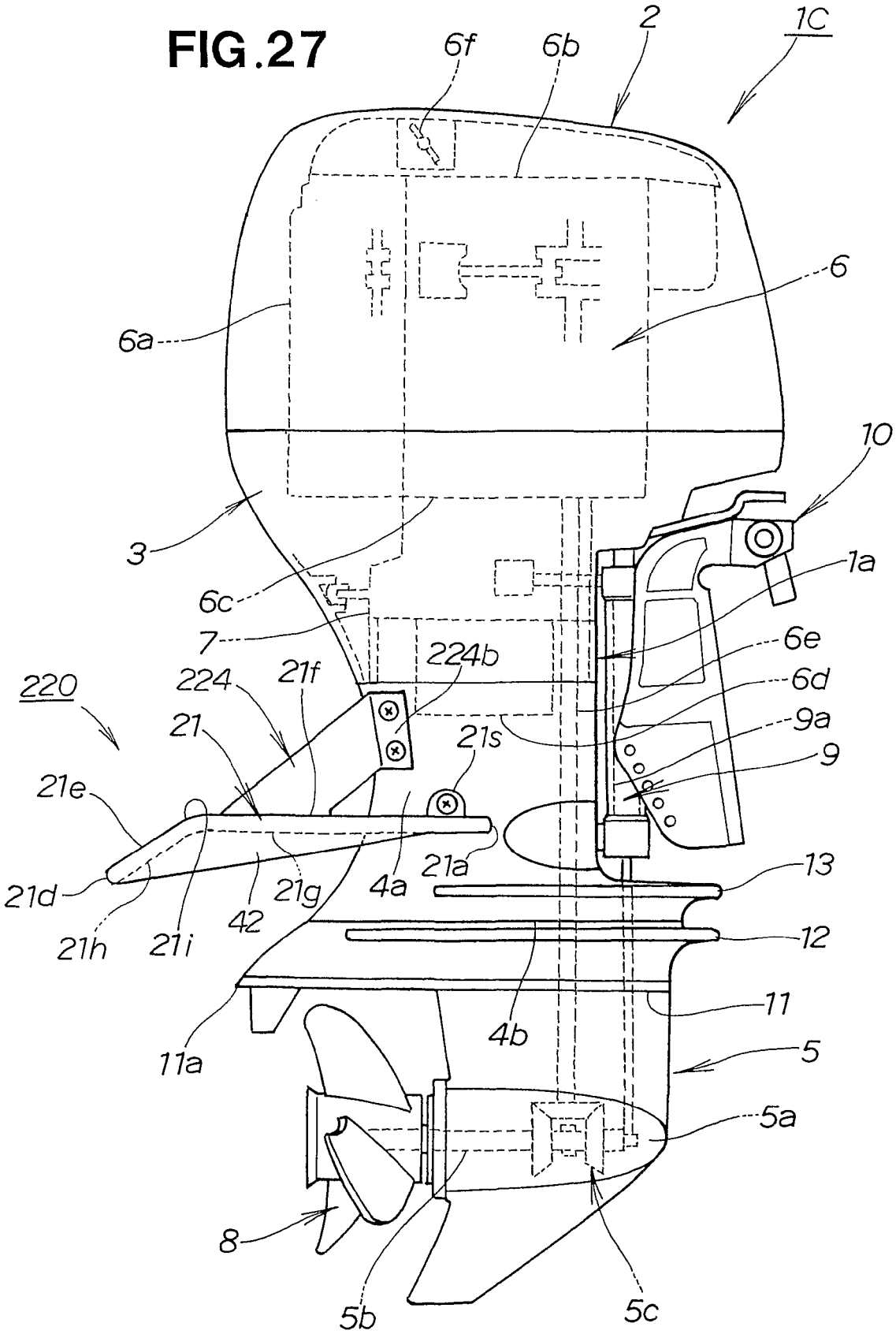
FIG. 27 is a side view of the boat propulsion engine shown in FIG. 26.
Figure 28:
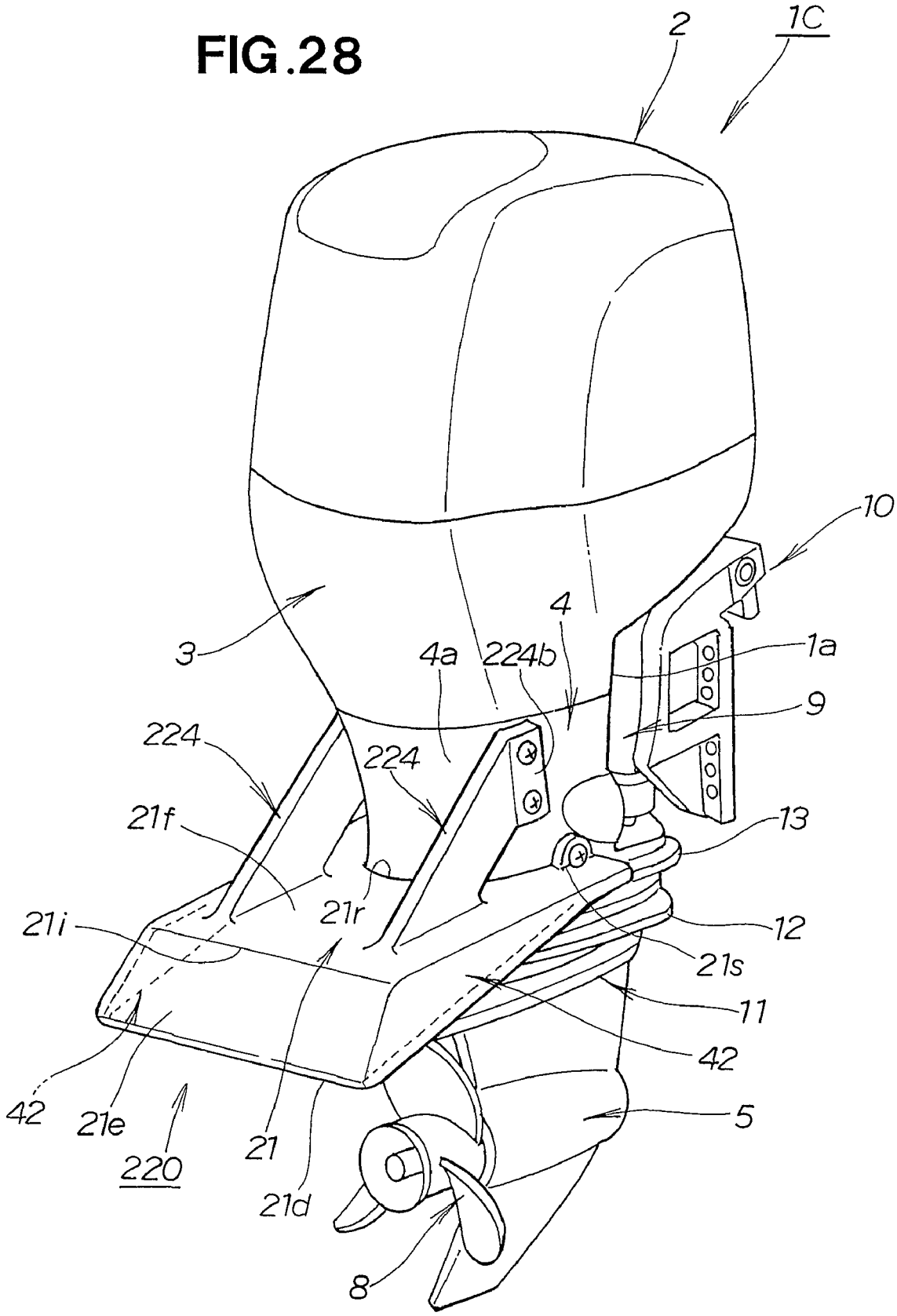
FIG. 28 is a perspective view of the boat propulsion engine shown in FIG. 26.

As shown in FIG. 25, the relationship of the width W1 of the plate-shaped body 201, i.e., of the width W1 of the lift generator 200, to the boat propulsion engine 1B is the same as in the first embodiment shown in FIG. 4. Specifically, the width W1 of the plate-shaped body 201 is preferably either set to be substantially equal to the maximum width W2 of the boat propulsion engine 1B (WL≈W2), or to be slightly less than the maximum width W2 (W1<W2). The width W1 of the plate-shaped body 201 is preferably set to be sufficiently greater than the outside diameter of the propeller 8.

The plate-shaped body 201 is supported by multiple supporting members 202 that extend forward and upward from the top surface 201*e* to the rear surface 4*a* of the extension case 4. The supporting members 202 are composed of three relatively thick vertical plates. The supporting members 202 are all arranged parallel to each other and separated to the left and right in a vertically erected state.

The bottom ends 202*a* of the supporting members 202 are integrally provided to a top surface 201*e* near the rear end 201*c*. The front ends 202*b* of the supporting members 202 are integrally provided at the top of the rear surface 4*a* of the extension case 4. Thus, the supporting members 202 integrally connect the plate-shaped body 201 with the extension case 4.

Next, a boat propulsion engine 1C according to a seventh embodiment will be described with reference to FIGS. 26 through 33.

Figure 33:
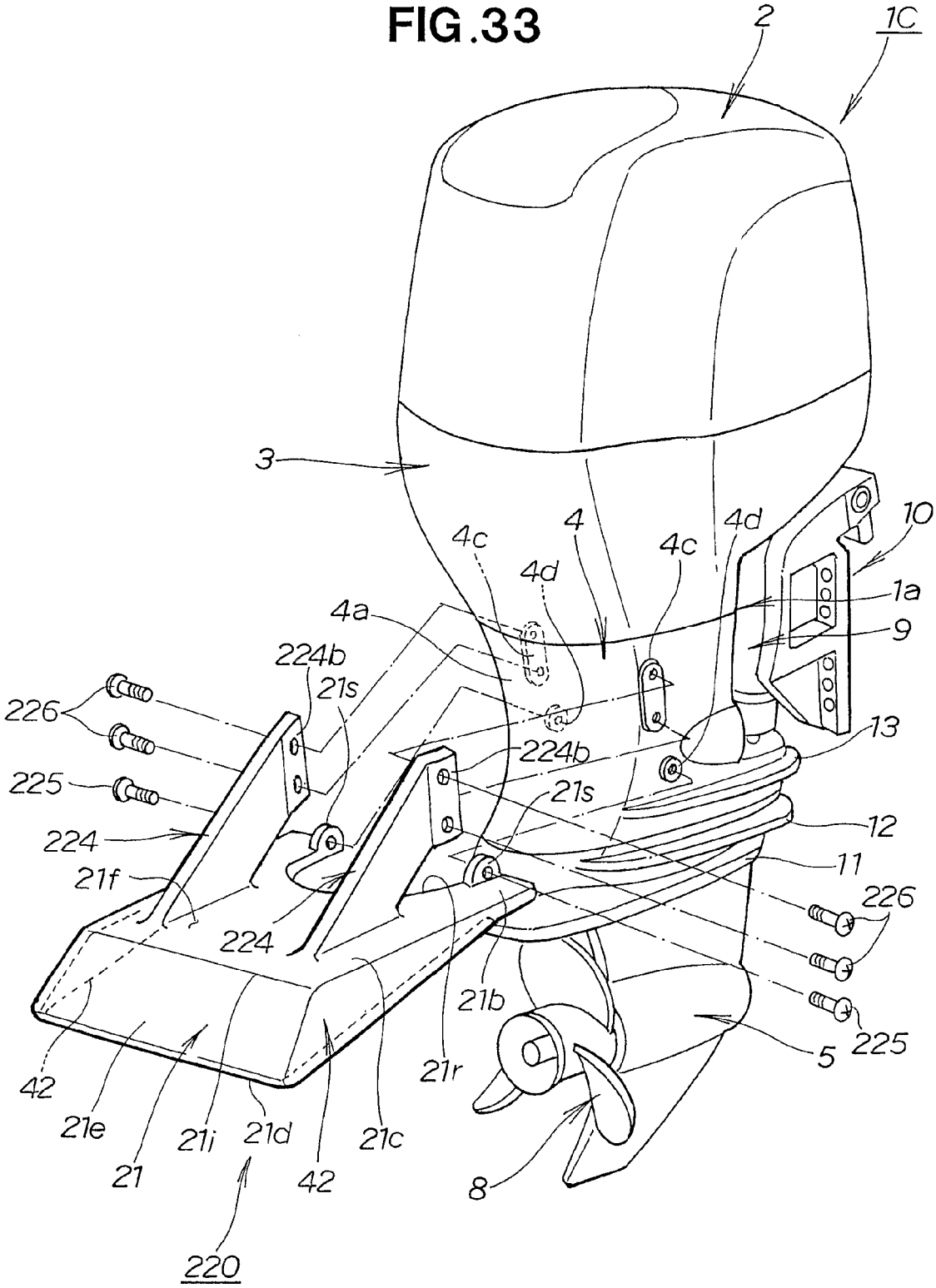
FIG. 33 is an exploded view of the lift generator shown, in FIG. 28, separated from the boat propulsion engine.

The boat propulsion engine 1C of the seventh embodiment is characterized in that a lift generator 220 and multiple supporting members 224 are configured separately from the extension case 4, as shown in FIG. 33. The configuration is otherwise identical to the configuration of the second embodiment shown in FIGS. 8 through 10, and the same numerical symbols are therefore used and descriptions are omitted.

The extension-case 4 of the boat propulsion engine 1C comprises two left and right upper attachment parts 4*c* at the top of the rear surface 4*a*, and two left and right lower attachment parts 4*d* at the bottom of the rear surface 4*a*, as shown in FIG. 33. The upper attachment parts 4*c* are oblong bosses that have attachment holes. The lower attachment parts, 4*d* are small disc-shaped bosses that have attachment holes.

The lift generator 220 is composed of a member that is separated from the extension case 4 and has substantially the same configuration as the lift generator 40 (see FIG. 8) according to the second embodiment. The lift generator 220 is composed of a plate body 21, and side edge parts 42, 42 formed integrally on the left and right edges of the plate body 21. The configuration of the plate body 21 and the side edge parts 42, 42 is substantially the same as in the second embodiment, and the same numerical symbols are therefore used and descriptions are omitted.

The front edge of the plate body 21 has an arcuate concavity 21*r* along the rear surface 4*a* of the extension case 4. As a result, the concavity 21*r* encircles the rear surface 4*a*. The front half 21*b* of the plate body 21 has two attachment bosses 21*s* at positions transversely relative to the concavity 21*r*. The attachment bosses 21*s* are formed so as to protrude upward from the top surface of the front half 21*b*. The attachment bosses 21*s* come in contact with the lower attachment parts 4*d* and are attached to the lower attachment parts 4*d* with bolts 225.

The plate body 21 is supported by multiple supporting members 224 that extend forward and upward from the top surface 21*f* of the plate body 21 to the rear surface 4*a* of the extension case 4. More specifically, the supporting members 224 are composed of two relatively thick vertical plates. The supporting members 224 are all disposed parallel to each other and are separated to the left and right in a vertically erected state. The bottom ends 224*a* of the supporting members 224 are integrally provided at the top surface 21*f* near the border between the intermediate part 21*c* and the rear inclined part 21*e*.

The supporting members 224 have attachment pieces 224*b* at the front ends. The attachment pieces 224*b* come in contact with the upper attachment parts 4*c* and are attached to the upper attachment parts 4*c* with bolts 226. Thus, the supporting members 224 integrally connect the top surface 21*f* of the plate body 21 with the rear surface 4*a* of the extension case 4.

Figure 29:
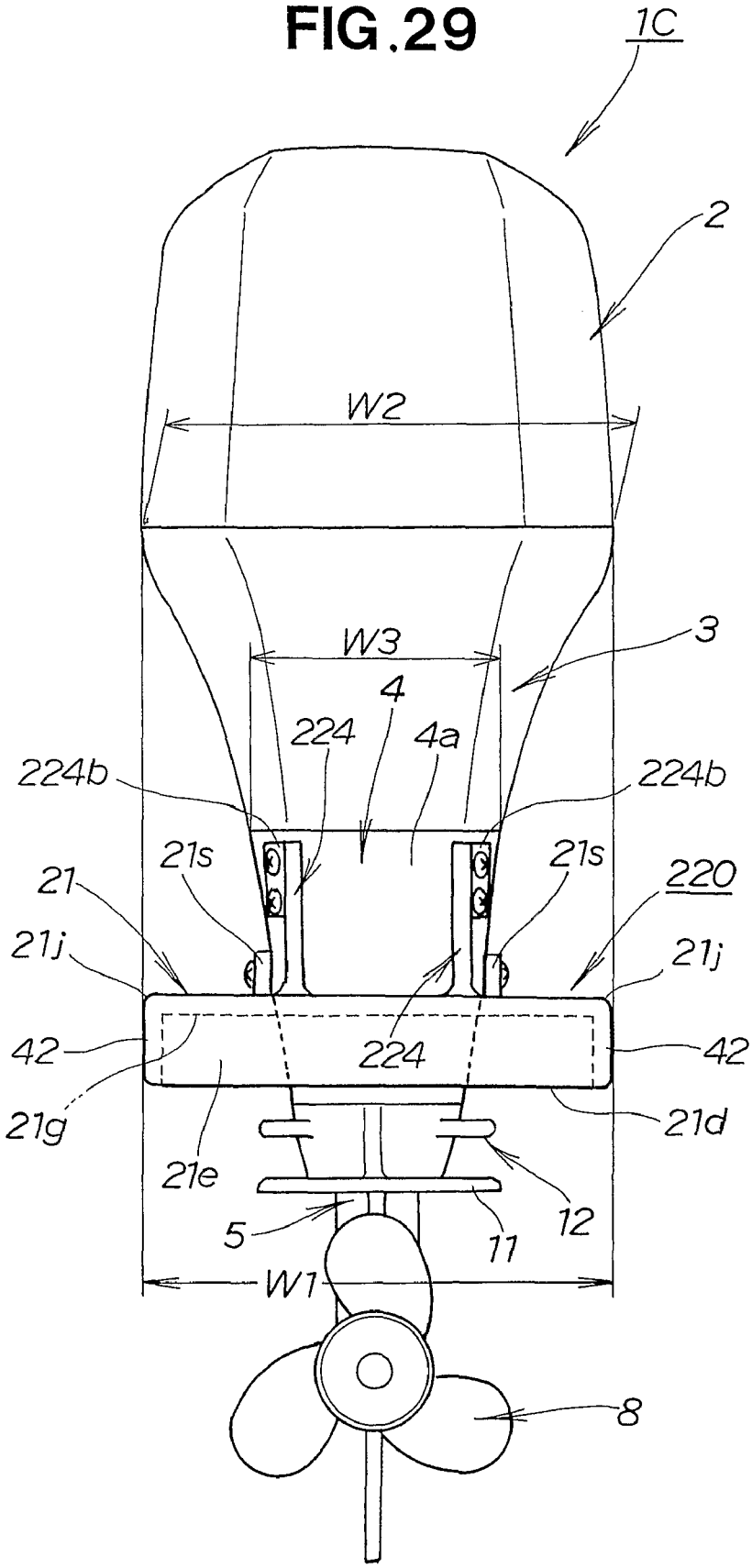
FIG. 29 is a rear view of the boat propulsion engine shown in FIG. 26.
Figure 30:
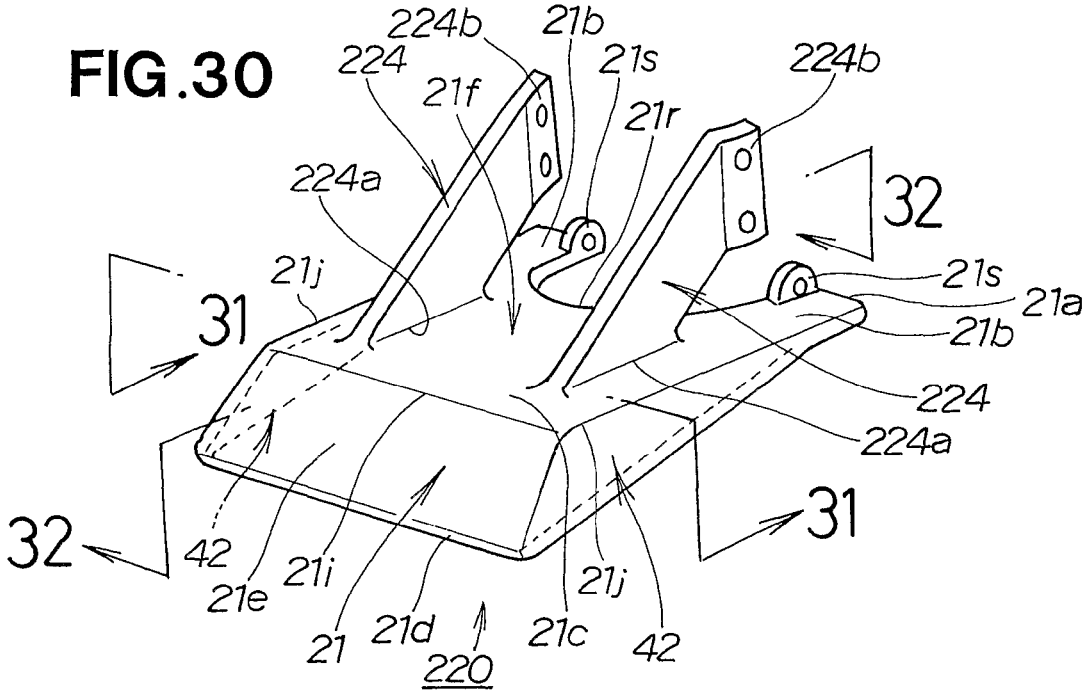
FIG. 30 is a perspective view of the lift generator shown in FIG. 28.
Figure 31:
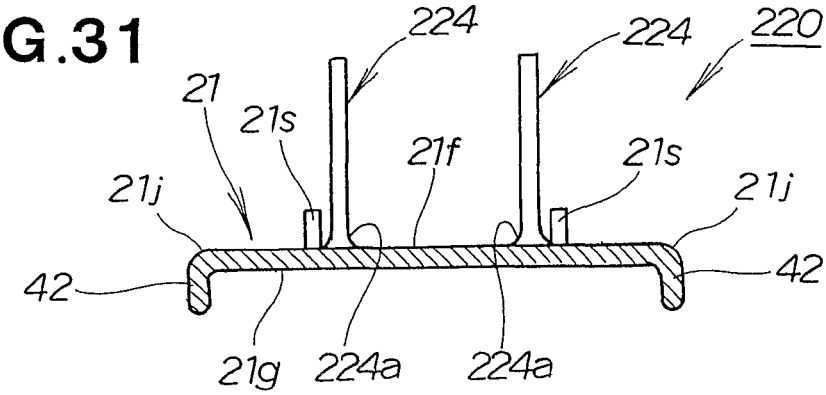
FIG. 31 is a cross-sectional view taken along line 31-31 of FIG. 30.
Figure 32:
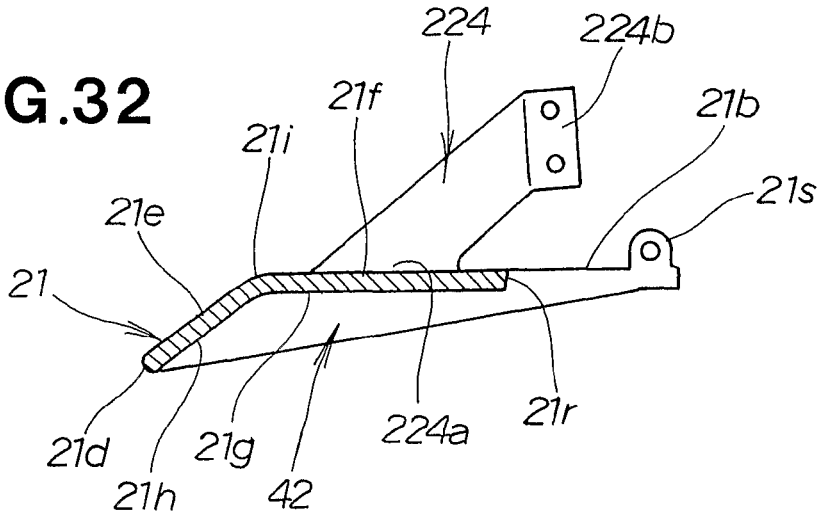
FIG. 32 is a cross-sectional view taken along line 32-32 of FIG. 30.

The distance between the outer surfaces of the left and right supporting members 224, 224 (the distance including the thicknesses) is set within a range of the width W3 of the extension case 4, when the boat propulsion engine 1C is viewed from the rear as in FIG. 29. It is more preferable that the left and right supporting members 224, 224 be disposed so as not to protrude to the sides past the contours of the extension case 4. Therefore, when the hull Si moves forward, wave-making resistance from the left and right supporting members 224, 224 can be reduced, splashing can be reduced when the boat moves, and smooth lift action can be achieved.

The relationship of the plate body 21 to the propeller 8 and the plates 11, 12, 13, as well as the size of the plate body 21, are the same as in the first embodiment.

The procedure of assembling the lift generator 220 and the supporting members 224 on the boat propulsion engine 1C is as follows.

First, the concavity 21*r* of the plate body 21 is fitted over the rear surface 4*a* of the extension case 4, as shown in FIG. 33.

Next, the left and right attachment pieces 224*b* are aligned with the left and right upper attachment parts 4*c*, and the left and right attachment bosses 21*s* are aligned with the left and right lower attachment parts 4*d*.

Finally, the left and right attachment pieces 224*b* are attached using bolts 226 to the left and right upper attachment parts 4*c*, and the left and right attachment bosses 21*s* are attached using bolts 225 to the left and right lower attachment parts 4*d*, completing the operation. As a result, the lift generator 220 and the supporting members 224 are assembled on the boat propulsion engine 1C.

Next, a first modification of the lift generator 220 (see FIG. 28) according to the seventh embodiment will be described with reference to FIG. 34.

Figure 34:
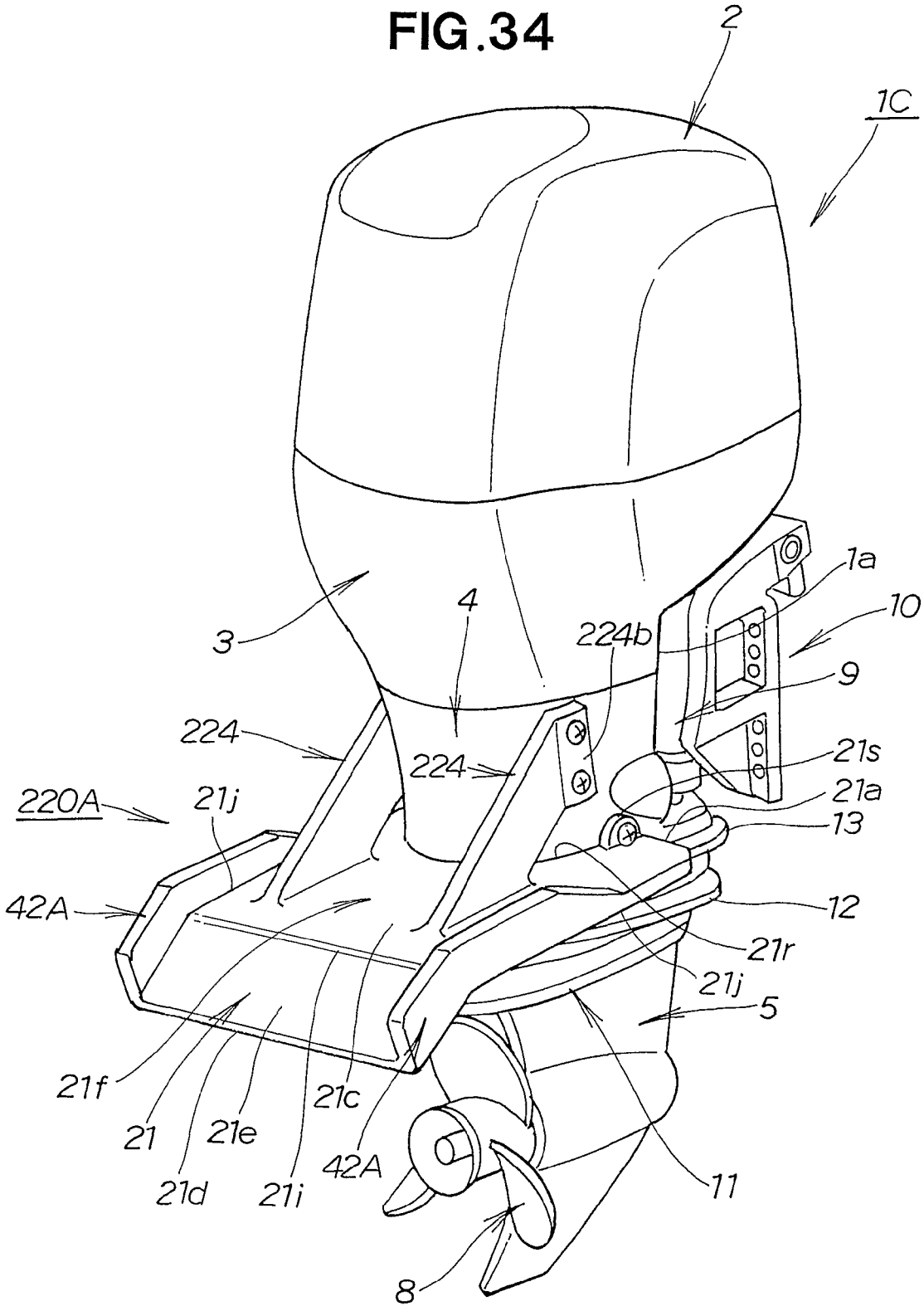
FIG. 34 is a perspective view of a first modification of the boat propulsion engine according to the seventh embodiment of the present invention.

The lift generator 220A of the first modification is characterized in that the left and right side edge parts 42, 42 (see FIG. 28) of the seventh embodiment are changed to left and right side edge parts 42A, 42A, as shown in FIG. 34. The configuration is otherwise identical to the configuration of the seventh embodiment shown in FIGS. 26 through 33, and the same numerical symbols are therefore used and descriptions are omitted.

The left and right side edge parts 42A, 42A are plate-shaped reinforcing bodies formed so as to extend upward from the left and right side edges 21*j*, 21*j* of the plate body 21. The left and right side edge parts 42A, 42A are formed continuously on the intermediate part 21*c* and the rear inclined part 21*e* in the plate body 21. The lift generator 220A has increased rigidity due to the side edge parts 42A, 42A that extend upward from the left and right edges of the plate body 21.

Figure 35:
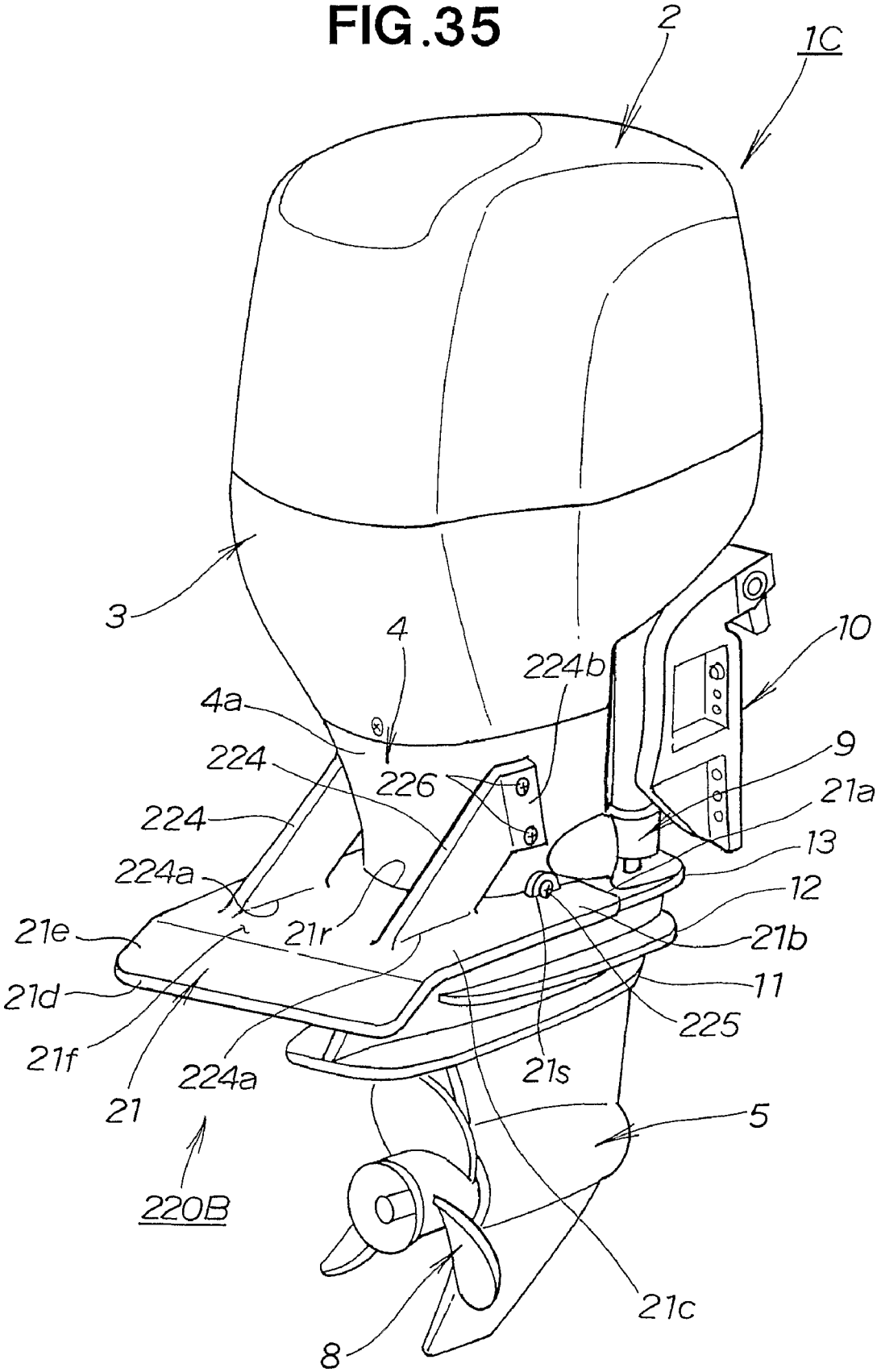
FIG. 35 is a perspective view of a second modification of the boat propulsion engine according to the seventh embodiment of the present invention.

Next, a second modification of the lift generator 220 (see FIG. 28) according to the seventh embodiment will be described with reference to FIG. 35.

The lift generator 220B of the second modification is characterized in lacking the left and right side edge parts 42, 42 (see FIG. 28) formed on the plate body 21. The configuration is otherwise identical to the configuration of the seventh embodiment shown in FIGS. 26 through 33, and the same numerical symbols are therefore used and descriptions are omitted.

Next, a boat propulsion engine 300 according to an eighth embodiment will be described with reference to FIG. 36.

Figure 36:
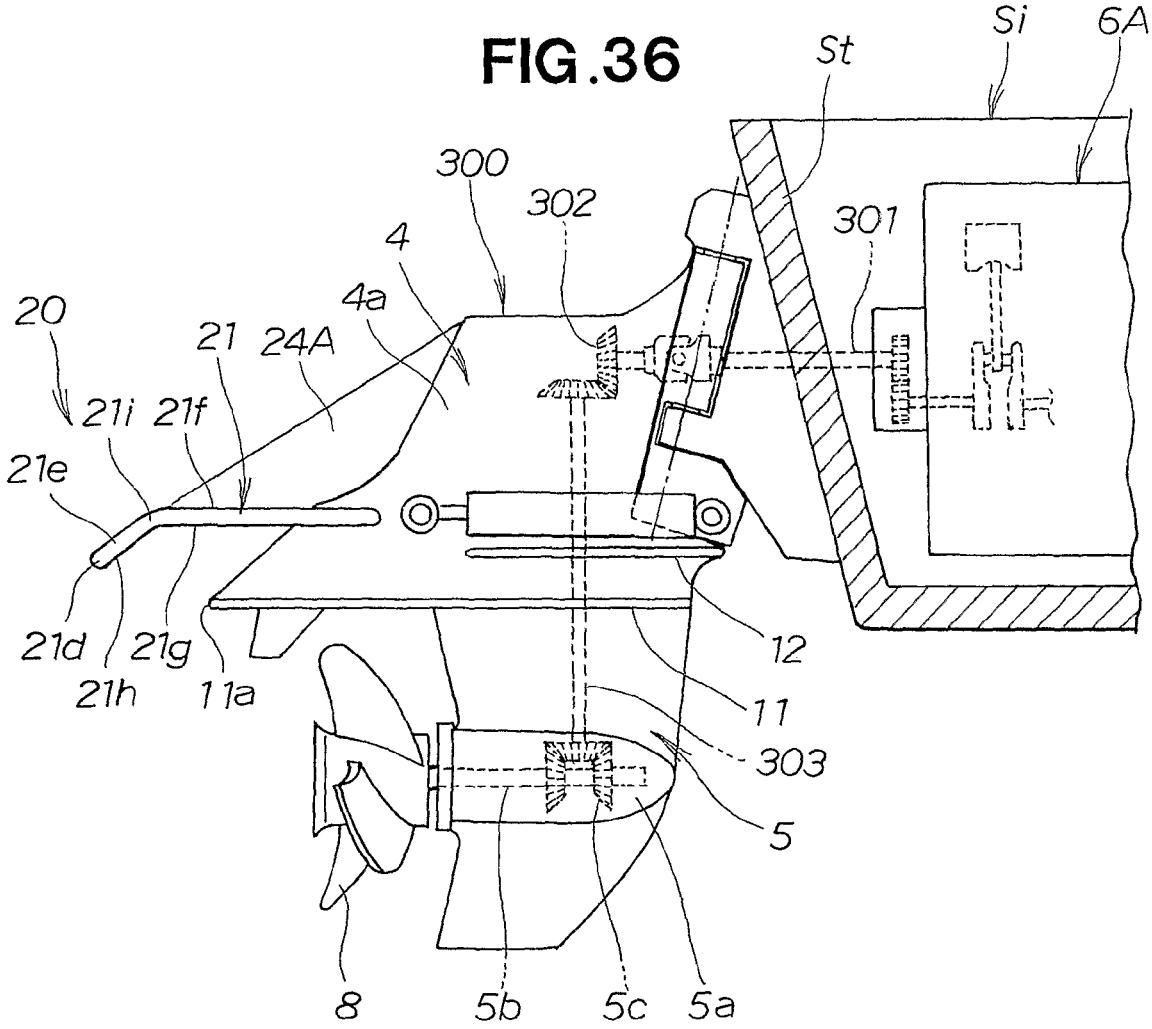
FIG. 36 is a view of a hull equipped with the boat propulsion engine according to an eighth embodiment of the present invention.

The boat propulsion engine 300 of the eighth embodiment is characterized in that the engine part 6A is an inboard engine-outboard drive unit housed within the hull Si, as shown in FIG. 36. Components that are similar to those of the first embodiment are denoted by the same numerical symbols, and detailed descriptions thereof are omitted.

More specifically, the boat propulsion engine 300 is attached to the stern St. The engine part 6A is a drive source that is housed within the hull Si. A first drive shaft 301 from the engine part 6A extends horizontally so as to protrude from the stern St out to the rear exterior. The first drive shaft 301 is linked to a second drive shaft 303 via a gear mechanism 302. The second drive shaft 303 passes through the extension case 4 and the gear case 5. The propeller 8 is rotated by the second drive shaft 303.

The engine part 6A is a multi-cylinder engine having multiple cylinders, and the essential structure thereof is substantially identical to that of the engine part 6 of the first embodiment. This engine part 6A is a so-called horizontal engine, wherein a crankshaft and a camshaft are disposed with a horizontal orientation. The cylinders are disposed in a transverse orientation, with their axes oriented in the longitudinal direction.

The extension case 4 (main body 4) is configured so as to accommodate the second drive shaft 303, which extends vertically for the most part to transmit a drive force of the engine part 6A to the propeller 8. Furthermore, the extension case 4 comprises a lift generator 20 and multiple supporting members 24A. The lift generator 20 has the same configuration as in the first embodiment. The supporting members 24A have substantially the same essential structure as the supporting members 24 of the first embodiment.

Next, a modification of the boat propulsion engine 300 according to the eighth embodiment will be described with reference to FIG. 37.

Figure 37:
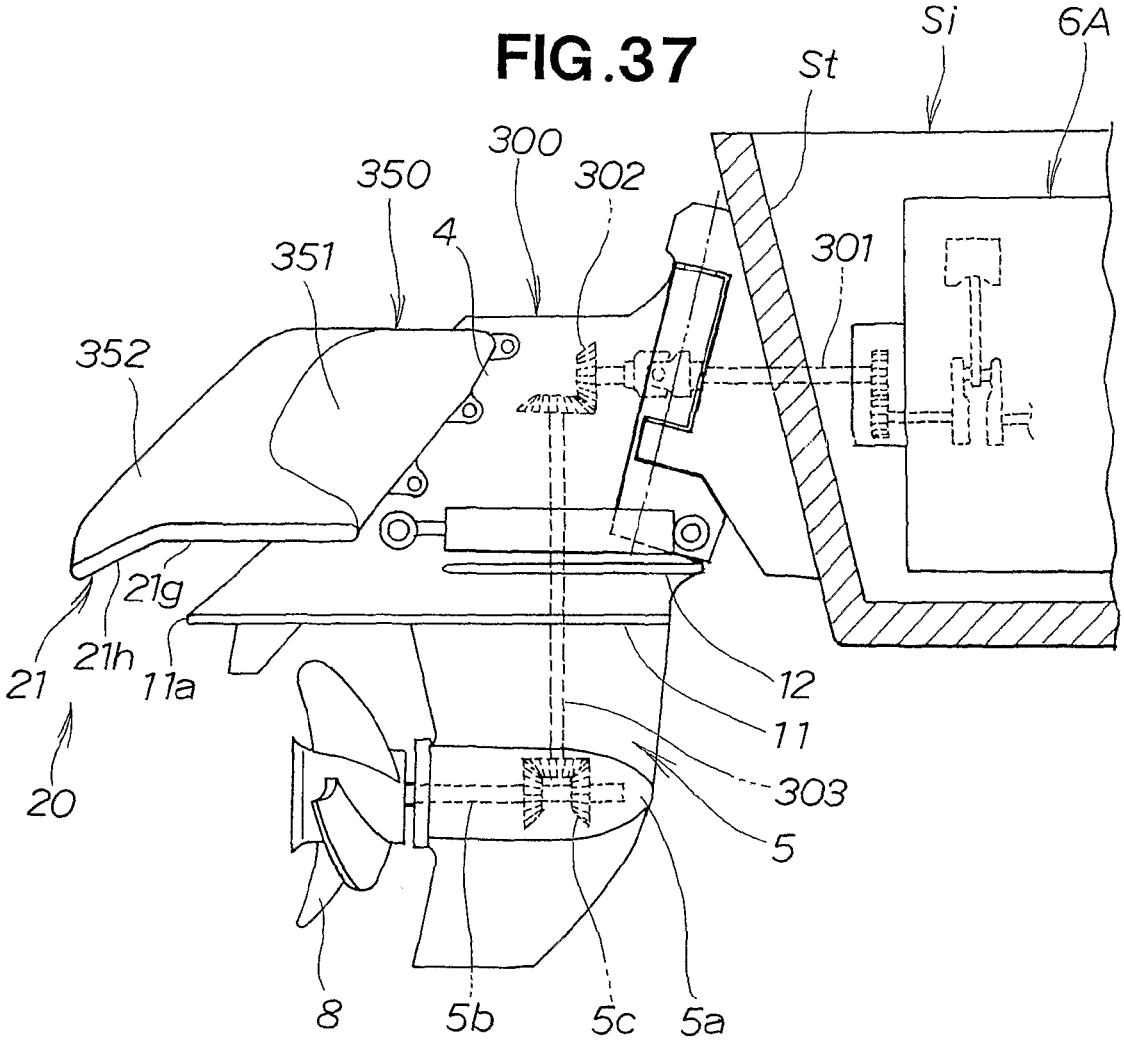
FIG. 37 is a view of a hull equipped with a boat propulsion engine according to a modification of the eighth embodiment of the present invention.

The boat propulsion engine 300 is characterized in that a buoyant body 350 is attached to the rear of the extension case 4, as shown in FIG. 37. The configuration is otherwise identical to the configuration of the eighth embodiment shown in FIG. 36, and the same numerical symbols are therefore used and descriptions are omitted.

Specifically, the buoyant body 350 is disposed so as to be superposed over the plate body 21 of the lift generator 20. The buoyant body 350 is composed of a front half 351 formed to be substantially horizontal, and a rear half 352 that is inclined downward and rearward. In other words, the bottom surface of the buoyant body 350 is curved in a dogleg shape. When the hull Si accelerates from a standstill, lift acts in addition to the buoyancy of the buoyant body 350 itself to raise the stern St. This lift results from the presence of the inclined surface 21*h* in the rear half 352. Therefore, when the boat accelerates, the stern St is raised quickly, and the hull Si is smoothly brought to a horizontal orientation.

Thus, the boat propulsion engines 1, 1A through 1C, and 300 can be applied to inboard/outboard engines as well as outboard engines.

INDUSTRIAL APPLICABILITY

The present invention is preferred for rapidly and smoothly bringing a boat to high speeds in the initial phase of propulsion by means of a boat propulsion engine 1, 1A through 1C, or 300 attached to the stern St of the hull Si.

The invention claimed is:

1. A boat propulsion engine adapted to be mounted to a hull, comprising:

a main body; and a lift generator provided to the main body, wherein the lift generator includes:

a first portion that constitutes a substantially horizontal first bottom surface; and a second portion that constitutes a second bottom surface extended continuously rearward from the rear end of the first bottom surface and that is inclined downward and rearward, wherein the first portion and second portion are integral, reinforcing bodies extending in the longitudinal direction are provided across the entire first portion and second portion, the reinforcing bodies are provided to a top surface and left and right side edges of the lift generator.

2. The boat propulsion engine of claim 1, wherein the reinforcing bodies are provided within a range of the width of the boat propulsion engine when the boat propulsion engine is viewed from behind.

3. The boat propulsion engine of claim 2, wherein the reinforcing bodies are provided to a top surface of the lift generator.

4. The boat propulsion engine of claim 1, wherein the reinforcing bodies are provided to a bottom surface of the lift generator.

* * * * *